US010362924B2

(12) United States Patent
Lee et al.

(10) Patent No.: US 10,362,924 B2
(45) Date of Patent: Jul. 30, 2019

(54) JET UNIT, JET NOZZLE AND MANUFACTURING METHOD THEREOF, AND DISH WASHING MACHINE HAVING THE SAME

(71) Applicant: SAMSUNG ELECTRONICS CO., LTD., Suwon-si, Gyeonggi-do (KR)

(72) Inventors: Chang Wook Lee, Seoul (KR); Min Ho Jung, Suwon-si (KR); Hyun Dong Jung, Suwon-si (KR); Chan Young Park, Suwon-si (KR); Soo Hyung Yoo, Incheon (KR); Seung Gee Hong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 987 days.

(21) Appl. No.: 14/531,446

(22) Filed: Nov. 3, 2014

(65) Prior Publication Data

US 2015/0129004 A1 May 14, 2015

(30) Foreign Application Priority Data

Nov. 12, 2013 (KR) ..... 10-2013-0137054
Dec. 31, 2013 (KR) ..... 10-2013-0169541

(51) Int. Cl.
*A47L 15/42* (2006.01)
*A47L 15/16* (2006.01)
(Continued)

(52) U.S. Cl.
CPC ..... *A47L 15/4278* (2013.01); *A47L 15/16* (2013.01); *A47L 15/4282* (2013.01); *B05B 1/02* (2013.01); *B05B 1/20* (2013.01)

(58) Field of Classification Search
CPC ..... A47L 15/4278
See application file for complete search history.

(56) References Cited

U.S. PATENT DOCUMENTS 4,457,343 A * 7/1984 Zukausky ..... G05D 7/012 138/45
5,664,733 A * 9/1997 Lott ..... B01F 5/02 239/429
(Continued)

FOREIGN PATENT DOCUMENTS

CN 1128130 8/1996
CN 1493248 5/2004
(Continued)

OTHER PUBLICATIONS

Decision on grant dated Jul. 12, 2017 in corresponding European Patent Application No. 12 192 727.2.
(Continued)

*Primary Examiner* — Michael E Barr
*Assistant Examiner* — Jason P Riggleman
(74) *Attorney, Agent, or Firm* — Staas & Halsey LLP

(57) ABSTRACT

A dish washing machine including a cabinet configured to form an exterior, a washing tub provided in the cabinet to wash dishes, and a jet nozzle configured to jet washing water to the washing tub, wherein the jet nozzle includes a plurality of nozzle inner walls provided therein to form a passage through which the washing water passes and having a plurality of passage inner walls provided to have arc shapes in section vertical to a flow direction of the washing water. Due to such configuration, a jetting force may be enhanced and washing efficiency may be also improved.

8 Claims, 80 Drawing Sheets

(51) Int. Cl.
*B05B 1/02* (2006.01)
*B05B 1/20* (2006.01)

(56) References Cited

U.S. PATENT DOCUMENTS

| | | | | |
|---|---|---|---|---|
| 5,992,763 | A | 11/1999 | Smith et al. | |
| 7,931,754 | B2 | 4/2011 | Kehl et al. | |
| 2010/0108102 | A1* | 5/2010 | Kehl | A47L 15/23 134/25.2 |

FOREIGN PATENT DOCUMENTS

| | | | |
|---|---|---|---|
| CN | 1214758 | | 8/2005 |
| CN | 101416857 | | 4/2009 |
| CN | 201389002 | | 1/2010 |
| CN | 103126637 | | 6/2013 |
| CN | 103321688 | | 9/2013 |
| DE | 1628813 | | 7/1970 |
| DE | 102010043019 | A1 | 5/2012 |
| EP | 2192852 | | 6/2010 |
| JP | 2003-299988 | | 10/2003 |
| KR | 10-2006-0029863 | | 7/2006 |
| KR | 10-1036543 | | 5/2011 |
| KR | 10-2012-0104751 | | 9/2012 |
| WO | 92/12665 | | 8/1992 |

OTHER PUBLICATIONS

Australian Office Action dated Apr. 28, 2017 in corresponding Australian Patent Application No. 2014349415.
PCT International Search Report dated Feb. 25, 2015 in corresponding International Patent Application No. PCT/KR2014/010601.
Extended European Search Report dated Mar. 11, 2015 in corresponding European Patent Application No. 14192727.7.
Australian Notice of Acceptance for Patent Application dated Sep. 20, 2017 in Australian Patent Application No. 2014349415.
European Office Action dated Jul. 4, 2016 in corresponding European Patent Application No. 14 192 727.7.
Chinese Office Action dated Apr. 27, 2018 in Chinese Patent Application No. 201410645691.0.
Chinese Office Action dated Jan. 2, 2019 in Chinese Patent Application No. 201410645691.0.

* cited by examiner

JET UNIT, JET NOZZLE AND MANUFACTURING METHOD THEREOF, AND DISH WASHING MACHINE HAVING THE SAME

CROSS-REFERENCE TO RELATED APPLICATIONS

This application claims the benefit of Korean Patent Application Nos. 10-2013-0137054 and 10-2013-0169541, filed on Nov. 12, 2013 and Dec. 31, 2013 in the Korean Intellectual Property Office, the disclosures of which are incorporated herein by reference.

BACKGROUND

1. Field

Embodiments of the present disclosure relate to a dish washing machine which has a jet nozzle fixed to one side of a washing tub, and a vane movably disposed in the washing tub and configured to reflect washing water jetted from the jet nozzle to a dish side.

2. Description of the Related Art

Dish washing machines are home appliances including a main body having a washing tub therein, a basket configured to receive dishes, a sump configured to store washing water, a jet nozzle configured to jet the washing water, and a pump configured to supply the washing water in the sump to the jet nozzle, and configured to jet high pressure washing water to the dishes and thus wash the dishes.

Generally, the dish washing machines employ a rotor type jet structure having a rotary jet nozzle. The rotary nozzle is rotated by water pressure to jet the washing water. However, since the rotary nozzle may jet the washing water to only a range within a rotational radius thereof, an area in which the washing water is not jetted may be generated. Therefore, there has been proposed a linear type jet structure which has no area in which the washing water is not jetted.

The linear type jet structure includes a fixed nozzle fixed to one side of a washing tub, and a vane movably disposed in the washing tub and configured to reflect washing water jetted from the jet nozzle to a dish side, and may jet the washing water to an entire area of the wash tub according to movement of the reflection plate.

The fixed nozzle may have a plurality of jet holes arranged in left and right directions of the washing tub, and may be fixed to a rear wall of the washing tub, and the vane may be formed to extend in the left and right directions of the washing tub to reflect the washing water jetted through the plurality of jet holes and provided to linearly reciprocate in front and rear directions of the washing tub.

The linear type jet structure further includes a driving device configured to drive the vane. The driving device may be embodied in various manners. As an example, the driving device may include a motor, a belt connected to the motor to transmit a driving force to the vane, and a rail configured to guide movement of the vane. When the motor is driven, the belt is rotated, and thus the vane is moved on the rail.

In a distribution device configured to distribute the washing water stored in the sump to the jet nozzles, when comparing with the rotor type jet structure, the linear type jet structure may prefer another type distribution device.

In the case in which the jet nozzles disposed under the washing tub are rotary nozzles, when an outlet of the distribution device is disposed upward, a length of a passage connecting the outlet of the distribution device and the rotary nozzles may be shortened and pressure loss of the washing water may be minimized.

However, in the case in which the jet nozzles disposed under the washing tub are fixed nozzles, since the fixed nozzles are disposed to be adjacent to the rear wall, the outlet of the distribution device is not needed to be disposed upward. On the contrary, if the outlet of the distribution device is disposed upward, the passage connecting the outlet of the distribution device and the fixed nozzles should be bent from the outlet of the distribution device toward a rear side thereof, and thus the pressure loss of the washing water may be increased.

On the other hand, in the linear type jet structure, since the jet nozzles are fixed, it is possible to perform a divided washing operation in which the washing water may be distributed to only parts of the whole jet nozzles so that the washing water is jetted to only a partial area in the washing tub.

SUMMARY

Therefore, it is an aspect of the present disclosure to provide a jet unit, a jet nozzle and a manufacturing method thereof, and a dish washing machine having the same, which may enhance straightness of washing water and may also have a compact washing structure.

It is another aspect of the present disclosure to provide a jet unit, a jet nozzle and a manufacturing method thereof, and a dish washing machine having the same, which may enhance straightness of washing water and may also have improved durability of the jet nozzle.

Additional aspects of the disclosure will be set forth in part in the description which follows and, in part, will be apparent from the description, or may be learned by practice of the disclosure.

In accordance with one aspect of the present disclosure, a dish washing machine includes a cabinet configured to form an exterior, a washing tub provided in the cabinet to wash dishes, and a jet nozzle configured to jet washing water to the washing tub, wherein the jet nozzle includes a plurality of nozzle inner walls provided therein to form a passage through which the washing water passes and having a plurality of passage inner walls provided to have arc shapes in section vertical to a flow direction of the washing water.

Centers of curvature radii of the plurality of passage inner walls may be spaced apart from each other.

A cross sectional area of the passage at a first point may be formed to be wider than that of the passage at a second point which is located downstream of the first point.

The nozzle inner wall may include a plurality of protrusions which are formed by that the plurality of passage inner walls are in contact with each other and protrude toward the passage.

The plurality of protrusions may protrude in the same direction as the flow direction of the washing water.

The plurality of protrusions may be arranged along the nozzle inner wall to be spaced apart from each other in a circumferential direction.

When the plurality of protrusions protrude from the nozzle inner wall to have a first height at a first point, and also protrude from the nozzle inner wall to have a second height at a second point which is located downstream of the first point in the flow direction of the washing water, the second height may be greater than the first height.

The plurality of protrusions may be formed to have convexly curved shapes toward the passage.

In accordance with another aspect of the present disclosure, a jet unit includes a jet nozzle configured to guide and jet washing water, a nozzle inner wall provided at the jet nozzle to form a passage through which the washing water passes, and a plurality of protrusions formed to more protrude toward the passage than the adjacent nozzle inner wall.

The plurality of protrusions may include a top portion formed to protrude from the nozzle inner wall toward the passage, and side portions formed at both side surfaces of the top portion.

The top portion may protrude in the same direction as a flow direction of the washing water.

When the plurality of protrusions protrude from the nozzle inner wall to have a first height at a first point, and also protrude from the nozzle inner wall to have a second height at a second point which is located downstream of the first point in the flow direction of the washing water, the second height may be greater than the first height.

The nozzle inner wall may include a plurality of passage inner walls having arc shapes in section vertical to a flow direction of the washing water.

The nozzle inner wall may include a plurality of passage inner walls having arc shapes in section vertical to a flow direction of the washing water, and the side portions may be respectively formed to have the same curvature as that of the adjacent one of the plurality of passage inner walls.

Centers of curvature radii of the plurality of passage inner walls may be spaced apart from each other.

Assuming that a cross sectional area of the passage, which is vertical to a flow direction of the washing water, at a first point is a first area, and a cross sectional area of the passage, which is vertical to the flow direction of the washing water, at a second point located downstream of the first point is a second area, the first area may be formed to be wider than the second area.

The nozzle inner wall may include a first nozzle inner wall defining a first passage and formed to have a gradient toward a center of the passage in the flow direction of the washing water, and a second nozzle inner wall defining a second passage in communication with the first passage and formed to have a gradient in a direction to become more distant from the center of the passage.

The jet nozzle may further include a washing water jet port provided at an end of the passage to jet the washing water, and the washing water jet port may be formed at a more inner side than an end of the jet nozzle.

In accordance with yet another aspect of the present disclosure, a jet unit includes a jet nozzle configured to jet washing water, and a jet passage provided in the jet nozzle so that the washing water passes therethrough, wherein the jet passage includes a plurality of sub-passages formed so that the washing water passes therethrough and also formed to be at least partly overlapped with each other.

A plurality of sub-passage axes passing through centers of the plurality of sub-passages may be formed to be spaced apart from a jet passage axis passing through a center of the jet passage.

A separation distance between the jet passage axis and the plurality of sub-passage axes may become smaller in a flow direction of the washing water.

The jet nozzle includes an inlet port configured to allow washing water to be introduced into the jet passage therethrough and an outlet port configured to allow washing water of the jet passage to be discharged therethrough; and the plurality of sub-passages allows washing water to be introduced through the inlet port and discharged through the outlet port.

The plurality of sub-passages may be formed to have the same diameters, and a distance between a plurality of sub-passage axes passing through centers of the plurality of sub-passages may be formed to be smaller than diameters of the plurality of sub-passages.

A plurality of sub-passage axes passing through centers of the plurality of sub-passages may be radially arranged around a jet passage axis passing through a center of the jet passage.

The jet unit may further include a nozzle inner wall formed in the jet nozzle to define the jet passage, and a protrusion configured to protrude from the nozzle inner wall toward a jet passage axis passing through a center of the jet passage.

The protrusion may be provided to have a protruding degree which becomes greater in a flow direction of the washing water.

In accordance with still another aspect of the present disclosure, a dish washing machine includes a cabinet configured to form an exterior, a washing tub provided in the cabinet to wash dishes, and a jet nozzle having a passage formed therein to jet washing water to the washing tub, wherein the jet nozzle includes a nozzle inner wall defining the passage and having a plurality of passage inner walls provided to have arc shapes in section vertical to a flow direction of the washing water.

In accordance with yet still another aspect of the present disclosure, a dish washing machine includes a cabinet configured to form an exterior, a washing tub provided in the cabinet to wash dishes, and a jet nozzle configured to jet washing water to the washing tub, wherein the jet nozzle includes a first jet nozzle having a first passage of which a cross sectional area becomes smaller in a flow direction of the washing water, and a second jet nozzle having a second passage in communication with the first passage.

The second jet nozzle may include a stepped portion provided at the second passage so that a cross sectional area thereof located upstream of the second passage is smaller than that located downstream of the first passage.

The second passage may be provided so that a cross sectional area thereof becomes wider in the flow direction of the washing water.

A central line of the first passage and a central line of the second passage may be formed to be the same.

The jet nozzle may include a nozzle inner wall defining the first passage and the second passage and having a plurality of passage inner walls having arc shapes in section vertical to the flow direction of the washing water.

Centers of curvature radii of the plurality of passage inner walls may be spaced apart from each other.

The nozzle inner wall may include a plurality of protrusions which are formed by that the plurality of passage inner walls are in contact with each other and protrude toward centers of the first passage and the second passage.

The plurality of protrusions may be arranged along the nozzle inner wall to be spaced apart from each other in a circumferential direction.

The jet nozzle may further include a concave portion formed at an end of the jet nozzle, through which the washing water is jetted, to be more concave than the adjacent jet nozzle, and a washing water jet port provided at the concave portion to jet the washing water.

The dish washing machine may further include a nozzle inner wall defining the first passage and the second passage, and a nozzle tip formed to cover at least part of the nozzle inner wall and formed of a metallic material.

The nozzle tip may be formed by an insert injection molding process when the jet nozzle is manufactured.

The dish washing machine may further include a fixed nozzle assembly provided at one side of the washing tub to feed the washing water to the jet nozzle, and the jet nozzle may be removably coupled to the fixed nozzle assembly.

The jet nozzle may include a thread portion formed to be coupled to the fixed nozzle assembly, and the fixed nozzle assembly may include a thread groove portion formed to correspond to the thread portion.

The thread portion and the thread groove portion may be formed to have the same length.

The jet nozzle may include a sub-jet hole provided to pass through the jet nozzle, such that an outer side of the jet nozzle is in communication with one of the first passage and the second passage, and an opening/closing member provided to be moved between an opening position opening the sub-jet hole and a closing position closing the sub-jet hole.

The dish washing machine may further include a basket provided in the washing tub to receive the dishes, and a vane movably provided to change a direction of the washing water jetted from the jet nozzle to the basket, and the opening/closing member may be pressed by the vane and moved from the closing position to the opening position when the vane is moved toward the jet nozzle.

The dish washing machine may further include a basket provided in the washing tub to receive the dishes, a vane movably provided to change a direction of the washing water jetted from the jet nozzle to the basket, and a sub-vane provided to be rotated between a standby position disposed at an end of the jet nozzle to be spaced apart from the flow direction of the washing water and a reflecting position disposed in the flow direction of the washing water to reflect a direction of the washing water, and the sub-vane may be pressed by the vane and rotated from the standby position to the reflecting position when the vane is moved toward the jet nozzle.

In accordance with yet still another aspect of the present disclosure, a dish washing machine includes a cabinet configured to form an exterior, a washing tub provided in the cabinet to wash dishes, and a jet nozzle having a passage formed therein to jet washing water to the washing tub, wherein the jet nozzle includes a first nozzle inner wall formed to have a gradient toward a center of the passage in a flow direction of the washing water and defining a first passage, and a second nozzle inner wall defining a second passage in communication with the first passage and formed to have a gradient along the flow direction of the washing water in a direction to become more distant from the center of the passage.

The first nozzle inner wall and the second nozzle inner wall may be connected so as to have a step.

The first passage may be formed so that a cross sectional area thereof becomes smaller in the flow direction of the washing water, and the second passage may be formed so that a cross sectional area thereof becomes larger in the flow direction of the washing water.

The dish washing machine may further include a fixed nozzle assembly provided at one side of the washing tub to feed the washing water to the jet nozzle, and the jet nozzle may be removably coupled to the fixed nozzle assembly.

The jet nozzle may include a thread portion formed to be coupled to the fixed nozzle assembly, and the fixed nozzle assembly may include a thread groove portion formed to correspond to the thread portion.

In accordance with yet still another aspect of the present disclosure, a method of manufacturing a jet nozzle provided to jet washing water into a washing tub of a dish washing machine includes preparing a first core and a second core which have cavities having shapes corresponding to the jet nozzle and a jet passage through which the washing water flows, and are disposed to be opposed to each other, and in which a portion corresponding to the jet passage of the first core and a portion corresponding to the jet passage of the second core have different diameters from each other, and pouring a molding material into the cavities and forming the jet nozzle.

A parting surface formed at a portion in which the first core and the second core are coupled may be formed at the jet passage.

The first core and the second core may be formed to have a gradient, such that a cross sectional area of the jet passage becomes smaller in a direction facing the parting surface.

The jet nozzle may further include a nozzle inner wall defining the jet passage, and a nozzle tip formed of a metallic material to cover at least part of the nozzle inner wall may be insert-injection-molded.

In accordance with yet still another aspect of the present disclosure, a dish washing machine includes a cabinet configured to form an exterior, a washing tub provided in the cabinet to wash dishes, and a jet nozzle having a jet passage formed therein to jet washing water to the washing tub, wherein the jet nozzle includes a sub-jet hole provided to pass through the jet nozzle, such that an outer side of the jet nozzle is in communication with the jet passage, and an opening/closing member provided to be moved between an opening position opening the sub-jet hole and a closing position closing the sub-jet hole.

The dish washing machine may further include a basket provided in the washing tub to receive the dishes, and a vane movably provided to change a direction of the washing water jetted from the jet nozzle to the basket, and the opening/closing member may be pressed by the vane and moved from the closing position to the opening position when the vane is moved toward the jet nozzle.

In accordance with yet still another aspect of the present disclosure, a dish washing machine includes a cabinet configured to form an exterior, a washing tub provided in the cabinet to wash dishes, a basket provided in the washing tub to receive the dishes, a jet nozzle defining a jet passage to jet washing water to the washing tub, a vane movably provided to change a direction of the washing water jetted from the jet nozzle to the basket, and a sub-vane provided to be rotated between a standby position disposed at an end of the jet nozzle to be spaced apart from a flow direction of the washing water and a reflecting position disposed in the flow direction of the washing water to reflect the direction of the washing water, wherein the sub-vane is pressed by the vane and rotated from the standby position to the reflecting position when the vane is moved toward the jet nozzle.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 4 is a view illustrating a state in which a fixed nozzle assembly of the dish washing machine of FIG. 1 is disassembled;

FIG. 5 is a cross-sectional view illustrating the fixed nozzle assembly of the dish washing machine of FIG. 1;

DETAILED DESCRIPTION

Figure 1:
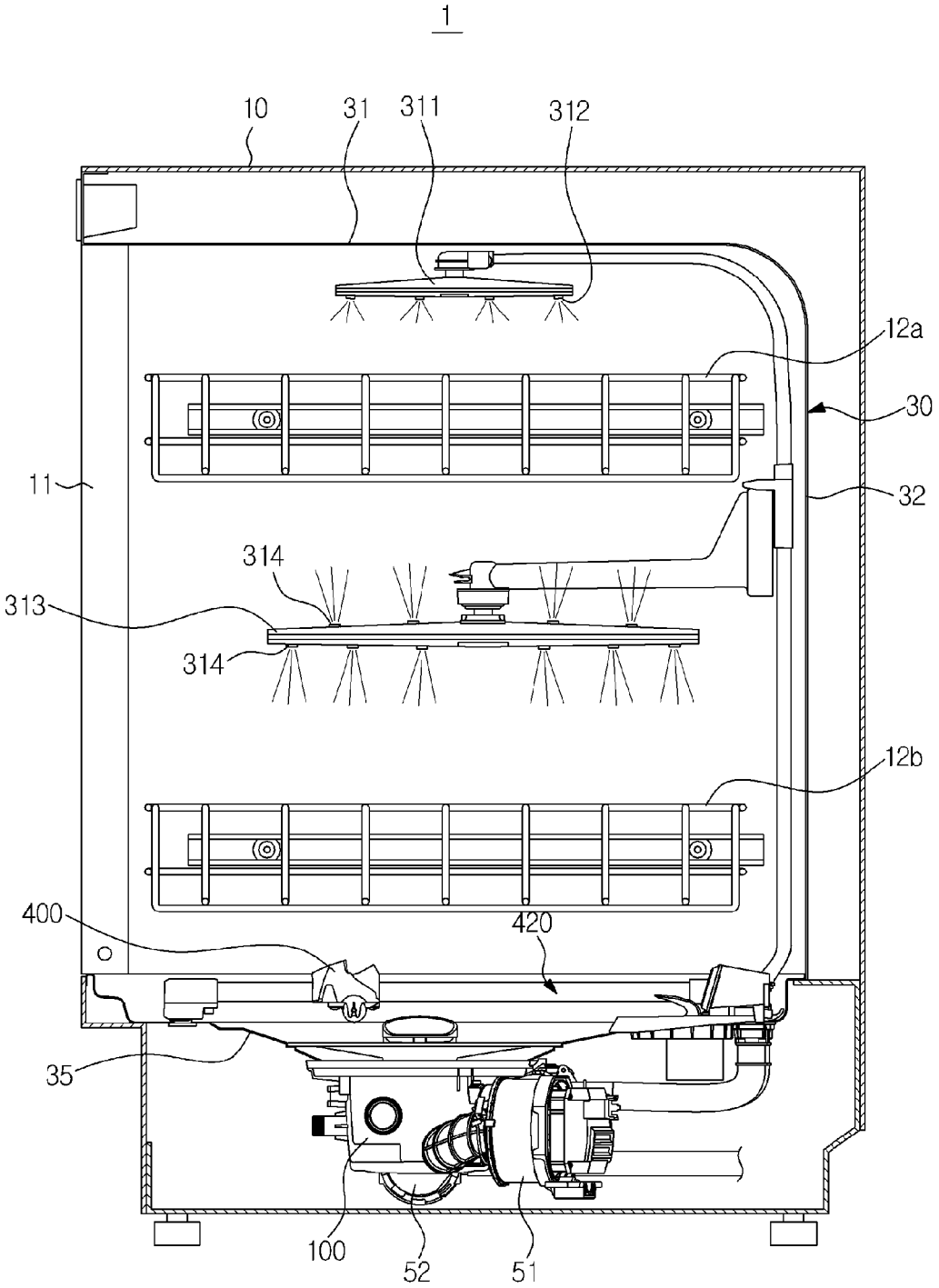
FIG. 1 is a schematic cross-sectional view of a dish washing machine in accordance with one embodiment of the present disclosure.

Reference will now be made in detail to the embodiments, examples of which are illustrated in the accompanying drawings, wherein like reference numerals refer to the like elements throughout. The embodiments are described below to explain the present disclosure by referring to the figures.

Figure 2:
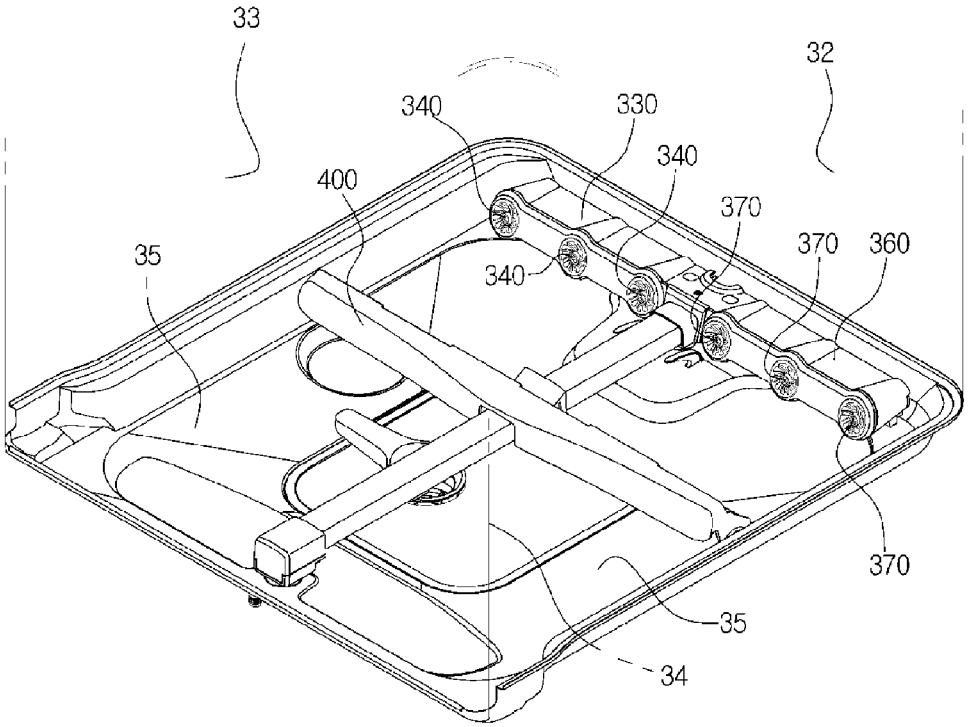
FIG. 2 is a view illustrating a lower portion of the dish washing machine of FIG. 1.

FIG. 1 is a schematic cross-sectional view of a dish washing machine in accordance with one embodiment of the present disclosure, and FIG. 2 is a view illustrating a lower portion of the dish washing machine of FIG. 1.

An entire structure of a dish washing machine in accordance with one embodiment of the present disclosure will be schematically described with reference to FIGS. 1 and 2.

A dish washing machine 1 includes a main body 10 configured to form an exterior, a washing tub 30 provided in the main body 10, baskets 12*a* and 12*b* provided in the washing tub 30 to receive dishes, jet nozzles 311, 313 and 320 configured to jet washing water, a sump 100 configured to store the washing water, a circulation pump 51 configured to pump and supply the washing water of the sump 100 to the jet nozzles 311, 313 and 320, a drainage pump 52 configured to discharge the washing water of the sump 100 to an outside together with slops, a vane 400 moving in the washing tub 30 to reflect the washing water to the dishes, and a driving device 420 configured to drive the vane 400.

The washing tub 30 may have an approximately box shape of which a front portion is opened to put the dishes therein or take out the dishes therefrom. The front opening of the washing tub 30 may be opened and closed by a door 11. The washing tub 30 may have an upper wall 31, a rear wall 32, a left wall 33, a right wall 34 and a bottom plate 35.

The baskets 12*a* and 12*b* may be wire racks formed of wires so that the washing water does not stagnate therein but passes therethrough. The baskets 12*a* and 12*b* may be removably provided in the washing tub 30. The baskets 12*a* and 12*b* may include an upper basket 12*a* disposed at an upper portion of the washing tub 30 and a lower basket 12*b* disposed at a lower portion of the washing tub 30.

The jet nozzles 311, 313 and 320 may jet the washing water at a high pressure and wash the dishes. The jet nozzles 311, 313 and 320 may include an upper rotary nozzle 311 disposed at the upper portion of the washing tub 30, a middle rotary nozzle 313 disposed at a middle portion of the washing tub 30, and a fixed nozzle assembly 320 disposed at the lower portion of the washing tub 30.

The upper rotary nozzle 311 is disposed above the upper basket 12*a* to jet the washing water downward while being rotated by water pressure. To this end, jet holes 312 may be provided at a lower end of the upper rotary nozzle 311. The upper rotary nozzle 311 may directly jet the washing water toward the dishes received in the upper basket 12*a*.

The middle rotary nozzle 313 is disposed between the upper basket 12*a* and the lower basket 12*b* to jet the washing water upward and downward while being rotated by the water pressure. To this end, jet holes 314 may be provided at upper and lower ends of the middle rotary nozzle 313. The middle rotary nozzle 313 may directly jet the washing water toward the dishes received in the upper and lower baskets 12*a* and 12*b*.

Unlike the rotary nozzles 311 and 313, the fixed nozzle assembly 320 is disposed so as not to be moved, and fixed to one side of the washing tub 30. The fixed nozzle assembly 320 may be approximately disposed to be adjacent to the rear wall 32 of the washing tub 30 to jet the washing water toward a front side of the washing tub 30. Therefore, the washing water jetted from the fixed nozzle assembly 320 may not be directly directed to the dishes.

The washing water jetted from the fixed nozzle assembly 320 may be reflected to the dishes by the vane 400. The fixed nozzle assembly 320 may be disposed under the lower basket 12*b*, and the vane 400 may reflect upward the washing water jetted from the fixed nozzle assembly 320. That is, the washing water jetted from the fixed nozzle assembly 320 may be reflected to the dishes received in the lower basket 12*b* by the vane 400.

The fixed nozzle assembly 320 may have a plurality of jet nozzles 340 and 370 arranged in left and right directions of the washing tub 30. The plurality of jet nozzles 340 and 370 may jet the washing water toward front sides thereof.

The vane 400 may extend long in the left and right directions of the washing tub 30 to reflect all of the washing water jetted from the plurality of jet nozzles 340 and 370 of the fixed nozzle assembly 320. That is, one longitudinal end of the vane 400 may be disposed to be adjacent to the left wall 33 of the washing tub 30, and the other longitudinal end thereof may be disposed to be adjacent to the right wall 34 of the washing tub 30.

The vane 400 may be linearly reciprocated along a jet direction of the washing water jetted from the fixed nozzle assembly 320. That is, the vane 400 may be linearly reciprocated in front and rear directions of the washing tub 30.

Therefore, the linear type jet structure including the fixed nozzle assembly 320 and the vane 400 may wash an entire area of the washing tub 30 without any place which is not washed. This is different from the rotary nozzles in which the washing water can be jetted within only ranges of rotational radii thereof.

The fixed nozzle assembly 320 may include a left fixed nozzle assembly 330 disposed at a left side if the washing tub 30, and a right fixed nozzle 360 disposed at a right side if the washing tub 30.

As described later, the rotary nozzles 311 and 313 and the fixed nozzle assembly 320 may independently jet the washing water. Furthermore, the left fixed nozzle assembly 330 and the right fixed nozzle 360 may also independently jet the washing water.

The washing water jetted from the left fixed nozzle assembly 330 may be reflected to only a left area of the washing tub 30 by the vane 400, and the washing water jetted from the right fixed nozzle 360 may be reflected to only a right area of the washing tub 30 by the vane 400.

Therefore, in the dish washing machine, the left and right sides of the washing tub 30 may be independently and dividedly washed. Of course, unlike the embodiment, the washing tub 30 is not needed to be divided into only the left and right sides, and if necessary, the washing tub 30 may be further subdivided and washed.

Hereinafter, main elements of the dish washing machine according to one embodiment of the present disclosure will be described in turn.

Figure 3:
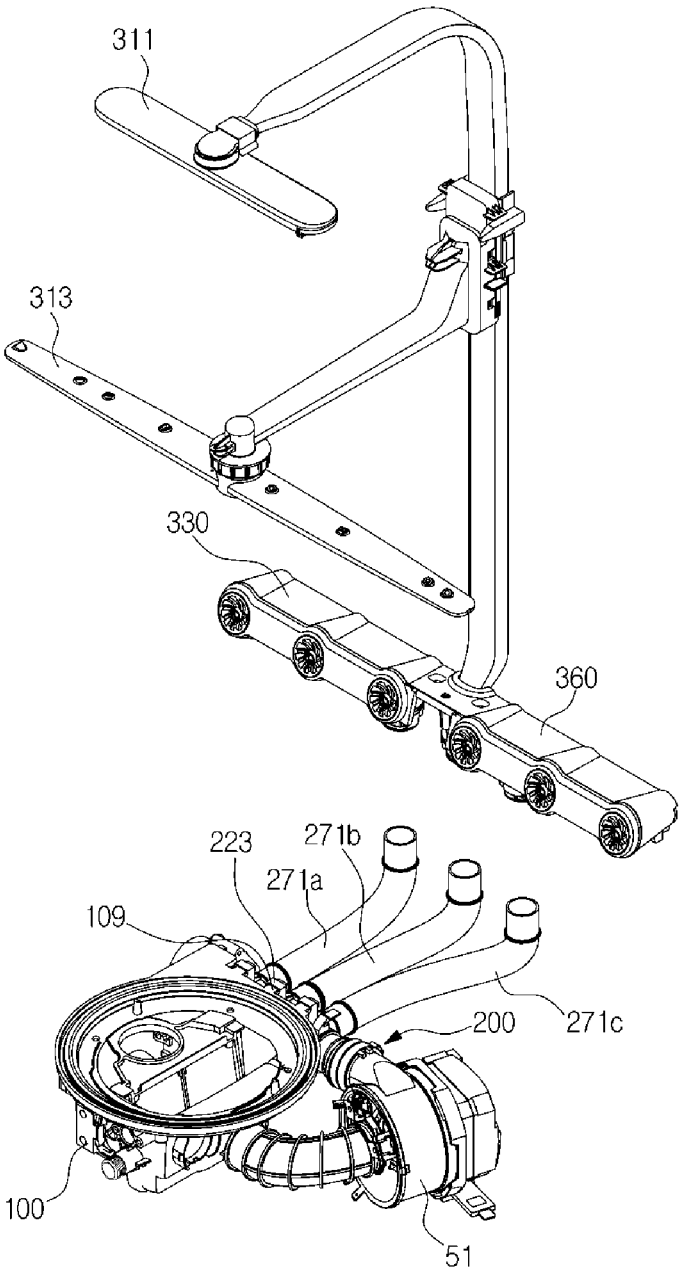
FIG. 3 is a view illustrating a passage structure of the dish washing machine of FIG. 1.

FIG. 3 is a view illustrating a passage structure of the dish washing machine of FIG. 1, FIG. 4 is a view illustrating a state in which the fixed nozzle assembly of the dish washing machine of FIG. 1 is disassembled, and FIG. 5 is a cross-sectional view illustrating the fixed nozzle assembly of the dish washing machine of FIG. 1.

With reference to FIGS. 3 to 5, a stroke, a passage structure, a structure of the fixed nozzle assembly, and a distribution structure of the washing water in the dish washing machine according to one embodiment of the present disclosure will be described.

The dish washing machine may have a water feeding stroke, a washing stroke, a drainage stroke, and a drying stroke.

In the water feeding stroke, the washing water may be fed into the washing tub 30 through a water feed pipe (not shown). The washing water fed into the washing tub 30 may flow to the sump 100 provided under the washing tub 30 due to a gradient of the bottom plate 35 of the washing tub 30, and may be stored in the sump 100.

In the washing stroke, the circulation pump 51 may be operated to pump the washing water in the sump 100. The washing water pumped by the circulation pump 51 may be distributed to the rotary nozzles 311 and 313, the left fixed nozzle assembly 330 and the right fixed nozzle 360 through a distribution device 200. By a pumping force of the circulation pump 51, the washing water may be jetted at the high pressure from the jet nozzles 311, 313 and 320 and may wash the dishes.

Here, the upper rotary nozzle 311 and the middle rotary nozzle 313 may receive the washing water from the distribution device 200 through a second hose 271*b*. The left fixed nozzle assembly 330 may receive the washing water from the distribution device 200 through a first hose 271*a*. The right fixed nozzle 360 may receive the washing water from the distribution device 200 through a third hose 271*c*.

In the embodiment, the distribution device 200 is provided to have four distribution modes in total.

In a first mode, the distribution device 200 feeds the washing water into only the rotary nozzles 311 and 313 through the second hose 271*b*.

In a second mode, the distribution device 200 feeds the washing water into only the right fixed nozzle 360 through the third hose 271*c*.

In a third mode, the distribution device 200 feeds the washing water into only the left and right fixed nozzles assembly 330 and 360 through the first and third hoses 271*a* and 271*c*.

In a fourth mode, the distribution device 200 feeds the washing water into only the left fixed nozzle assembly 330 through the first hose 271*a*.

However, unlike the embodiment, the distribution device 200 may be provided to have more distribution modes with a variety of hose configurations including more or less hoses.

The washing water jetted from the jet nozzles 311, 313 and 320 may strike the dishes, remove the slops remaining on the dishes, fall down together with the slops, and then may be stored again in the sump 100. The circulation pump 51 serves to pump and circulate again the washing water stored in the sump 100. During the washing stroke, the circulation pump 51 may be repeatedly operated and stopped a few times. In this process, the slops fallen down together with the washing water into the sump 100 is filtered by a filter installed at the sump 100 so as not to be circulated to the jet nozzles 311, 313 and 320 but to be remained in the sump 100.

In the drainage stroke, the drainage pump 52 may be operated so that the slops and the washing water are discharged to an outside of the main body 10.

In the drying stroke, a heater (not shown) installed at the washing tub 30 may be operated to dry the dishes.

Figure 4A:
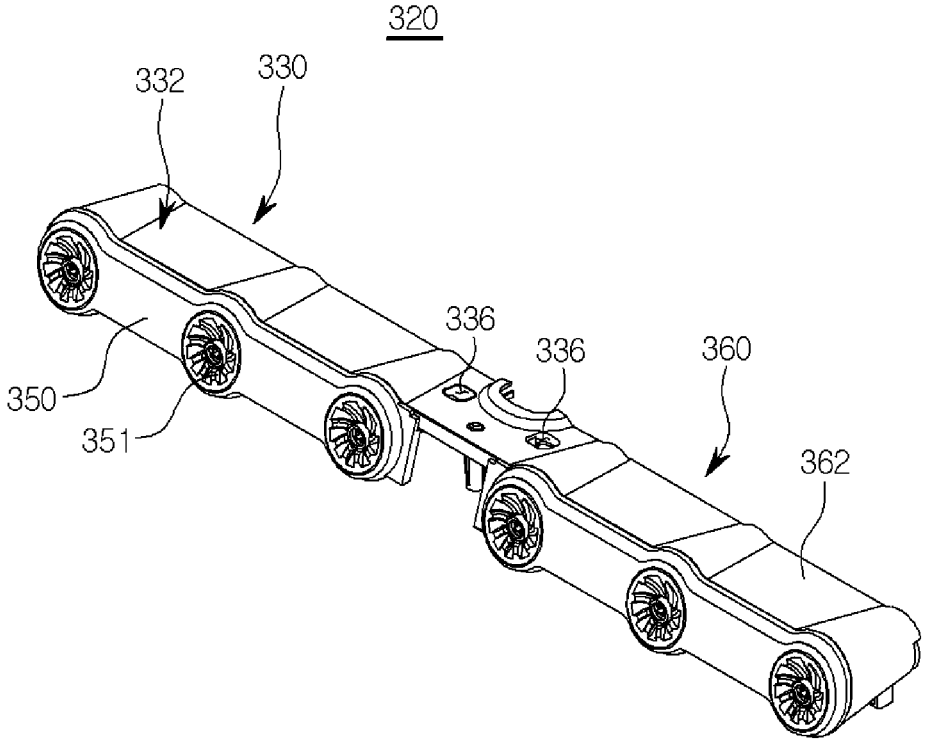
FIG. 4A is a perspective view of the fixed nozzle assembly of the dish washing machine of FIG. 1.
Figure 4B:
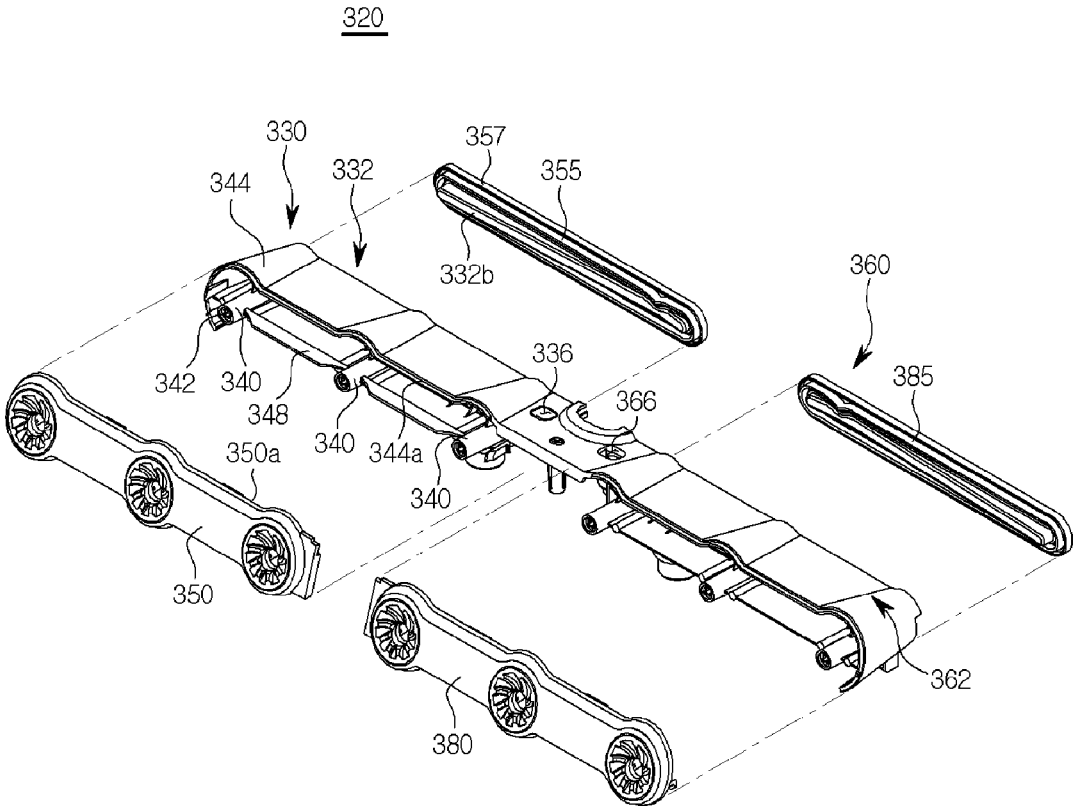
FIGS. 4B and 4C are views illustrating the state in which the fixed nozzle assembly of the dish washing machine of FIG. 1 is disassembled.
Figure 4C:
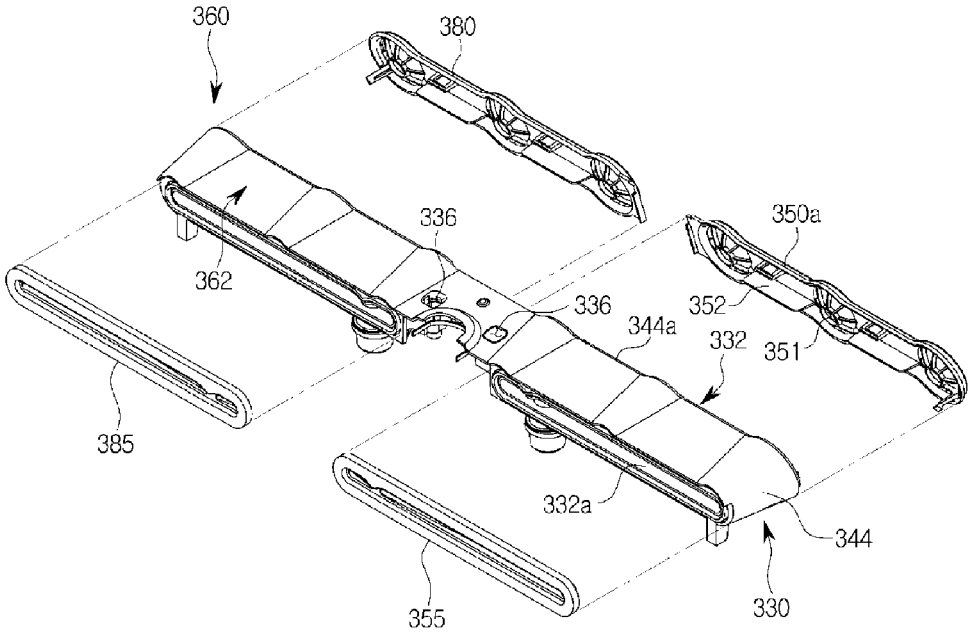

FIG. 4A is a perspective view of the fixed nozzle assembly of the dish washing machine of FIG. 1, and FIGS. 4B and 4C are views illustrating the state in which the fixed nozzle assembly of the dish washing machine of FIG. 1 is disassembled.

The fixed nozzle assembly 320 will be described.

The fixed nozzle assembly 320 may be disposed on the bottom plate 35 of the washing tub 30. Specifically, the fixed nozzle assembly 320 may be provided to be fixed to a bottom plate cover 600 (see FIG. 18A).

Since the left fixed nozzle assembly 330 and the right fixed nozzle assembly 360 may be provided to be symmetrical with respect to a center thereof, the left fixed nozzle assembly 330 will be mainly described.

The left fixed nozzle assembly 330 may include a nozzle body 332, a nozzle front cover 350, and a nozzle rear cover 355.

The nozzle body 332 is provided to form an exterior, and has the jet nozzle 340, and is also provided to have a nozzle passage 333 (see FIG. 5A) through which the washing water flows. Specifically, the nozzle passage 333 may be defined by that the nozzle body 332 is coupled with the nozzle rear cover 355 to be described later.

The jet nozzle 340 has a jet passage 342 through which the washing water flows, so that the washing water is jetted into the washing tub 30 through the jet passage 342. A plurality of jet nozzles 340 may be provided to be spaced apart from each other at regular intervals.

The fixed nozzle assembly 320 may include ribs 348 and 352 provided to prevent foreign substances from being introduced into an internal space from an outside thereof. The ribs 348 and 352 may include a nozzle supporting rib 348 and a guide rib 352 which are described later.

The nozzle supporting rib 348 may be disposed among the plurality of jet nozzles 340 to support the jet nozzles 340. The nozzle supporting rib 348 is provided to support an outer circumferential surface of the jet nozzle 340 so that the jet nozzle 340 is prevented from being deformed by a pressure of the washing water jetted through the jet nozzle 340.

The nozzle body 332 may include a nozzle side cover 344.

The nozzle side cover 344 is formed to cover at least part of the jet nozzles 340 and provided to be coupled with the nozzle front cover 350 to be described later. The nozzle side cover 344 may be injection-molded together with the nozzle body 332, or may be integrally formed with the nozzle body 332. The nozzle side cover 344 may be provided to cover upper and side portions of the jet nozzle 340.

At least one spacing rib 345 may be provided between the nozzle side cover 344 and the jet nozzle 340, and the spacing rib 345 is provided so that the jet nozzle 340 and the nozzle side cover 344 may be spaced apart from each other and also firmly supported by each other.

The nozzle front cover 350 may be coupled to a front surface of the nozzle body 332. The nozzle front cover 350 may have a discharge hole 351 in communication with the jet passage 342 of the jet nozzle 340, and may be provided at the front surface of the nozzle body 332 to cover an inner side of the nozzle body 332.

The nozzle front cover 350 is coupled to the nozzle side cover 344, and a coupling method and configuration thereof will be described later in detail.

The guide rib 352 may be provided at a rear surface of the nozzle front cover 350. The guide rib 352 may be provided so that the foreign substances are prevented from being introduced into the nozzle body 332 and also the foreign substances introduced into the nozzle body 332 are guided and discharged to the outside together with the washing water.

The nozzle rear cover 355 is provided to be coupled to a rear side of the nozzle body 332. The nozzle rear cover 355 may be provided to be coupled with the nozzle body 332 and thus to form the nozzle passage 333.

Figure 5A:
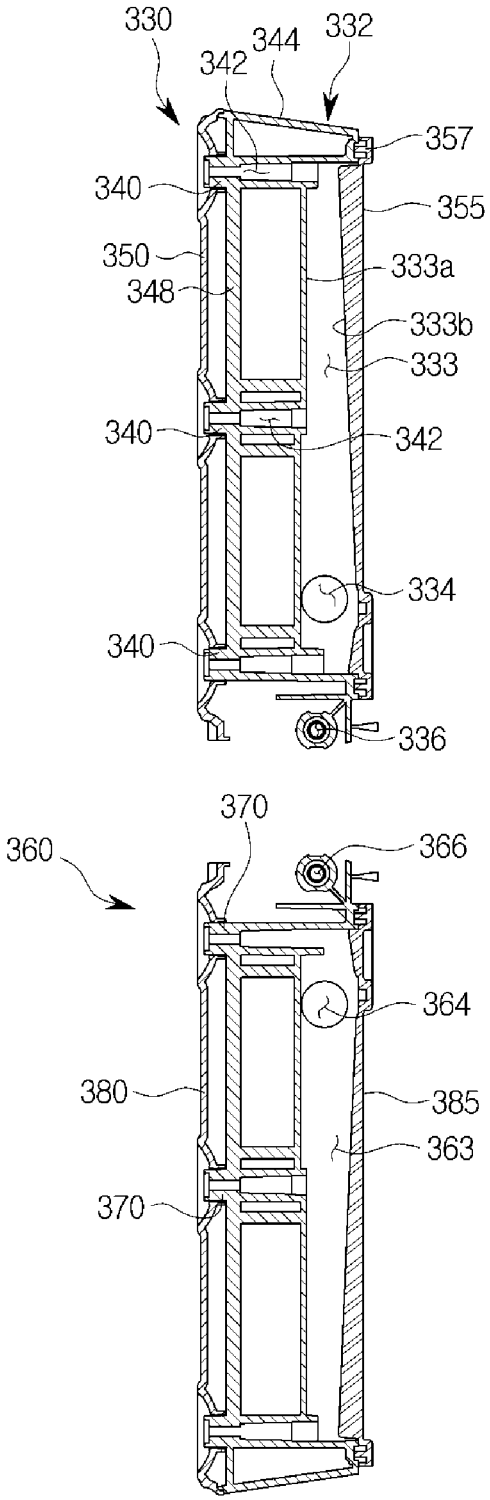
FIGS. 5A and 5B are cross-sectional views illustrating the fixed nozzle assembly of the dish washing machine of FIG. 1.

FIG. 5A is a cross-sectional view illustrating the fixed nozzle assembly of the dish washing machine of FIG. 1.

The nozzle body 332 may include the nozzle passage 333 in communication with the jet passage 342 of the jet nozzle 340 to feed the washing water to the jet nozzle 340, a nozzle inlet port 334 through which the washing water is introduced into the nozzle passage 333, and a coupling hole 336 formed at the nozzle body 332 so that the fixed nozzle assembly 320 is coupled to the bottom plate cover 600 to be described later.

The nozzle rear cover 355 may be provided to be coupled with the nozzle body 332 and thus form the nozzle passage 333.

A nozzle body passage surface 333*a* and a rear passage surface 333*b* provided at one side surface of the nozzle rear cover 355 are provided in the nozzle body 332. The nozzle body passage surface 333*a* and the rear passage surface 333*b* are coupled to each other by coupling the nozzle body 332 and the nozzle rear cover 355, thereby defining the nozzle passage 333.

That is, one side of the nozzle passage 333 is defined by the nozzle body 332, and the other side thereof is defined by the nozzle rear cover 355.

The rear passage surface 333*b* may be formed to have a gradient toward an inner side of the nozzle passage 333, as the rear passage surface 333*b* becomes more distant from the nozzle inlet port 334. That is, the rear passage surface 333*b* has a gradient so that the nozzle passage 333 becomes narrow in a direction that becomes more distant from the nozzle inlet port 334. Due to this configuration, in a process in which the washing water introduced from the nozzle inlet port 334 is fed to the plurality of jet nozzles 340 through the nozzle passage 333, the pressure of the washing water fed to the jet nozzle 340 disposed to be far away from the nozzle inlet port 334, which is smaller than that of the washing water fed to the jet nozzle 340 disposed to be close to the nozzle inlet port 334, may be compensated.

The rear passage surface 333*b* may be provided to be more convex than the adjacent nozzle rear cover 355, and the other surface thereof may be formed to be concave. That is, a portion in which the rear passage surface 333*b* is formed may be formed at the nozzle rear cover 355 in an intaglio manner to be convex.

Specifically, the nozzle rear cover 355 is coupled to the nozzle side cover 344. The coupling between the nozzle rear cover 355 and the nozzle side cover 344 may be achieved in various ways. However, in the embodiment of the present disclosure, the nozzle rear cover 355 and the nozzle side cover 344 are coupled by a thermal bonding method.

The nozzle rear cover 355 may include a rear cover coupling portion 357 through which the nozzle rear cover 355 is coupled to the nozzle side cover 344. The rear cover coupling portion 357 may be provided to be in contact with an end of the nozzle body 332, such that the nozzle rear cover 355 is coupled to the nozzle body 332.

The rear passage surface 333*b* is inserted into the nozzle body 332 and disposed at a more inner side of the nozzle body 332 than the rear cover coupling portion 357. That is, since the rear passage surface 333*b* defining the nozzle passage 333 is provided at the more inner side of the nozzle body 332 than the rear cover coupling portion 357, the nozzle passage 333 may be less affected from the outside. Further, since the rear passage surface 333*b* is formed at the more inner side of the nozzle body 332 than the rear cover coupling portion 357, a design of the nozzle passage 333 may be easily changed according to an applied washing water feed amount, and thus it is possible to provide convenience in working.

Figure 5B:
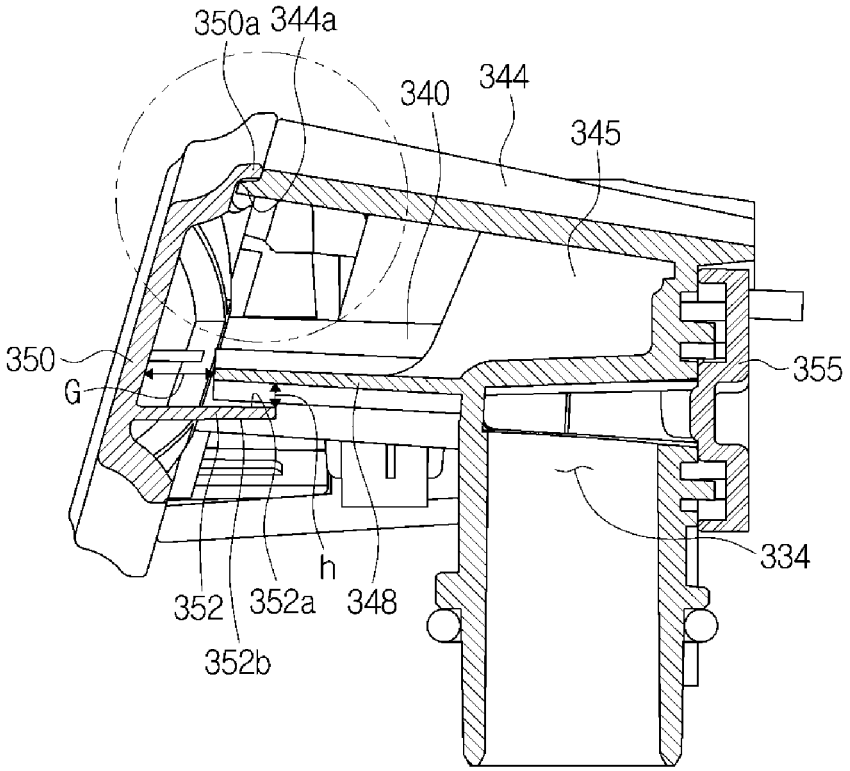

FIG. 5B is a cross-sectional view illustrating the fixed nozzle assembly of the dish washing machine of FIG. 1.

The guide rib 352 may be provided at a rear surface of the nozzle front cover 350. The guide rib 352 is provided so that the foreign substances are prevented from being introduced into the nozzle body 332 and also the foreign substances introduced into the nozzle body 332 are guided and discharged to the outside together with the washing water.

The guide rib 352 is provided to extend rearward from the rear surface of the nozzle front cover 350, and also provided to be spaced apart from the nozzle body 332 in a predetermined distance and thus to cover at least part of one side surface of the nozzle body 332.

The guide rib 352 may be disposed to be overlapped upward and downward with at least part of the nozzle supporting rib 348. That is, the guide rib 352 may be disposed under the nozzle supporting rib 348 to be overlapped up and down with the nozzle supporting rib 348.

The nozzle supporting rib 348 may be provided at the nozzle body 332 to connect between the plurality of jet nozzles 340, such that a front end thereof may be spaced apart from the nozzle front cover 350 in a predetermined gap G. Ideally, the nozzle front cover 350 and the nozzle supporting rib 348 may be completely coupled so that the foreign substances are not introduced into the nozzle body 332. However, by providing the predetermined gap G between the nozzle front cover 350 and the nozzle supporting rib 348, the foreign substances may be discharged to the outside of the nozzle body 332 through introduction of the washing water, even though the foreign substances are introduced into the nozzle body 332.

For this reason, the predetermined gap G is provided between the nozzle front cover 350 and the nozzle supporting rib 348. The guide rib 352 is provided to cover the predetermined gap G between the nozzle front cover 350 and the nozzle supporting rib 348, while being spaced apart therefrom for a distance, and also to prevent the water from being introduced from a lower side of the nozzle body 332 through the gap G. To this end, the guide rib 352 and the nozzle supporting rib 348 are disposed to be overlapped up and down with each other. That is, the guide rib 352 and the nozzle supporting rib 348 may be respectively formed to alternately extend from the nozzle front cover 350 and the nozzle body 332 in opposite directions to each other.

The guide rib 352 and the nozzle supporting rib 348 may be spaced apart from each other in a predetermined distance h so that the washing water introduced into the nozzle front cover 350 and the nozzle body 332 may be discharged. The distance h between the guide rib 352 and the nozzle supporting rib 348 may be 3 mm or more. However, the distance h is not limited thereto, and it is sufficient as long as the washing water introduced into the fixed nozzle assembly 320 may be smoothly discharged.

The guide rib 352 may include a rib upper surface 352*a* and a rib lower surface 352*b* provided downward at an opposite side to the rib upper surface 352*a*.

The rib upper surface 352*a* may be formed to be inclined downward along a direction that the guide rib 352 extends. That is, the rib upper surface 352*a* may be formed to be inclined downward along a direction that becomes more distant from the nozzle front cover 350. By such a configuration, the washing water or the foreign substances introduced into the nozzle body 332 may flow along the rib upper surface 352*a* and then may be discharged to an outside of the fixed nozzle assembly 320.

The rib lower surface 352*b* may be formed to be inclined upward along the direction that the guide rib 352 extends. That is, the rib lower surface 352*b* may be formed to be inclined upward along a direction that becomes more distant from the nozzle front cover 350. By such a configuration, the washing water or the foreign substances introduced from the lower portion of the washing tub 30 may flow along the rib lower surface 352*b* and also may not be introduced into the fixed nozzle assembly 320.

Figure 5C:
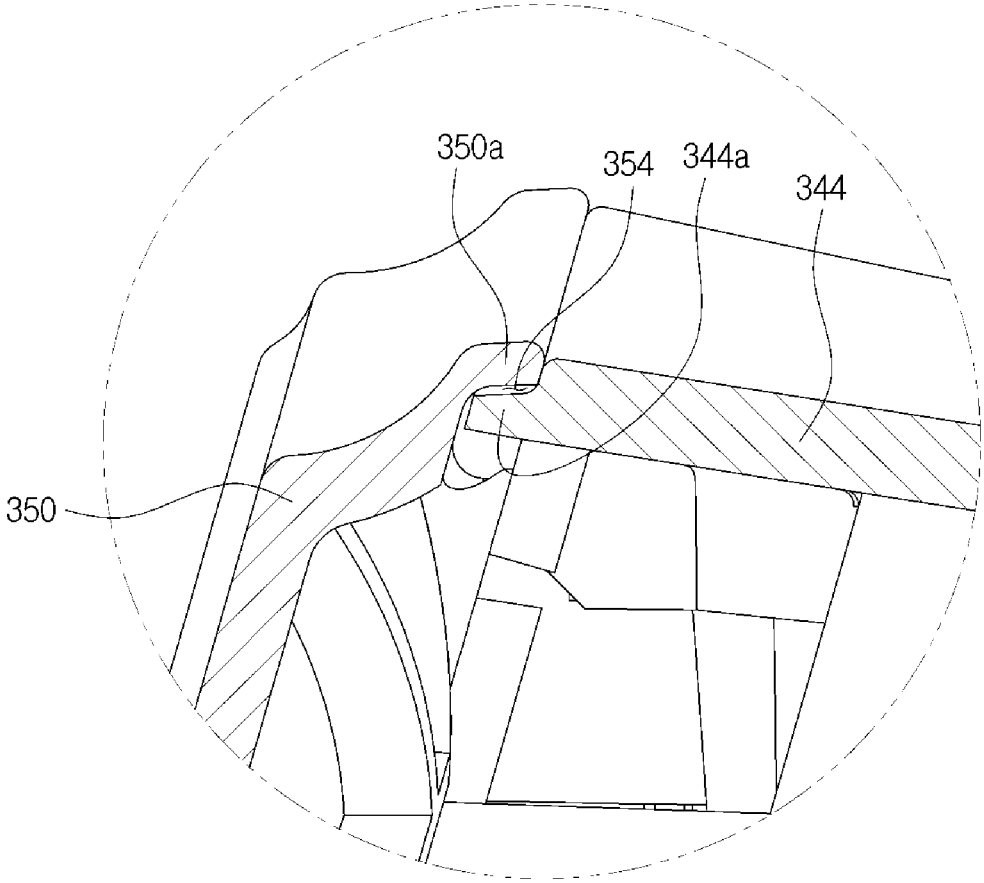
FIG. 5C is an enlarged view of a portion of FIG. 5B.

FIG. 5C is an enlarged view of a portion of FIG. 5B. The nozzle front cover 350 may be coupled to the nozzle side cover 344 of the nozzle body 332. Ideally, the nozzle front cover 350 and the nozzle side cover 344 may be coupled so that an inner side of the nozzle body 332 is sealed, or so that the washing water may be introduced therethrough and then discharged together with the foreign substances to the outside of the nozzle body 332.

The nozzle side cover 344 may include a concave coupling portion 344*a*.

The concave coupling portion 344*a* is at least partly formed along an end of the nozzle side cover 344 and also formed to have a step and thus to be bent inward from an outer circumferential surface of the adjacent nozzle side cover 344.

The nozzle front cover 350 may include a convex coupling portion 350*a*.

The convex coupling portion 350*a* corresponds to the concave coupling portion 344*a* so that the nozzle front cover 350 is coupled to the nozzle side cover 344, and is formed to be bent outward from an inner circumferential surface of the nozzle side cover 344 and also to have a step.

The concave coupling portion 344*a* and the convex coupling portion 350*a* define an introduction passage 354 through which a small amount of the washing water may pass.

The washing water introduced through the introduction passage 354 is just the small amount, and thus the small amount of the washing water flows along an inner side surface of the nozzle front cover 350 and the rib upper surface 352*a* of the guide rib 352. The washing water introduced into the nozzle body 332 through the introduction passage 354 by the above-mentioned flow is discharged together with the foreign substances introduced into the nozzle body 332 to the outside of the nozzle body 332.

Until now, it was described about the left fixed nozzle assembly 330, and the right fixed nozzle assembly 360 may have the same configuration.

That is, the right fixed nozzle assembly 360 may include the plurality of jet nozzles 370 configured to jet the washing water, the nozzle passage 363 configured to feed the washing water to the jet nozzles 370, the nozzle inlet port 364 through which the washing water is introduced into the nozzle passage 363, the nozzle body 362 configured to form an exterior and define the nozzle passage 363, the nozzle rear cover 385 coupled to the rear side of the nozzle body 362 to define the nozzle passage 363 with the nozzle body 362, the nozzle front cover 380 coupled to the front side of the nozzle body 362, and the coupling hole 366 formed in the nozzle body 362 to couple the right fixed nozzle assembly 360 to the bottom plate cover 600.

Figure 6:
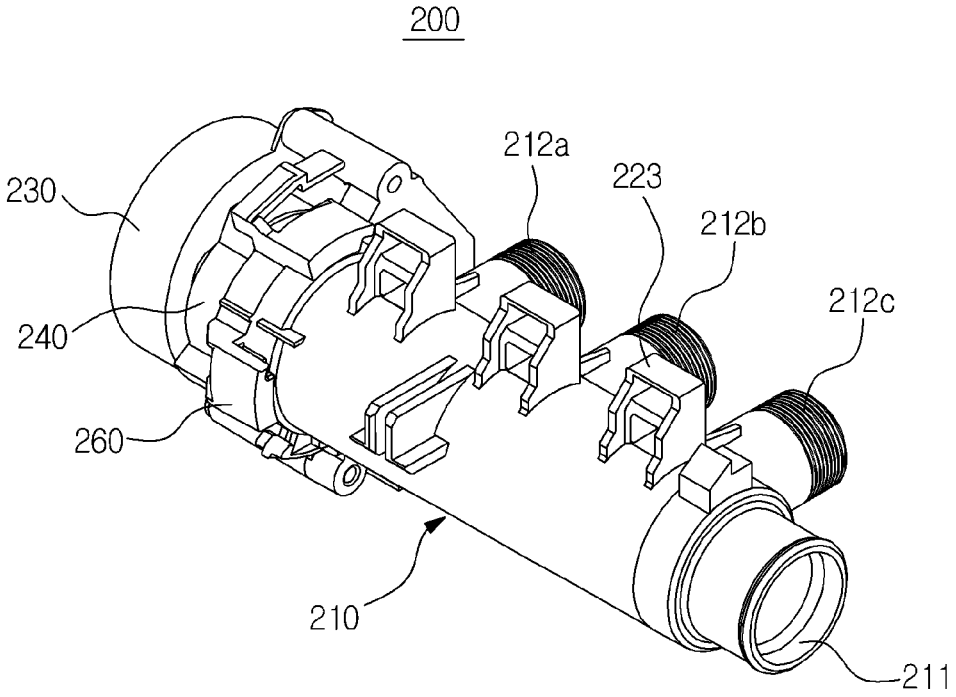
FIG. 6 is a view illustrating a distribution device of the dish washing machine of FIG. 1.

FIG. 6 is a view illustrating a distribution device of the dish washing machine of FIG. 1.

Figure 7:
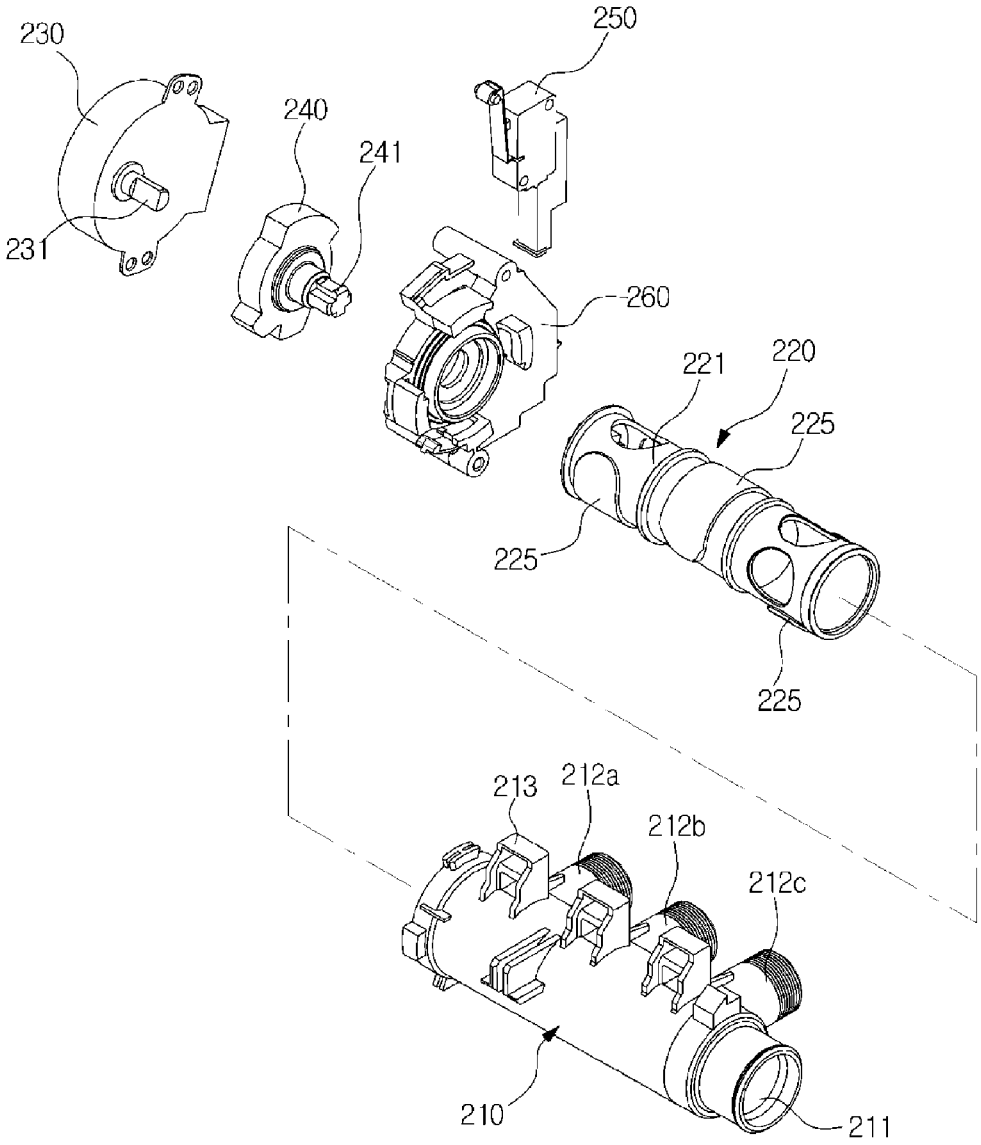
FIG. 7 is a view illustrating a state in which the distribution device of the dish washing machine of FIG. 1 is disassembled.
Figure 8:
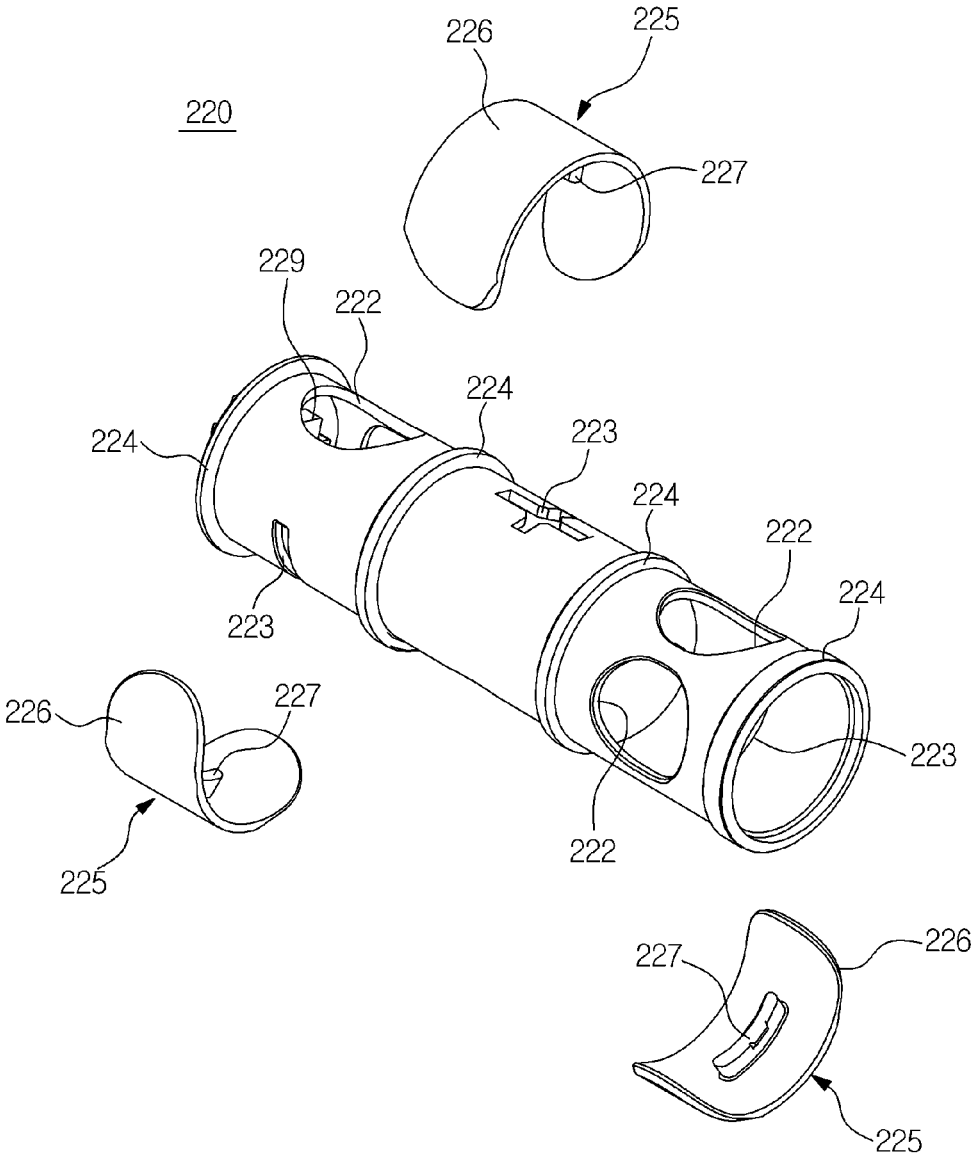
FIG. 8 is a view illustrating a state in which an opening/closing member of the distribution device of the dish washing machine of FIG. 1 is disassembled.
Figure 9:
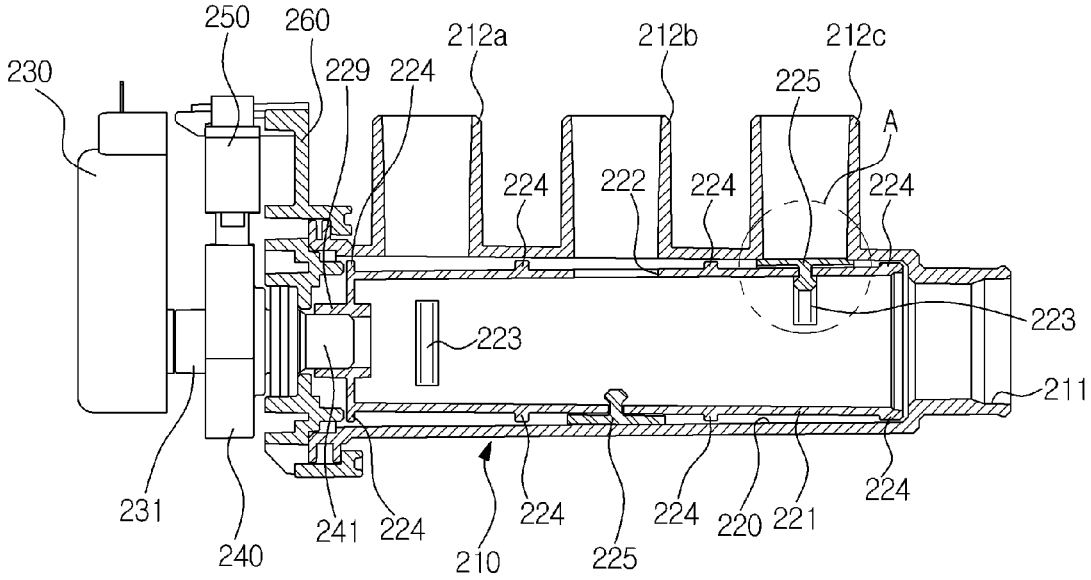
FIG. 9 is a cross-sectional view of the distribution device of the dish washing machine of FIG. 1.
Figure 10:
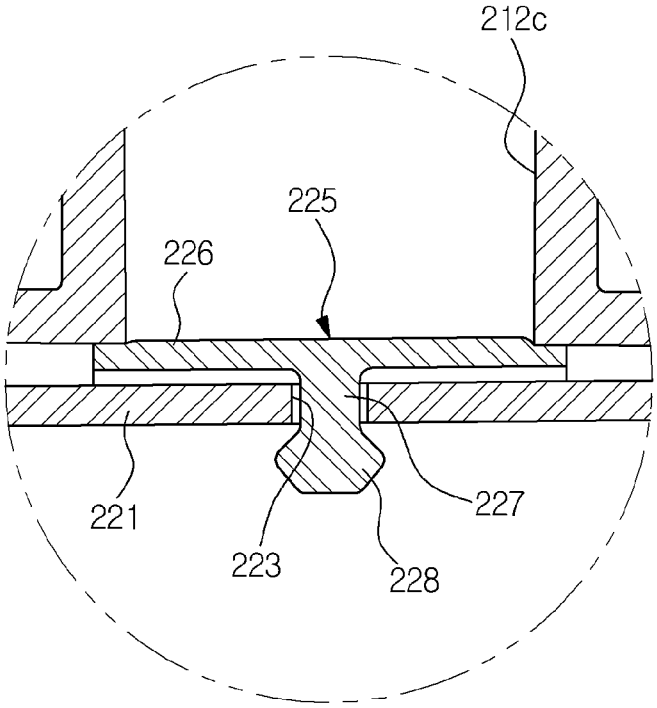
FIG. 10 is an enlarged view of an A portion of FIG. 9.

FIG. 7 is a view illustrating a state in which the distribution device of the dish washing machine of FIG. 1 is disassembled. FIG. 8 is a view illustrating a state in which an opening/closing member of the distribution device of the dish washing machine of FIG. 1 is disassembled. FIG. 9 is a cross-sectional view of the distribution device of the dish washing machine of FIG. 1. FIG. 10 is an enlarged view of an A portion of FIG. 9.

With reference to FIGS. 6 to 10, a distribution device of the dish washing machine according to one embodiment of the present disclosure will be described.

The distribution device 200 is provided to have an approximately cylindrical shape.

The distribution device 200 includes a housing 210 having an approximately hollow cylindrical shape to form an exterior, an opening/closing member 220 rotatably provided in the housing 210, a motor 230 configured to rotate the opening/closing member 220, a supporting member 260 configured to support the motor 230 and the housing 210, a cam member 240 coupled to the motor 230 and the opening/closing member 220 to be rotated together with the opening/closing member 220, and a micro-switch 250 in contact with the cam member 240 to detect a rotational position of the opening/closing member 220.

The housing 210 may be disposed to extend between the side walls 33 and 34 (FIG. 2) of the washing tub 30. Hereinafter, a lengthwise direction of the housing 210 is referred to as an axial direction. An inlet 211 through which the washing water is introduced into the housing 210 is formed at one axial end of the housing 210. The motor 230 is disposed at the other axial end of the housing 210.

Specifically, the inlet 211 may be provided to face the right wall 34 of the washing tub 30. The circulation pump 51 may be connected to the inlet 211 so that the washing water stored in the sump 100 is introduced into the housing 210 through the inlet 211 when the circulation pump 51 is driven.

A plurality of outlets 212*a*, 212*b* and 212*c* are formed at a circumferential surface of the housing 210. The plurality of outlets 212*a*, 212*b* and 212*c* are arranged at regular intervals in the axial direction. The plurality of outlets 212*a*, 212*b* and 212*c* include a first outlet 212*a*, a second outlet 212*b* and a third outlet 212*c*.

Here, the plurality of outlets 212*a*, 212*b* and 212*c* are disposed to face the rear wall 32 (FIG. 2) of the washing tub 30. The reason why the plurality of outlets 212*a*, 212*b* and 212*c* are disposed to face the rear wall 32 of the washing tub 30, as described above, is because of a structure in which the housing 210 of the distribution device 200 according to one embodiment of the present disclosure has the cylindrical shape, the housing 210 is disposed to extend axially between the side walls 33 and 34, and the opening/closing member 220 is rotated around the axial direction of the housing 210 to open and close the outlets 212*a*, 212*b* and 212*c*.

Additionally, since a general distribution device used in a conventional dish washing machine includes a semi-spherical housing, and a flat disk type opening/closing device rotatably disposed at an upper portion of the housing, outlets should be disposed at an upper portion of the distribution device.

As described above, in the distribution device 200 according to one embodiment of the present disclosure, since the outlets 212*a*, 212*b* and 212*c* are provided to face the rear wall 32 of the washing tub 30, there is an advantage in which pressure loss of the washing water fed to the fixed nozzle assembly 320 disposed to be adjacent to the rear wall 32 of the washing tub 30 is reduced.

This is because the passage connecting the outlets 212*a*, 212*b* and 212*c* and the fixed nozzle assembly 320 may be formed gently without a sharply bent portion.

On the contrary, if the conventional distribution device in which the outlets are provided to face an upper side of the distribution device is applied to the fixed nozzle assembly 320 according to one embodiment of the present disclosure, the passage connected to the outlets should be immediately sharply bent rearward, the pressure loss is increased.

The first outlet 212*a*, the second outlet 212*b*, and the third outlet 212*c* are arranged in turn from a left side of the washing tub 30 toward a right side thereof.

That is, the first outlet 212*a* is relatively close to the left fixed nozzle assembly 330, and the third outlet 212*c* is relatively close to the right fixed nozzle 360, and the second outlet 212*b* is disposed at a middle portion.

The first outlet 212*a* may be connected to the left fixed nozzle assembly 330 through the first hose 271*a* (FIG. 3). The second outlet 212*b* may be connected to the rotary nozzles 311 and 313 through the second hose 271*b* (FIG. 3). The third outlet 212*c* may be connected to the right fixed nozzle 360 through the third hose 271*c* (FIG. 3).

Accordingly, since each of the outlets 212*a*, 212*b* and 212*c* is connected to the jet nozzle 311, 313, 320 which is relatively close thereto, a length of each hose 271*a*, 271*b*, 271*c* may be shortened, the hoses may be prevented from being twisted, and the pressure loss may be reduced.

A sump coupling portion 213 coupled to the sump 100 may be provided at the housing 210, and a distribution device coupling portion 109 (FIG. 3) coupled to the sump coupling portion 213 may be provided at the sump 100. In the embodiment, the sump coupling portion 213 is provided in the form of a groove, and the distribution device coupling portion 109 is provided in the form of a protrusion. By coupling the sump coupling portion 213 and the distribution device coupling portion 109, the distribution device 200 and the sump 100 may be positioned.

The opening/closing member 220 is rotated around the axial direction of the housing 210 in the housing 210 to selectively open and close the outlets 212*a*, 212*b* and 212*c*. Therefore, the opening/closing member 220 substantially serves to distribute the washing water to the jet nozzles 311, 313 and 320.

The opening/closing member 220 has an approximately hollow cylindrical shape. The opening/closing member 220 includes a rotational body 221 rotated in the housing 210, and sealing members 225 coupled to the rotational body 221 to close the outlets 212*a*, 212*b* and 212*c*.

Communication holes 222 may be formed at a circumferential surface of the rotational body 221. When the communication holes 222 are located to correspond to the outlets 212*a*, 212*b* and 212*c*, the washing water may be smoothly discharged to the outlets 212*a*, 212*b* and 212*c*.

Further, spacing protrusions 224 configured to space apart an inner circumferential surface of the housing 210 and an outer circumferential surface of the rotational body 221 in a predetermined distance may be formed on the circumferential surface of the rotational body 221 to minimize friction with the housing 210 when the opening/closing member 220 is rotated in the housing 210, such that the opening/closing member 220 may be smoothly rotated. The inner circumferential surface of the housing 210 and the outer circumferential surface of the rotational body 221 may be always maintained to have the predetermined distance therebetween.

Further, hooking holes 223 in which the sealing members 225 are coupled may be formed at the circumferential surface of the rotational body 221. Hooking protrusions 227 of the sealing members 225 are coupled in the hooking holes 223. The hooking holes 223 may have different shapes to correspond to shapes of the hooking protrusions 227 of the sealing members 225.

As an example, the central hooking hole 223 may have an approximately cross shape, and the side hooking holes 223 may have straight line shapes. Similarly, the hooking protrusion 227 of the central sealing member 225 may have the cross shape, and the side hooking protrusions 227 may have the straight line shapes.

The reason why to have the different shapes is to easily discriminate the sealing members 225 in the case in which the central sealing member 225 and the side sealing members 225 have the different shapes from each other.

One of the both axial ends of the rotational body 221, which corresponds to the inlet 211 of the housing 210 is opened. A cam shaft coupling portion 229, to which a cam shaft 241 of the cam member 240 is coupled, is provided at the other one of the both axial ends of the rotational body 221.

The sealing members 225 are coupled to the circumferential surface of the rotational body 221 to close the outlets 212*a*, 212*b* and 212*c*. The sealing members 225 are coupled into the hooking holes 223 of the rotational body 221. The sealing members 225 are coupled into the hooking holes 223 of the rotational body 221 to be slightly movable in a radial direction. This allows the sealing members 225 to be in close contact with the outlets 212*a*, 212*b* and 212*c* and thus to reinforce sealing of the outlets 212*a*, 212*b* and 212*c*.

That is, the sealing members 225 are moved between an opening position in close contact with the rotational body 221 and a closing position in close contact with the outlets 212*a*, 212*b* and 212*c*. When the washing water is introduced into the housing 210, the sealing members 225 may be naturally moved from the opening position to the closing position by the water pressure of the washing water. Therefore, the sealing of the outlets 212*a*, 212*b* and 212*c* is enhanced, and the reliability of the distribution device 200 is improved.

The sealing members 225 include sealing portions 226 (FIG. 8) having curved shapes to be in close contact with the outlets 212*a*, 212*b* and 212*c*, and the hooking protrusions 227 configured to protrude from the sealing portions 226 to be inserted into the hooking holes 223 of the rotational body 221.

The hooking protrusions 227 and the hooking holes 223 are provided to have clearances therebetween, such that the sealing members 225 are movable in the radial direction. However, a stopper portion 228 having a larger diameter than that of the hooking hole 223 may be formed at an end of the hooking protrusion 227 so that the sealing member 225 is prevented from being completely separated from the hooking hole 223.

The sealing member 225 may be integrally formed of a resin material. The sealing member 225 may be easily assembled to the rotational body 221 in a fitting manner in which the hooking protrusion 227 is forcibly pressed and inserted into the hooking hole 223. After the assembling, the stopper portion 228 is hooked into the hooking hole 223, and the rotational body 221 is not separated unless an external force is manually applied thereto.

Figure 11:
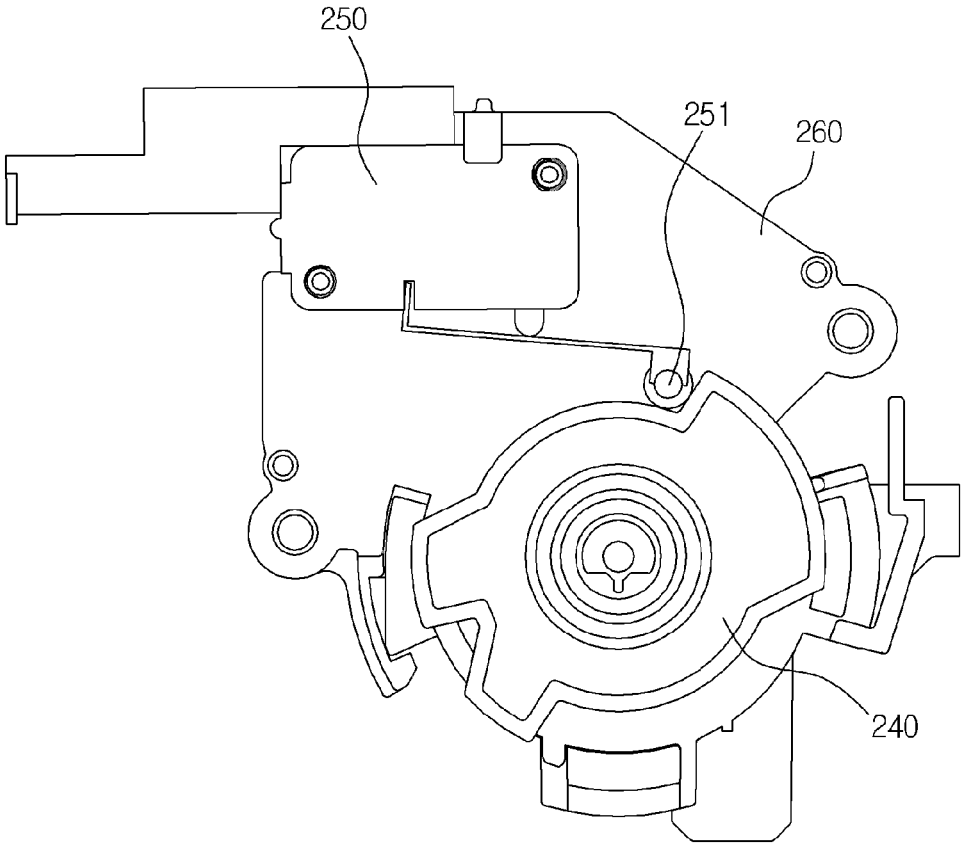
FIG. 11 is a side view illustrating the distribution device of the dish washing machine of FIG. 1 in which a motor is omitted.
Figure 12:
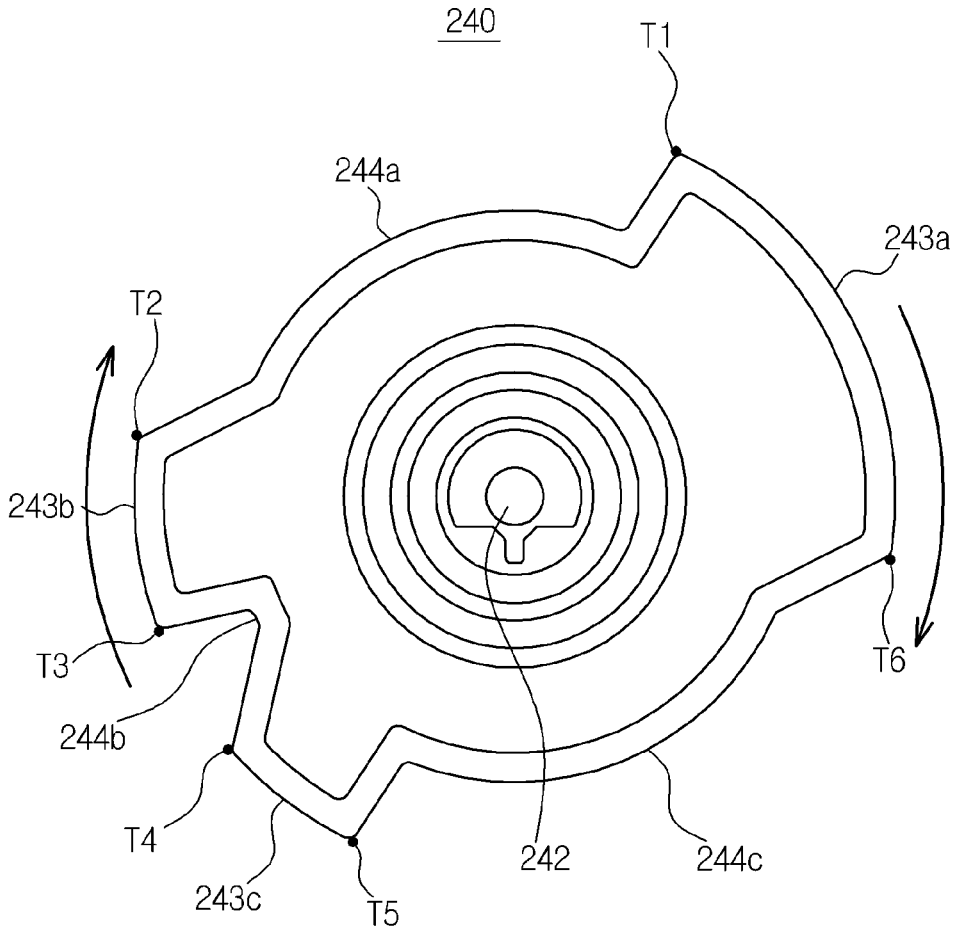
FIG. 12 is an enlarged view of a cam member of the distribution device of the dish washing machine of FIG. 1.
Figure 13:
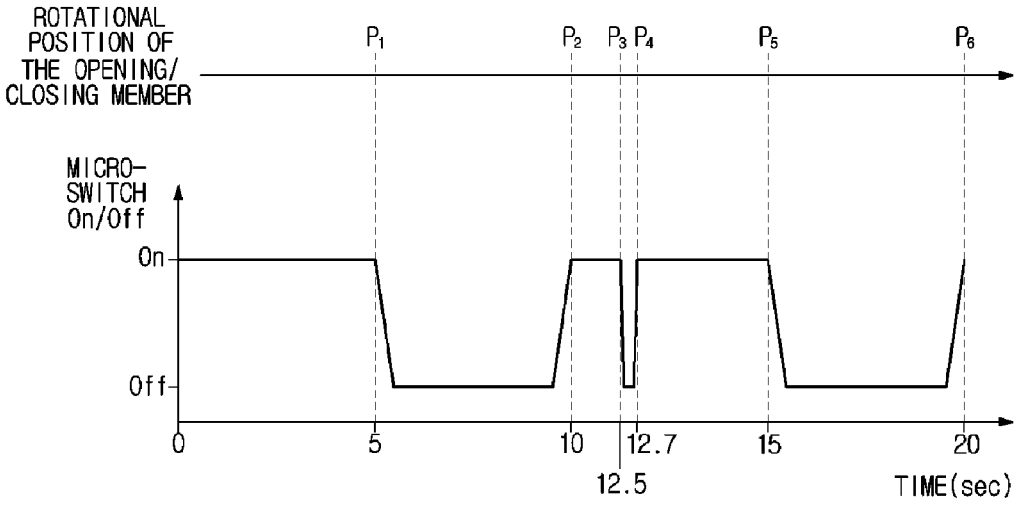
FIG. 13 is a view illustrating a relationship between an on/off time of a micro-switch and a rotational position of the opening/closing member in the distribution device of the dish washing machine of FIG. 1.
Figure 14:
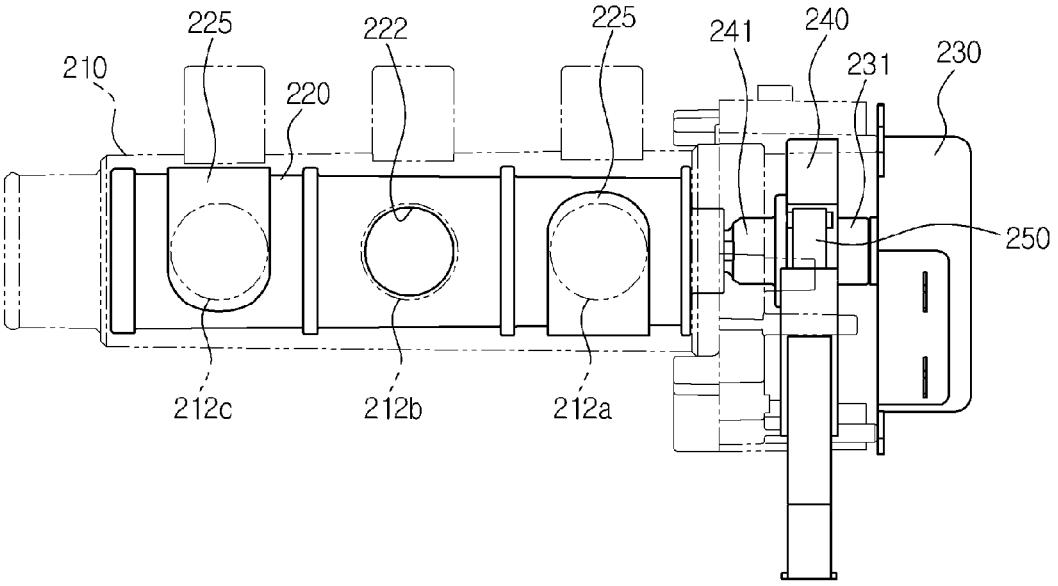
FIG. 14 is a view illustrating an operation of the distribution device of the dish washing machine of FIG. 1, wherein only a second outlet is opened, and thus washing water is distributed to only rotary nozzles.
Figure 15:
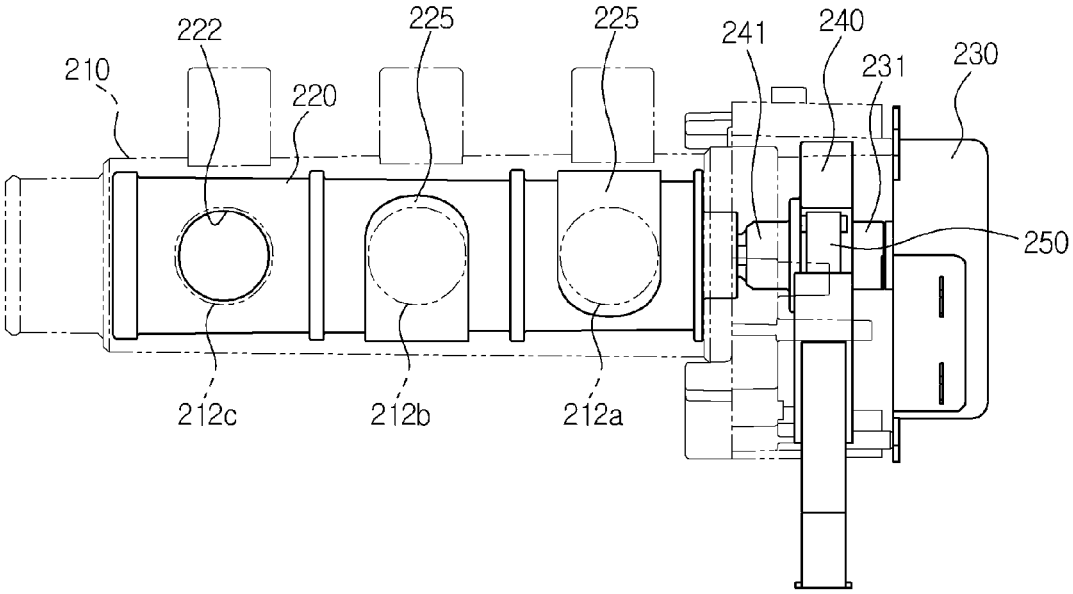
FIG. 15 is a view illustrating an operation of the distribution device of the dish washing machine of FIG. 1, wherein only a third outlet is opened, and thus the washing water is distributed to only the right fixed nozzle assembly.
Figure 16:
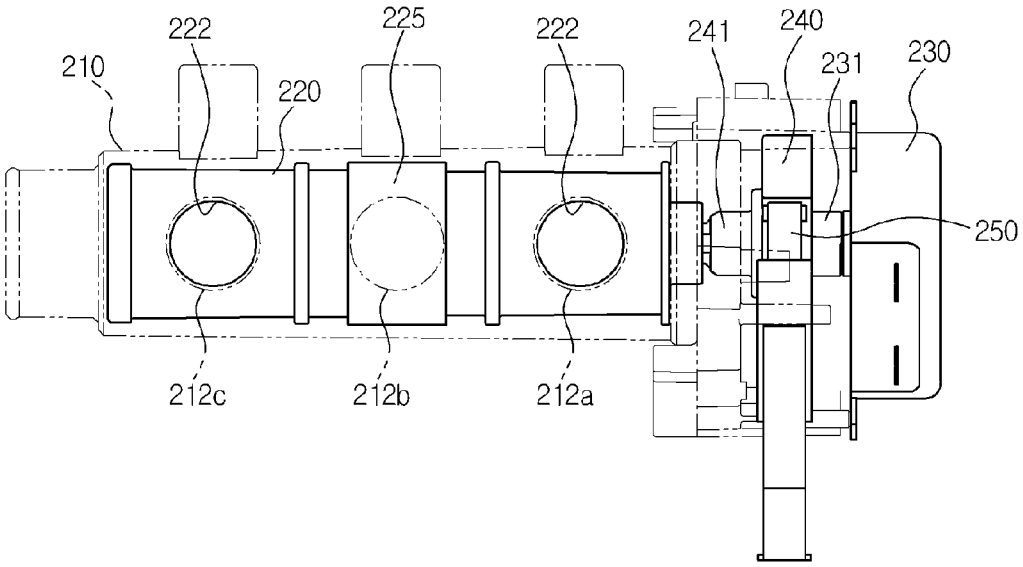
FIG. 16 is a view illustrating an operation of the distribution device of the dish washing machine of FIG. 1, wherein only the first and third outlets are opened, and thus the washing water is distributed to only the left and right fixed nozzle assemblies.
Figure 17:
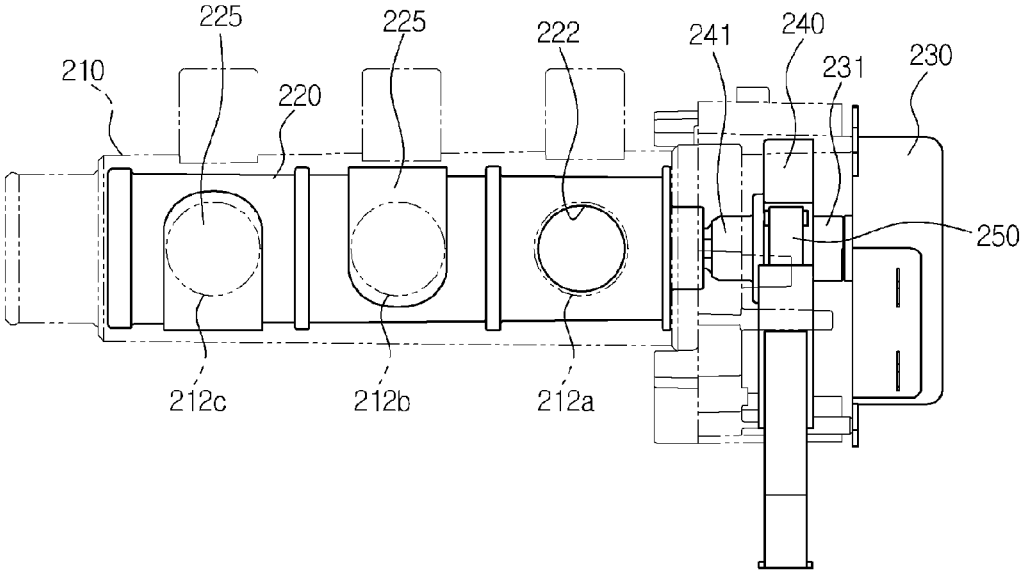
FIG. 17 is a view illustrating an operation of the distribution device of the dish washing machine of FIG. 1, wherein only the first outlet is opened, and thus the washing water is distributed to only the left fixed nozzle assembly.

FIG. 11 is a side view illustrating the distribution device of the dish washing machine of FIG. 1 (in which a motor is omitted). FIG. 12 is an enlarged view of the cam member of the distribution device of the dish washing machine of FIG. 1. FIG. 13 is a view illustrating a relationship between an on/off time of the micro-switch and a rotational position of the opening/closing member in the distribution device of the dish washing machine of FIG. 1. FIG. 14 is a view illustrating an operation of the distribution device of the dish washing machine of FIG. 1, wherein only the second outlet is opened, and thus washing water is distributed to only rotary nozzles. FIG. 15 is a view illustrating an operation of the distribution device of the dish washing machine of FIG. 1, wherein only the third outlet is opened, and thus the washing water is distributed to only the right fixed nozzle assembly. FIG. 16 is a view illustrating an operation of the distribution device of the dish washing machine of FIG. 1, wherein only the first and third outlets are opened, and thus the washing water is distributed to only the left and right fixed nozzle assemblies. FIG. 17 is a view illustrating an operation of the distribution device of the dish washing machine of FIG. 1, wherein only the first outlet is opened, and thus the washing water is distributed to only the left fixed nozzle assembly.

With reference to FIGS. 11 to 17, an operation of the distribution device according to one embodiment of the present disclosure will be described.

When the motor 230 is driven, a rotational force is transmitted to the cam member 240 through a motor shaft 231, and the cam member 240 is rotated. The motor 230 may be a one-way motor which is rotated in only one direction.

For convenience's sake, based on FIG. 12, it is assumed that the cam member 240 is rotated around a rotational center 242 in a clockwise direction. If the cam member 240 is rotated, the rotational force is transmitted to the opening/closing member 220 through the cam shaft 241, and thus the opening/closing member 220 is rotated together.

The cam member 240 is provided to be in contact with a contact terminal 251 of the micro-switch 250. The cam member 240 includes convex portions 243*a*, 243*b* and 243*c* configured to protrude in a radial direction to turn on/off the micro-switch 250, and concave portions 244*a*, 244*b* and 244*c* recessed in the radial direction.

The convex portions 243*a*, 243*b* and 243*c* may include a first convex portion 243*a*, a second convex portion 243*b*, and a third convex portion 243*c* which are arranged in turn in a counterclockwise direction, and the concave portions 244*a*, 244*b* and 244*c* may include a first concave portion 244*a*, a second concave portion 244*b*, and a third concave portion 244*c* which are arranged in turn in a counterclockwise direction.

It is assumed that the micro-switch 250 is turned on when the contact terminal 251 is in contact with the convex portions 243*a*, 243*b* and 243*c* of the cam member 240, and turned off when the contact terminal 251 is in contact with the concave portions 244*a*, 244*b* and 244*c* of the cam member 240. Therefore, when the motor is driven, the micro-switch 250 may be alternately turned on and off.

Meanwhile, the distribution device 200 further includes a control part which designates rotational positions of the opening/closing member 220 according to an on/off time of the micro-switch 250, and rotates or stops the motor 230 so that the opening/closing member 220 is rotated to a necessary position of the designated rotational positions.

As an example, as illustrated in FIG. 13, the control part may designate 6 rotational positions P1, P2, P3, P4, P5 and P6 of the opening/closing member 220.

The control part may designate the rotational position of the opening/closing member 220 at a point of time when the micro-switch 250 is turned on for 5 seconds and then turned off as a first rotational position P1 of the 6 rotational positions P1, P2, P3, P4, P5 and P6 of the opening/closing member 220.

In the embodiment, since the point of time when the micro-switch 250 is turned on for 5 seconds and then turned off is unique, a section in which the micro-switch 250 is turned on for 5 seconds may be a reference reset section.

The rotational position of the opening/closing member 220 at a point of time when the micro-switch 250 is turned on for 5 seconds, turned off for another 5 seconds, and then turned on again may be designated as a second rotational position P2.

In the same manner, first to sixth rotational positions P1 to P6 may be designated.

In the 6 rotational positions P1, P2, P3, P4, P5 and P6 of the opening/closing member 220, the contact terminal 251 of the micro-switch 250 is located at each contact terminal positions T1, T2, T3, T4, T5 and T6 shown in FIG. 12.

In the control part, rotational position information of the opening/closing member 220 according to the on/off time of the micro-switch 250 may be previously stored in a ROM type.

Further, in the control part, opening/closing information of the outlets 212*a*, 212*b* and 212*c* of the distribution device 200 according to each rotational position of the opening/closing member 220, and jet information of the jet nozzles 311, 313, 330 and 340 according to the opening and closing of the outlets 212*a*, 212*b* and 212*c* may be also previously stored in the ROM type.

Therefore, when a user inputs a particular jet nozzle 311, 313, 330, 360 to be used, the control part may determine the outlet 212*a*, 212*b*, 212*c* to be opened or closed, and thus may determine the particular rotational position of the opening/closing member 220.

To rotate the opening/closing member 220 to the determined particular rotational position, the control part may drive the motor 230, and then stop the motor 230 when the opening/closing member 220 is completely rotated to the particular rotational position.

In the embodiment, when the opening/closing member 220 is in the first rotational position P1, only the second outlet 212*b* is opened as illustrated in FIG. 14, and thus the washing water may be distributed to only the rotary nozzles 311 and 313.

When the opening/closing member 220 is in the second rotational position P2, only the third outlet 212*c* is opened as illustrated in FIG. 15, and thus the washing water may be distributed to only the right fixed nozzle 360.

The third and fourth rotational positions P3 and P4 of the opening/closing member 220 are not used.

When the opening/closing member 220 is in the fifth rotational position P5, only the first and third outlets 212*a* and 212*c* are opened as illustrated in FIG. 16, and thus the washing water may be distributed to only the left and right fixed nozzles 330 and 340.

When the opening/closing member 220 is in the sixth rotational position P6, only the first outlet 212*a* is opened as illustrated in FIG. 17, and thus the washing water may be distributed to only the left fixed nozzle assembly 330.

Figure 18A:
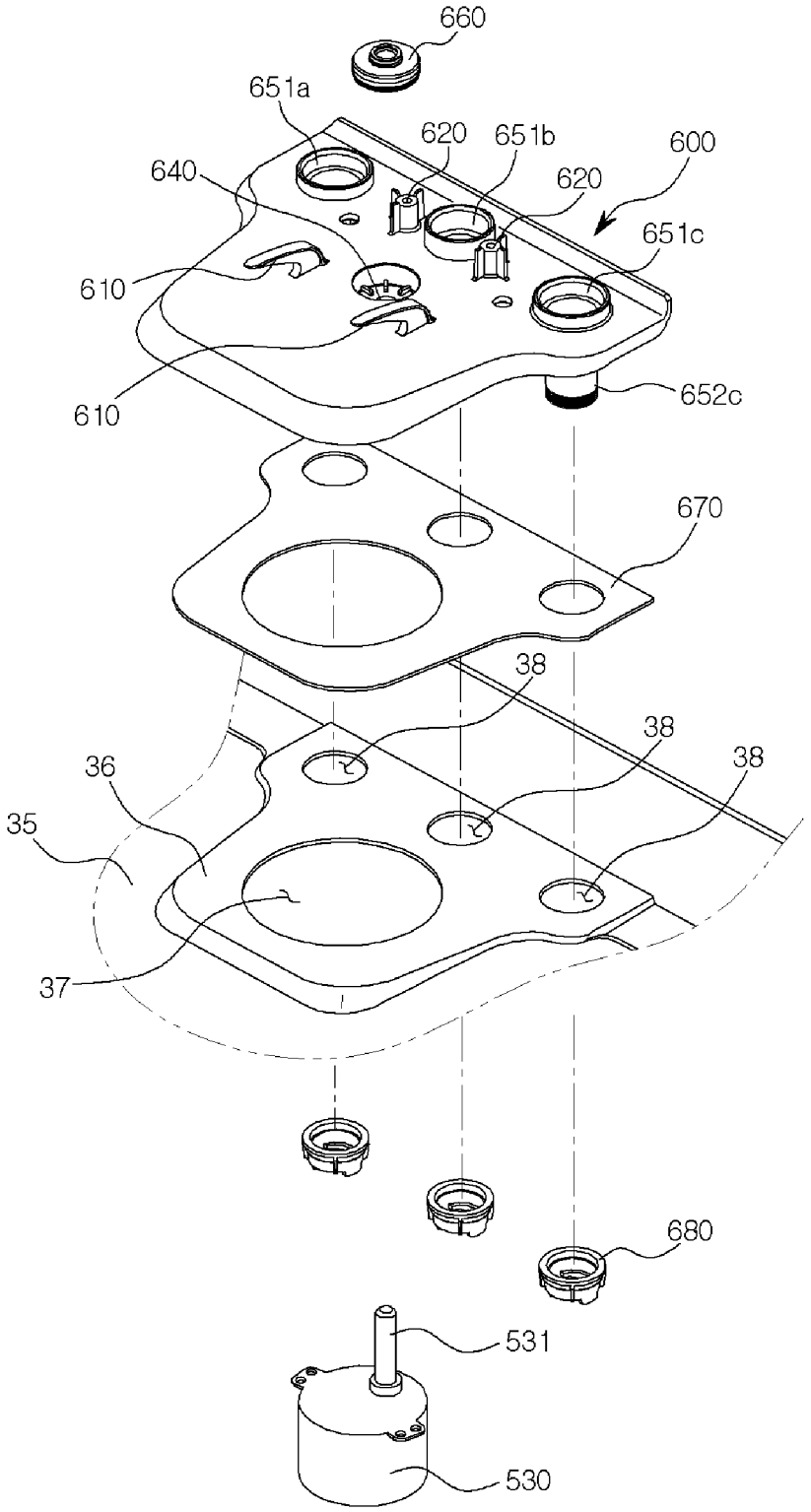
FIG. 18A is a view illustrating a state in which a bottom plate, a bottom plate cover and a motor in a washing tub of the dish washing machine of FIG. 1 are disassembled.
Figure 18B:
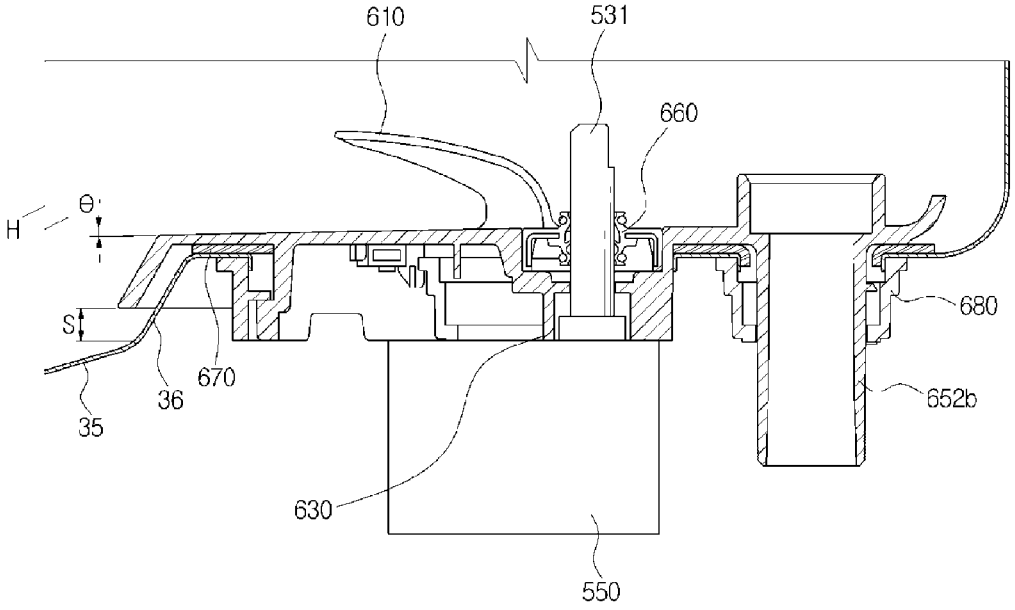
FIG. 18B is a cross-sectional view of the bottom plate, the bottom plate cover and the motor in the dish washing machine of FIG. 1.
Figure 19A:
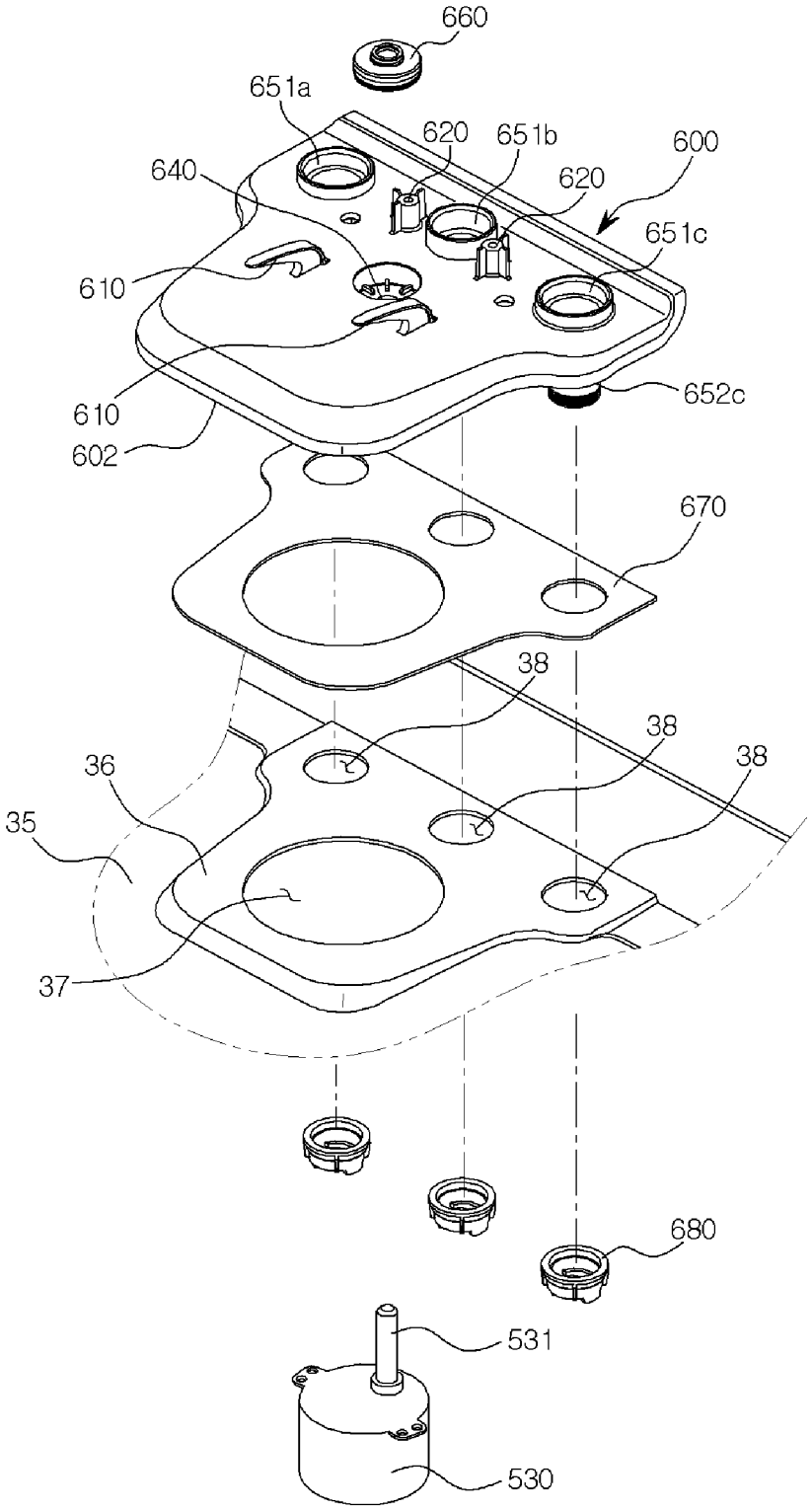
FIG. 19A is a view illustrating a state in which a sealing member is added to FIG. 18A.
Figure 19B:
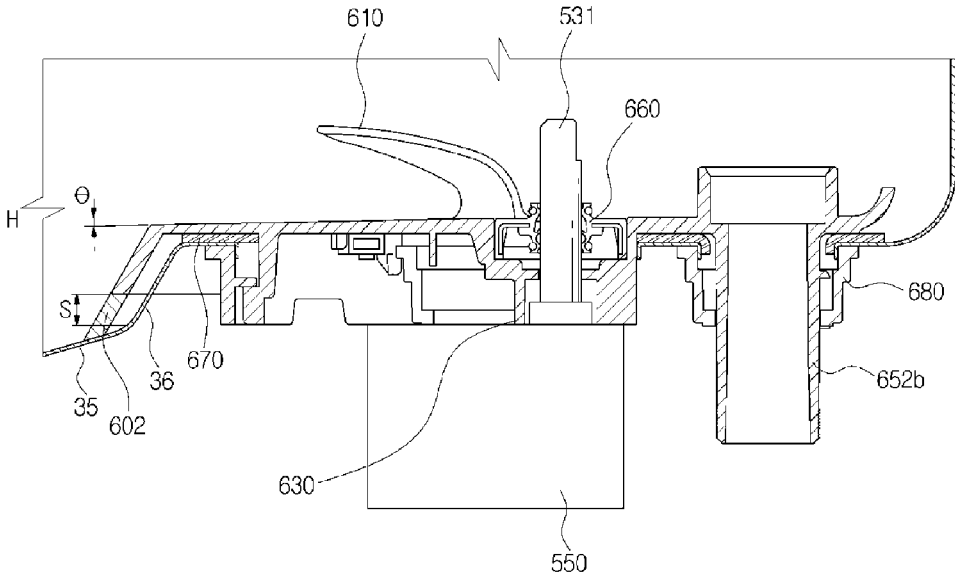
FIG. 19B is a view illustrating a state in which the sealing member is added to FIG. 18B.
Figure 20:
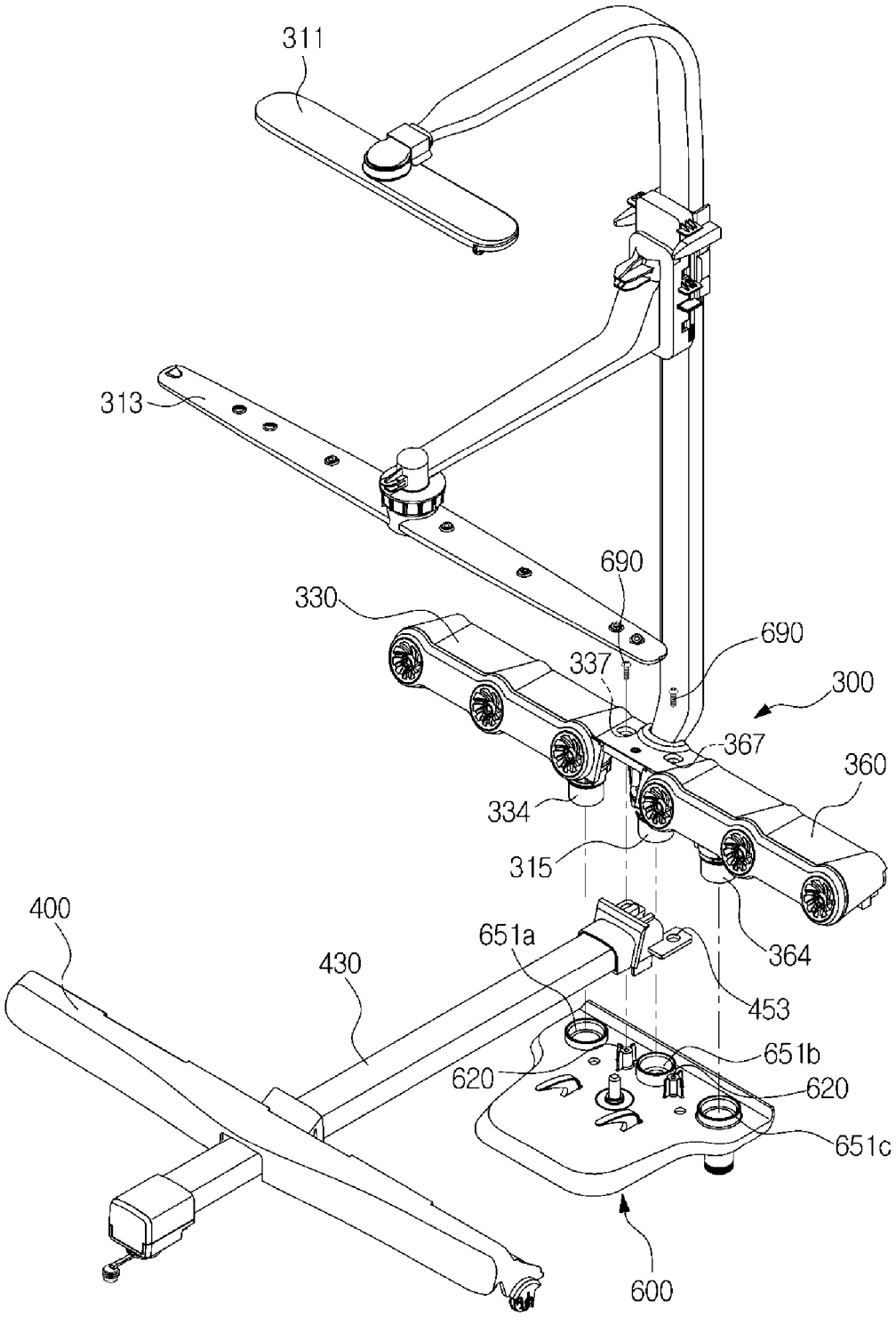
FIG. 20 is a view illustrating a state in which a vane, a rail assembly, a jet nozzle assembly and the bottom plate cover in the dish washing machine of FIG. 1 are disassembled.

FIG. 18A is a view illustrating a state in which the bottom plate, the bottom plate cover and the motor in the washing tub of the dish washing machine of FIG. 1 are disassembled. FIG. 18B is a cross-sectional view of the bottom plate, the bottom plate cover and the motor in the dish washing machine of FIG. 1. FIG. 19A is a view illustrating a state in which the sealing member is added to FIG. 18A. FIG. 19B is a view illustrating a state in which the sealing member is added to FIG. 18B. FIG. 20 is a view illustrating a state in which the vane, a rail assembly, a jet nozzle assembly and the bottom plate cover in the dish washing machine of FIG. 1 are disassembled.

With reference to FIGS. 18A to 20, the bottom plate cover of the dish washing machine according to one embodiment of the present disclosure will be described.

The dish washing machine 1 includes the bottom plate cover 600 coupled to rear one side of the bottom plate 35 of the washing tub 30 of the dish washing machine 1.

The bottom plate cover 600 serves to seal a motor passing hole 37 and passage passing holes 38 which are formed at the bottom plate 35, to support a motor 530 configured to drive the vane 400, and to fix a nozzle assembly 300 and a rail assembly 430 of the dish washing machine 1.

Here, as described above, the nozzle assembly 300 includes the upper rotary nozzle 311, the middle rotary nozzle 313, the left fixed nozzle assembly 330, and the right fixed nozzle 360.

The rail assembly 430 serves to guide movement of the vane 400 and will be described later in detail.

A bottom plate protrusion 36 which protrudes so that the bottom plate cover 600 is coupled thereto may be formed at a rear side of the bottom plate 35. The motor passing hole 37 through which the motor 530 for driving the vane 400 passes and the passage passing holes 38 through which a passage connecting the nozzle assembly 300 and the distribution device 200 (FIG. 3) passes may be formed at the bottom plate protrusion 36.

The motor 530 is mounted on a lower surface of the bottom plate cover 600, and when the bottom plate cover 600 is disassembled from the bottom plate 35, the motor 530 may be separated together with the bottom plate cover 600 through the motor passing hole 37.

Specifically, hose connecting portions 652*a*, 652*b* and 652*c* of the bottom plate cover 600 may pass through the passage passing holes 38.

The bottom plate cover 600 includes a shaft passing hole 640 through which a driving shaft 531 of the motor 530 passes, the hose connecting portions 652*a*, 652*b* and 652*c* configured to protrude downward so that the hoses 271*a*, 271*b* and 271*c* extending from the distribution device 200 are coupled thereto and inserted into the passage passing holes 38 of the bottom plate protrusion 36, nozzle inlet port connecting portions 651*a*, 651*b* and 651*c* configured to protrude upward so that inlet ports 315, 334 and 364 of the nozzle assembly 300 are coupled thereto, coupling holes 620 configured to fix the nozzle assembly 300 and the rail assembly 430, and a rotational guide 610 configured to protrude to guide rotation of the vane 400.

The bottom plate cover 600 is in close contact with and coupled to an upper surface of the bottom plate protrusion 36. Fixing caps 680 are coupled to the hose connecting portions 652*a*, 652*b* and 652*c* of the bottom plate cover 600, and thus the bottom plate cover 600 may be fixed to the bottom plate protrusion 36.

A sealing member 670 may be provided between the bottom plate cover 600 and the bottom plate protrusion 36 to prevent the washing water in the washing tub 30 from leaking through the motor passing hole 37 and the passage passing holes 38 of the bottom plate protrusion 36. The sealing member 670 may be formed of a rubber material.

A motor mounting portion 630 to which the motor 530 driving the vane 400 is mounted may be provided at a lower surface of the bottom plate cover 600. The driving shaft 531 of the motor 530 may pass through the shaft passing hole 640 of the bottom plate cover 600 and protrude into the washing tub 30. A driving pulley 500 (FIG. 21) to be described later is coupled to the driving shaft 531 of the motor 530 to be rotated together with the driving shaft 531.

A sealing member 660 may be provided at the shaft passing hole 640 to prevent the washing water in the washing tub 30 from leaking through the shaft passing hole 640. The sealing member 660 may be a mechanical sealing device which may achieve the sealing and also may allow the driving shaft 531 to be smoothly rotated.

The upper surface of the bottom plate cover 600 may be provided to be inclined at a predetermined angle with respect to a reference horizontal surface H (FIG. 19).

This is to prevent the slops from being collected on the bottom plate cover 600, or the slops from being moved to the fixed jet nozzles 320. In the dish washing machine 1 according to one embodiment of the present disclosure, since the fixed jet nozzles 320, unlike the rotary nozzles 311 and 313, are not moved, and thus the slops may be remained or stayed, this problem may be prevented by the above-mentioned structure.

An inclined angle θ between the upper surface of the bottom plate cover 600 and the reference horizontal surface H may be approximately 3° or more.

Further, an end of the bottom plate cover 600 may be proved to be spaced apart from the bottom plate 35 in a predetermined distance S (FIG. 19). This is because it is difficult that the bottom plate cover 600 is completely in close contact with the bottom plate 35 due to an error in a manufacturing or assembling process, and this is also to prevent the slops from being caught in a fine gap formed between the end of the bottom plate cover 600 and the bottom plate 35. The distance S between the end of the bottom plate cover 600 and the bottom plate 35 may be approximately 5 mm or more.

The rail assembly 430 and the nozzle assembly 300 may be coupled to the bottom plate cover 600. The bottom plate cover 600, the rail assembly 430, and the nozzle assembly 300 may be firmly fixed by a coupling member 690. To this end, the coupling holes 620, 453, and 347 may be formed at corresponding positions of the bottom plate cover 600, the nozzle assembly 300, and the rail assembly 430.

By this structure, the rail assembly 430 and the nozzle assembly 300 may be fixed and aligned to each other.

In the dish washing machine 1 according to one embodiment of the present disclosure, since the washing water jetted from the fixed jet nozzles 320 of the nozzle assembly 300 is not directly directed to the dishes but reflected by the vane 400 coupled to the rail assembly 430 and then directed to the dishes, the fixed jet nozzles 320 and the rail assembly 430 are required to be precisely positioned and aligned. This requirement may be satisfied by the above-mentioned coupling structure.

The end of the bottom plate cover 600 may be provided to be spaced apart from the bottom plate 35 in the predetermined distance. Alternatively, a sealing member 602 may be further included at the end of the bottom plate cover 600.

The sealing member 602 may be provided at the end of the bottom plate cover 600 so that the bottom plate 35 and the bottom plate cover 600 are in close contact with each other. Through this configuration, the slops may be prevented from being caught in the fine gap formed between the end of the bottom plate cover 600 and the bottom plate 35.

The sealing member 602 may be formed of an elastic material such as rubber and a gasket, or may be formed of a deformable material such as a sponge.

Further, the bottom plate cover 600 may be treated by a process which etches an outer surface such as an oxide film. The washing water flowing on a surface of the bottom plate cover 600 may be easily vaporized by the process. For example, only the surface etching process of the bottom plate cover 600 was described, but the surface etching process may be applied to other elements in the washing tub.

Figure 21:
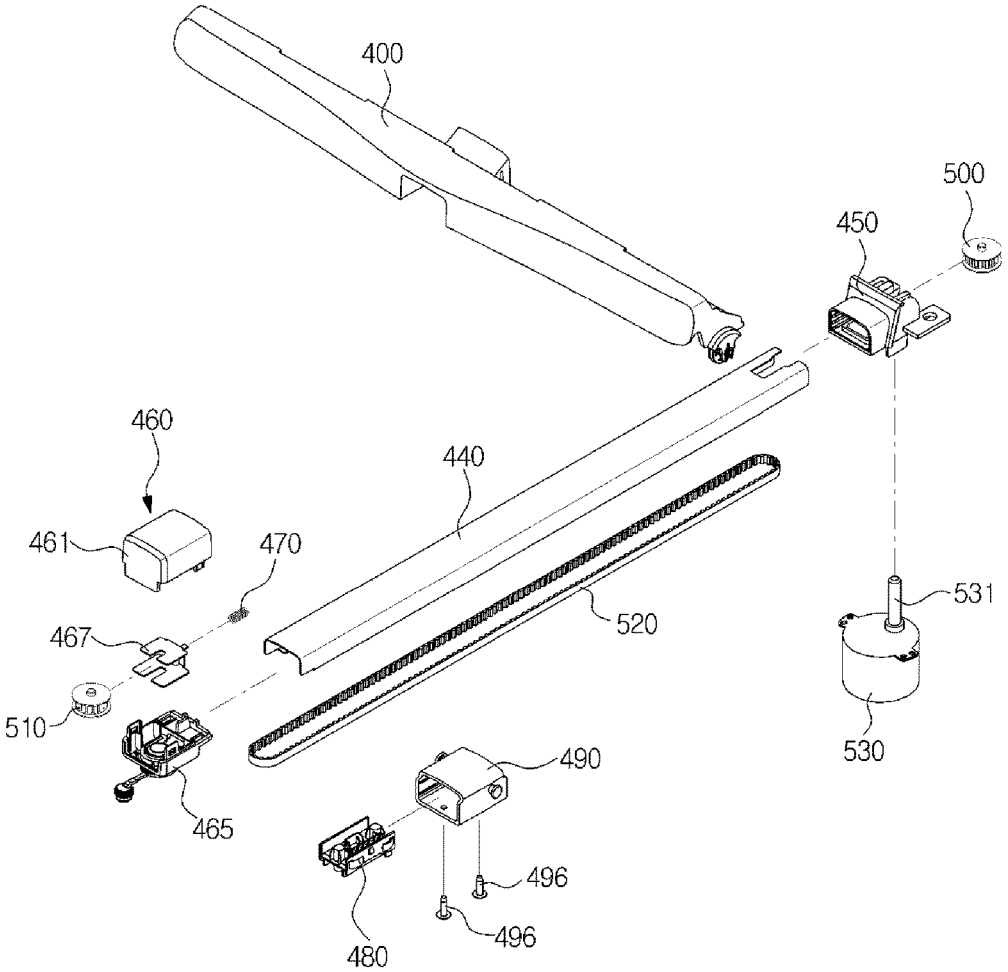
FIG. 21 is a view illustrating the vane and a driving device in the dish washing machine of FIG. 1, wherein the driving device is disassembled.
Figure 22:
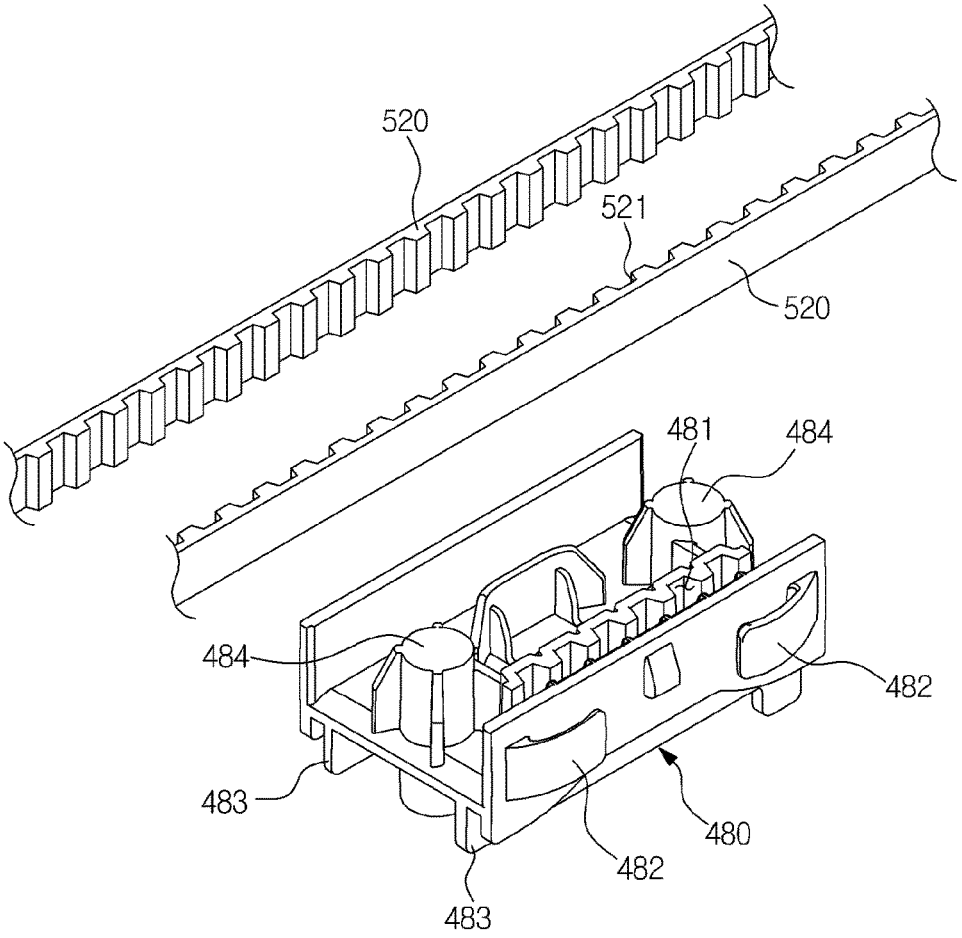
FIG. 22 is a view illustrating a belt and a belt holder of the dish washing machine of FIG. 1.
Figure 23:
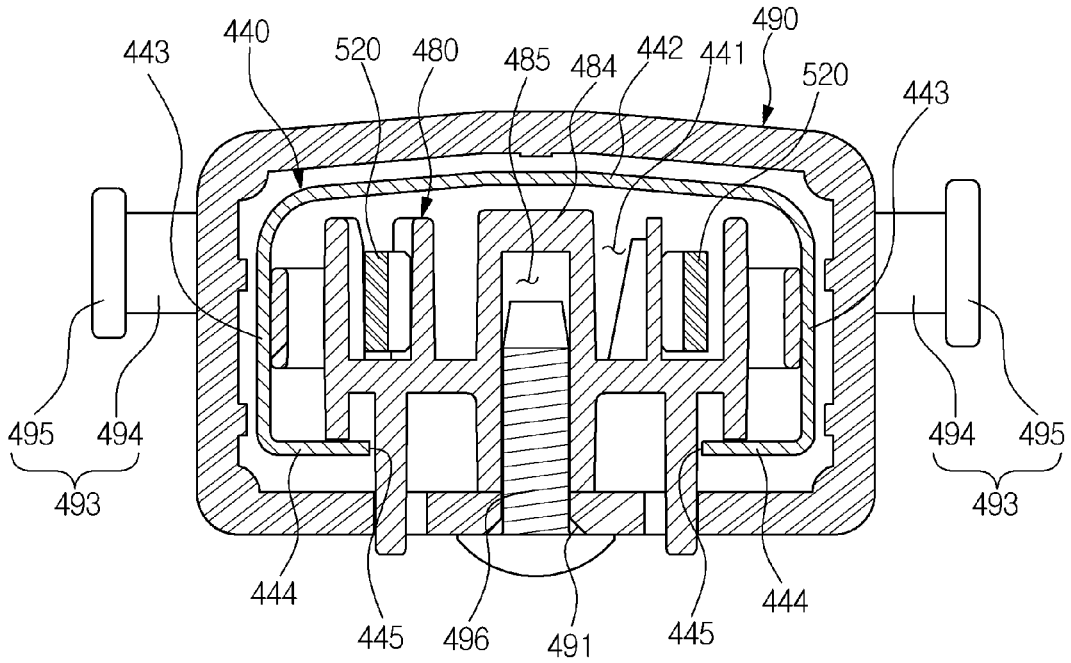
FIG. 23 is a cross-sectional view illustrating a rail, the belt, the belt holder, and a vane holder of the dish washing machine of FIG. 1.
Figure 24:
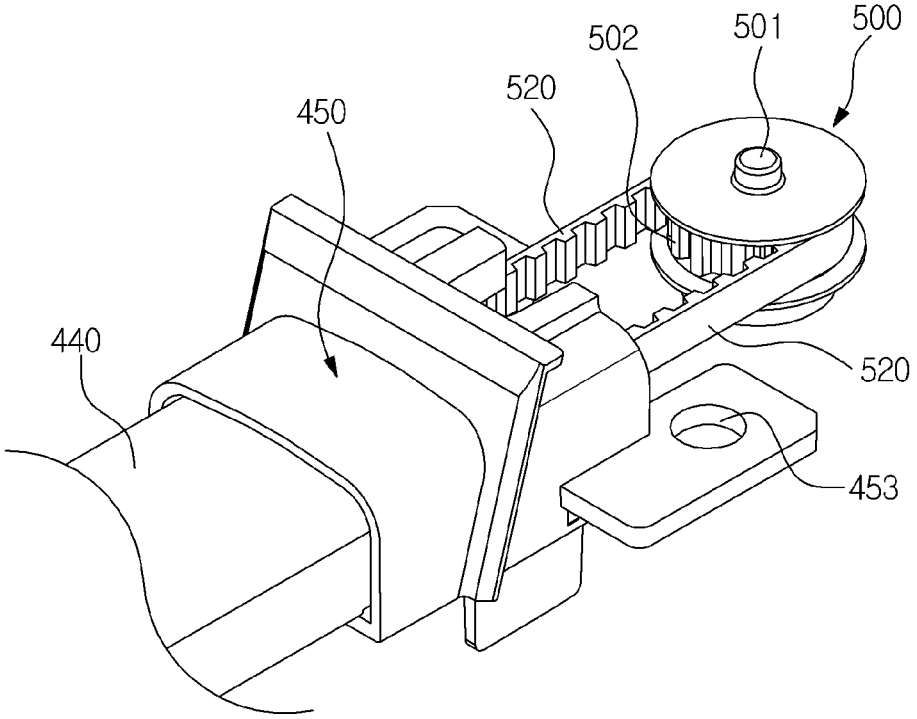
FIG. 24 is a view illustrating the rail, the belt, a driving pulley and a rear holder of the dish washing machine of FIG. 1.
Figure 25:
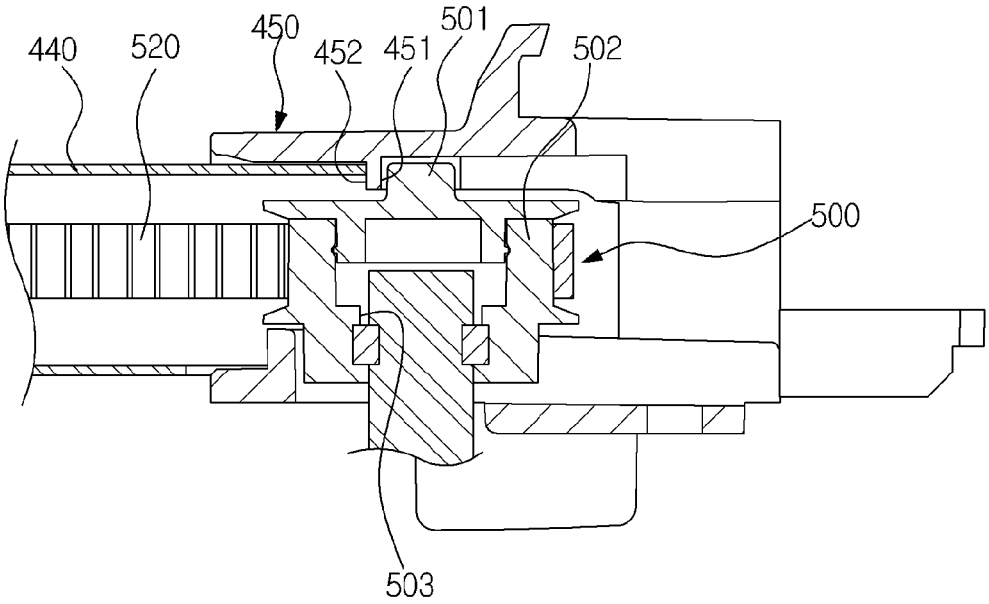
FIG. 25 is a cross-sectional view illustrating the rail, the belt, the driving pulley and the rear holder of the dish washing machine of FIG. 1.
Figure 26:
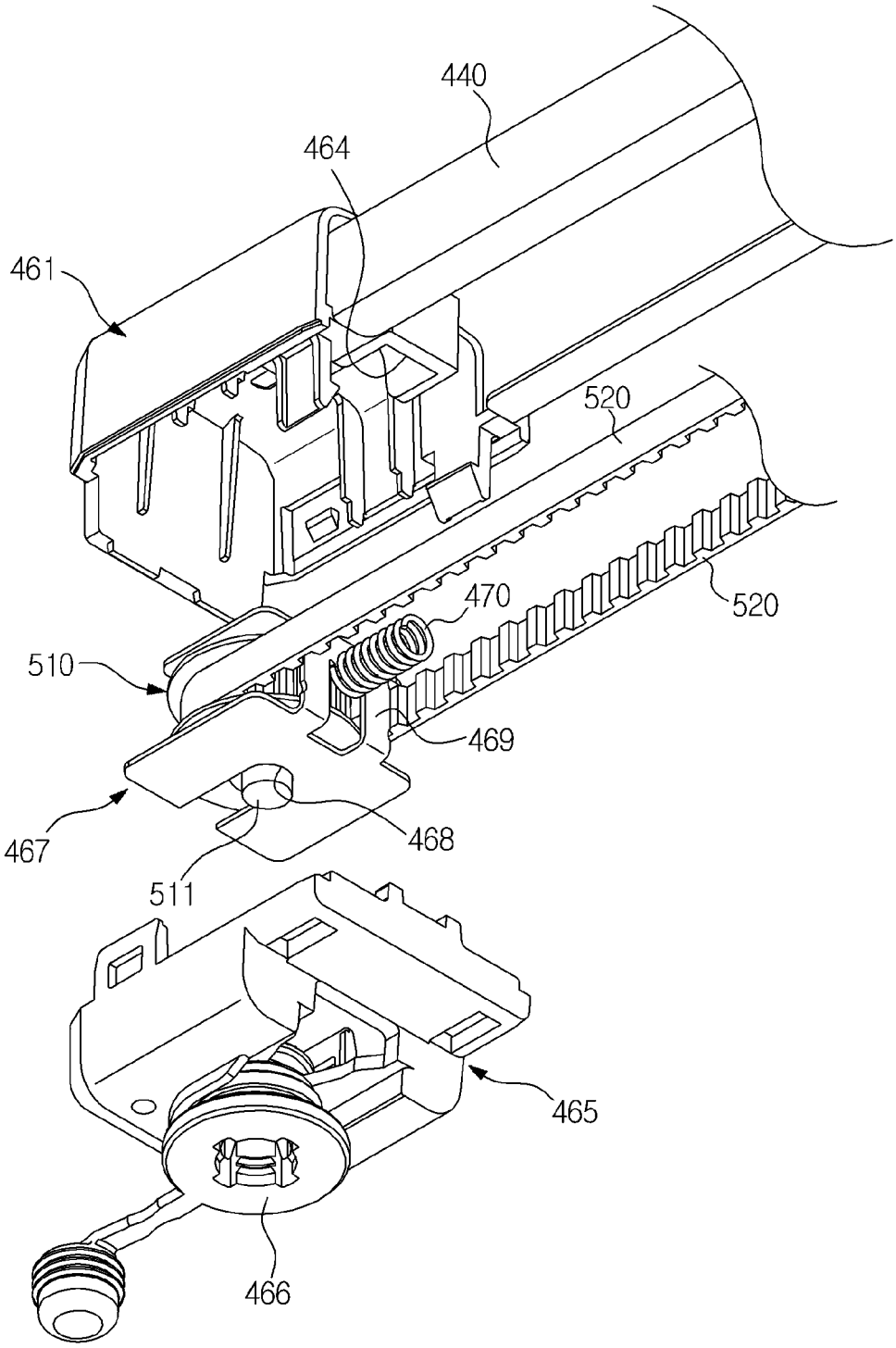
FIG. 26 is a view illustrating the rail, the belt, an idle pulley and a front holder of the dish washing machine of FIG. 1.
Figure 27:
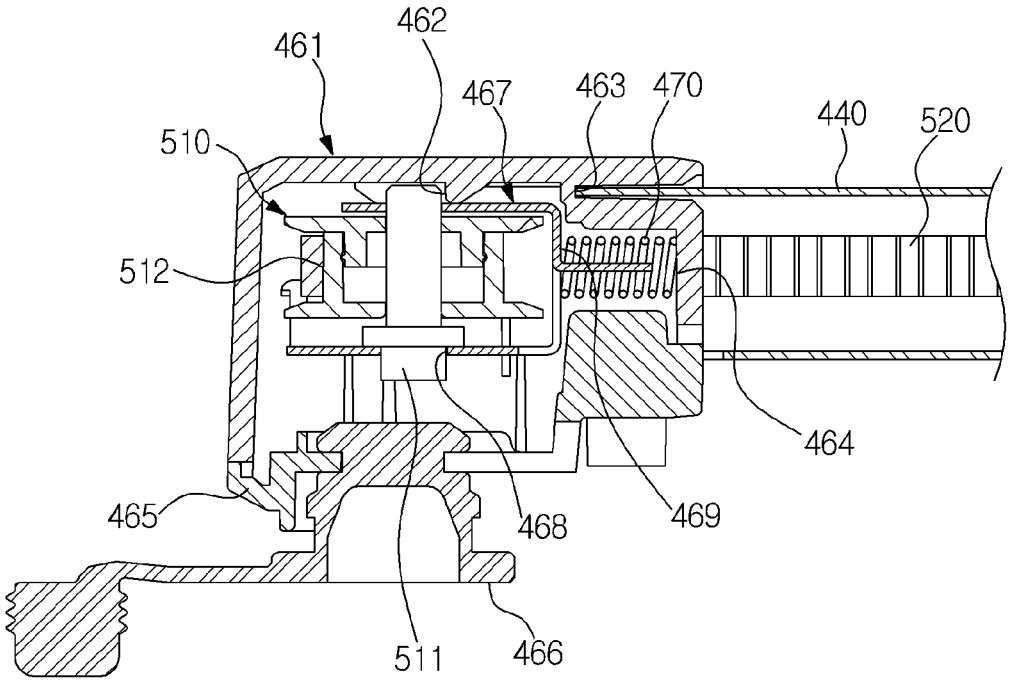
FIG. 27 is a cross-sectional view illustrating the rail, the belt, the idle pulley and the front holder of the dish washing machine of FIG. 1.

FIG. 21 is a view illustrating the vane and the driving device in the dish washing machine of FIG. 1, wherein the driving device is disassembled. FIG. 22 is a view illustrating a belt and a belt holder of the dish washing machine of FIG. 1. FIG. 23 is a cross-sectional view illustrating a rail, the belt, the belt holder, and a vane holder of the dish washing machine of FIG. 1. FIG. 24 is a view illustrating the rail, the belt, a driving pulley and a rear holder of the dish washing machine of FIG. 1. FIG. 25 is a cross-sectional view illustrating the rail, the belt, the driving pulley and the rear holder of the dish washing machine of FIG. 1. FIG. 26 is a view illustrating the rail, the belt, an idle pulley and a front holder of the dish washing machine of FIG. 1. FIG. 27 is a cross-sectional view illustrating the rail, the belt, the idle pulley and the front holder of the dish washing machine of FIG. 1.

With reference to FIGS. 21 to 27, the vane and the driving device thereof in the dish washing machine according to one embodiment of the present disclosure will be described.

The dish washing machine 1 according to one embodiment of the present disclosure includes the vane 400 configured to reflect the washing water jetted from the fixed nozzle assembly 320. The vane 400 may be reciprocated in a jet direction of the washing water jetted from the fixed jet nozzles 320.

The dish washing machine 1 according to one embodiment of the present disclosure includes the driving device 420 which linearly reciprocates the vane 400.

The driving device 420 includes the motor 530 configured to generate the driving force, and the rail assembly 430 configured to guide movement of the vane 400.

The rail assembly 430 includes a rail 440 configured to guide the movement of the vane 400 and having an inner space 441, the driving pulley 500 connected to the motor 530 to be rotated, a belt 520 connected to the driving pulley 500 to be rotated and disposed in the inner space 441 of the rail 440, an idle pulley 510 connected with the belt 520 to rotatably support the belt 520, a belt holder 480 coupled to the belt 520 and disposed in the inner space 441 of the rail 440 to be linearly reciprocated, a vane holder 490 coupled to the belt holder 480, disposed at an outside of the rail 440 to be reciprocated, and to which the vane 400 is coupled, a rear holder 450 configured to rotatably support the driving pulley 500 and coupled to a rear end of the rail 440, and a front holder 460 configured to rotatably support the idle pulley 510 and coupled to a front end of the rail 440.

The rail 440 may be formed of a metallic material. The rail 440 may be provided at a center between the left wall 33 and the right wall 34 of the washing tub 30 to extend long in front and rear directions.

The rail 440 may have an approximately tubular shape having an opening 445 formed at a lower portion thereof. That is, the rail 440 may include the inner space 441, an upper wall 442, a lower wall 444, both side walls 443, and the lower opening 445 formed at the lower wall 444. The lower opening 445 may extend from one longitudinal end of the rail 440 to the other end thereof.

The reason why the rail has the tubular shape is to dispose the belt 520 in the inner space 441 of the rail 440 and thus to prevent the belt 520 from being in contact with and obstructed by the dishes of the washing tub 30, or to prevent the belt 520 from being in contact with and corroded by the washing water of the washing tub 30.

Further, the reason why the opening 445 is formed at the lower wall 444 of the rail 440 is to connect the belt 520 disposed in the inner space 441 of the rail 440 and the vane 400 provided at the outside of the rail 440 and thus to transmit a driving force of the belt 520 to the vane 400.

The belt 520 may be wound on the driving pulley 500 and the idle pulley 510 to form a closed curve, and may be rotated in a rotational direction of the motor 530 when the motor 530 is driven. The belt 520 may be formed of a resin material including aramid fiber in consideration of tensile force and manufacturing cost thereof.

Gear teeth 521 which transmit the driving force of the belt 520 to the belt holder 480 may be formed at an inner side surface of the belt 520.

The belt holder 480 is disposed in the inner space 441 of the rail 440 in the same manner as the belt 520, and coupled with the gear teeth 521 of the belt 520 to be moved together with the belt 520. To this end, the belt holder 480 may have a gear tooth coupling portion 481 coupled with the gear teeth 521 of the belt 520.

Further, the belt holder 480 may include legs 482 and 483 supported by the rail 440. The legs 482 and 483 may include at least one side leg 482 configured to protrude laterally to be supported by the side walls 443 of the rail 440, and at least one lower leg 483 configured to protrude downward to be supported by the lower wall 444.

The at least one side leg 482 may be provided to be elastically deformed, such that noise and vibration due to collision and friction with the rail 440 are reduced and the belt holder 480 is smoothly moved.

The at least one side leg 482 may be an elastic body which is a kind of a plate spring. That is, the at least one side leg 482 may include a curved plate which is elastically deformed between a relaxed state and a compressed state.

Further, the belt holder 480 may have a coupling portion 484 coupled with the vane holder 490. The coupling portion 484 may include a coupling hole 485 in which a coupling member 496 is inserted.

The vane holder 490 is coupled to the belt holder 480, and moved together with the belt holder 480 to transmit the driving force of the belt holder 480 to the vane 400. The vane holder 490 is provided to cover an outer side surface of the rail 440.

The vane holder 490 is coupled to the belt holder 480 through the lower opening 445 of the rail 440. To this end, the vane holder 490 may have a coupling hole 491 coupled with the belt holder 480. Therefore, the vane holder 490 and the belt holder 480 may be coupled by coupling the coupling member 496 to the coupling hole 491 of the vane holder 490 and the coupling hole 485 of the belt holder 480.

The coupling member 496 may proceed upward from a lower side and may be coupled, in turn, into the coupling hole 491 of the vane holder 490 and the coupling hole 485 of the belt holder 480.

A coupling protrusion 493 to which the vane 400 may be removably coupled may be formed at the vane holder 490. The coupling protrusion 493 may include a coupling shaft portion 494 configured to protrude laterally, and a separation preventing portion 495 formed at an end of the coupling shaft portion 494 to prevent separation of the vane 400.

The driving pulley 500 includes a rotational shaft 501, a shaft connecting portion 503 connected to the driving shaft 531 of the motor 530 to receive the driving force, and a belt coupling portion 502 to which the belt 520 is coupled.

The rear holder 450 rotatably supports the driving pulley 500, and is coupled to the rear end of the rail 440. The rear holder 450 includes a pulley supporting surface 451 configured to support the rotational shaft 501 of the driving pulley 500, a rail supporting surface 452 configured to support the rear end of the rail 440, and the coupling hole 453 provided to be coupled with the bottom plate cover 600.

The idle pulley 510 includes a rotational shaft 511, and a belt coupling portion 512 to which the belt 520 is coupled.

The front holder 460 includes a front top holder 461, a front bottom holder 465 coupled to a lower portion of the front top holder 461, and a pulley bracket 467 disposed between the front top holder 461 and the front bottom holder 465 to be movable in the lengthwise direction of the rail 440 and configured to rotatably support the idle pulley 510.

The front top holder 461 includes a pulley supporting surface 462 configured to support the rotational shaft 511 of the idle pulley 510, and a rail supporting surface 463 configured to support the front end of the rail 440.

The front bottom holder 465 may be coupled to the lower portion of the front top holder 461 by a hooking structure. The front bottom holder 465 may have a coupling protrusion 466 coupled to the bottom plate 35 of the washing tub 30.

The pulley bracket 467 includes a pulley supporting surface 468 configured to support the rotational shaft 511 of the idle pulley 510.

Meanwhile, the rail 440, the belt 520, the driving pulley 500, the rear holder 450, the idle pulley 510, the front holder 460 may be assembled with each other by the tensile force of the belt 520.

That is, the driving pulley 500 is pressed by the tensile force of the belt 520 in a direction to be closer to the rail 440, and this force is transmitted to the rear holder 450 through the pulley supporting surface 451 of the rear holder 450, and as a result, the rear holder 450 is in close contact with and coupled with the rear end of the rail 440.

Further, the idle pulley 510 is pressed by the tensile force of the belt 520 in the direction to be closer to the rail 440, and this force is transmitted to the front holder 460 through the pulley supporting surface 462 of the front holder 460, and as a result, the front holder 460 is in close contact with and coupled with the front end of the rail 440.

Meanwhile, the front holder 460 may further include an elastic member 470 configured to maintain the tensile force of the belt 520. This is because, if the belt 520 is expanded by heat in the washing tub 30, the belt 520 hangs loosely, and the tensile force of the belt 520 is reduced, and thus the vane 400 may not be smoothly driven due to the reduction in the tensile force.

One end of the elastic member 470 may be supported by the front holder 460, and the other end thereof may be supported by the pulley bracket 467. To this end, elastic member supporting surfaces 464 and 469 may be formed at the front holder 460 and the pulley bracket 467.

The elastic member 470 may be a compression spring. Since the front holder 460 is supported to the rail 440 by the rail supporting surface 463, an elastic force of the elastic member 470 may be applied to the pulley bracket 467. That is, the pulley bracket 467 may be pressed by the elastic force of the elastic member 470 in a direction to become more distant from the rail 440.

At this time, since the pulley bracket 467 is pressed by the tensile force of the belt 520 in a direction to become closer to the rail 440, the pulley bracket 467 is moved to a position in which the tensile force of the belt 520 and the elastic force of the elastic member 470 achieve a balance.

That is, when the belt 520 hangs loosely, and the elastic force of the elastic member 470 is larger than the tensile force of the belt 520, the pulley bracket 467 is moved by the elastic force of the elastic member 470 in a direction to become more distant from the rail 440. If the pulley bracket 467 is moved in the direction to become more distant from the rail 440, the belt 520 tightens tensely again, and then the tensile force of the belt 520 is restored.

By this configuration, even when the belt 520 hangs loosely due to thermal expansion, the pulley bracket 467 is moved to tighten the belt 520, and thus the tensile force of the belt 520 may be constantly maintained, and the reliability of the driving device 420 is enhanced.

An assembling order of the rail assembly 430 of the dish washing machine according to one embodiment of the present disclosure will be described.

As illustrated in FIG. 22, the belt holder 480 is coupled to the belt 520.

As illustrated in FIG. 23, an assembly of the belt 520 and the belt holder 480 is disposed in the inner space 441 of the rail 440. Then, the vane holder 490 is coupled to the assembly of the belt 520 and the belt holder 480 through the coupling member 496.

As illustrated in FIG. 24, the rear holder 450 is assembled to the longitudinal rear end of the rail 440. Then, the driving pulley 500 is coupled to the belt 520.

As illustrated in FIG. 26, the front top holder 461 is coupled to the longitudinal front end of the rail 440. Next, the belt 520, the idle pulley 510, the pulley bracket 467, and the elastic member 470 are coupled. Then, the assembly of the belt 520, the idle pulley 510, the pulley bracket 467, and the elastic member 470 is pushed in the front top holder 461. Then, the front bottom holder 465 is coupled to the front top holder 461.

Figure 28:
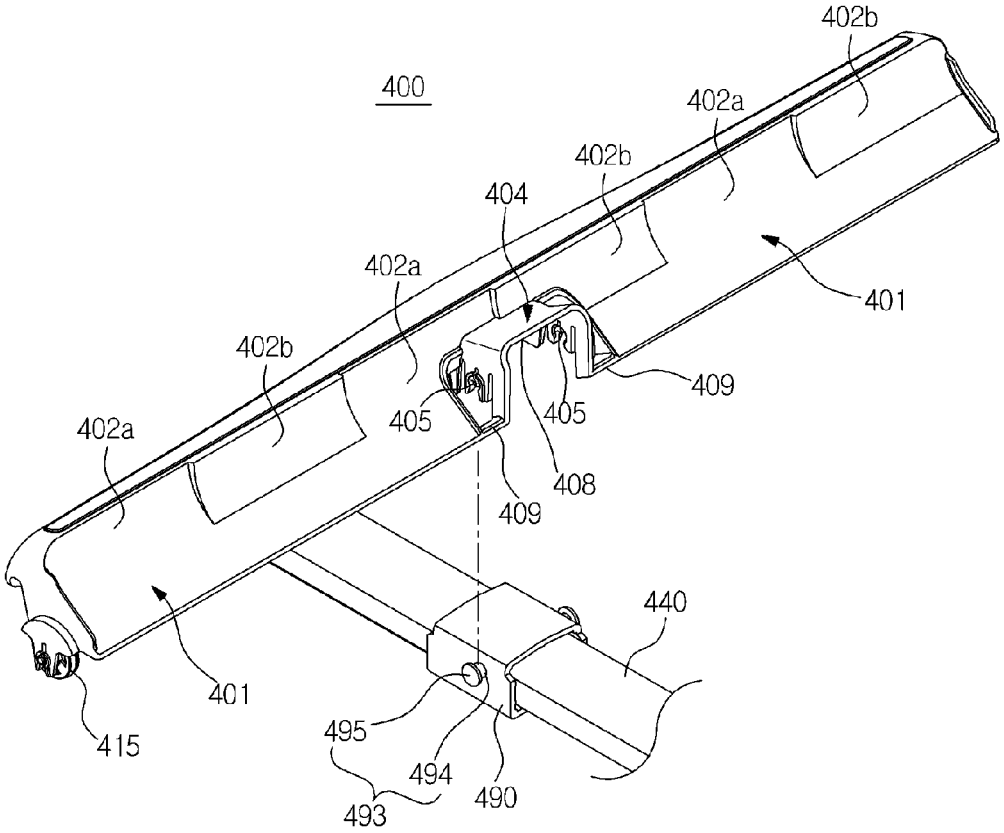
FIG. 28 is a view illustrating the vane and the vane holder of the dish washing machine of FIG. 1.
Figure 29:
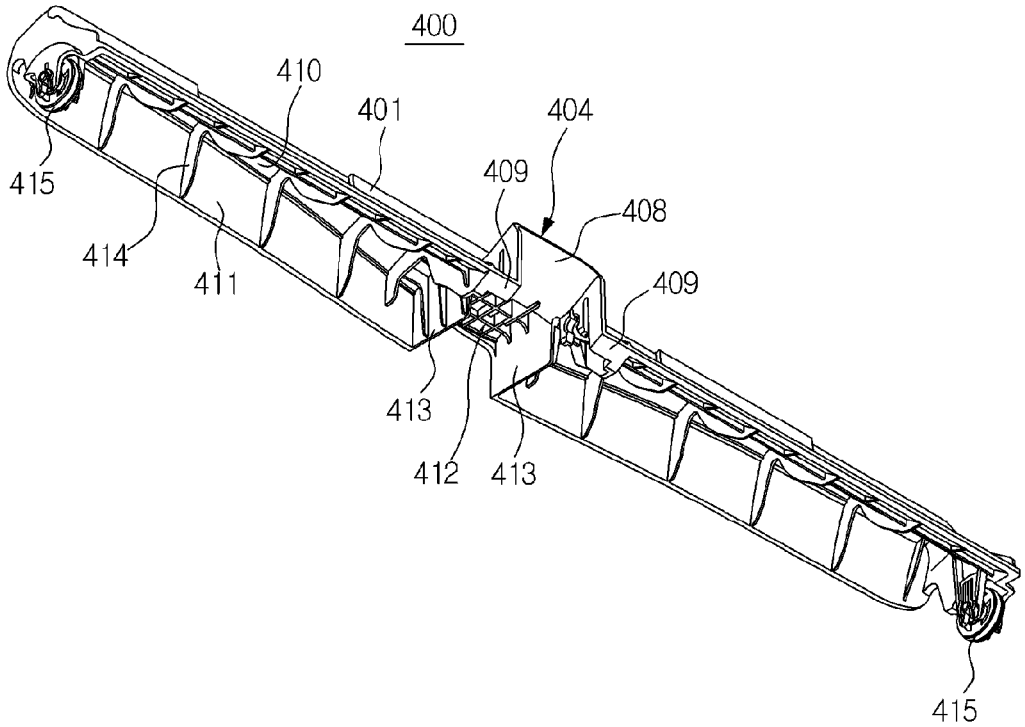
FIG. 29 is a perspective view illustrating the vane of the dish washing machine of FIG. 1.
Figure 30:
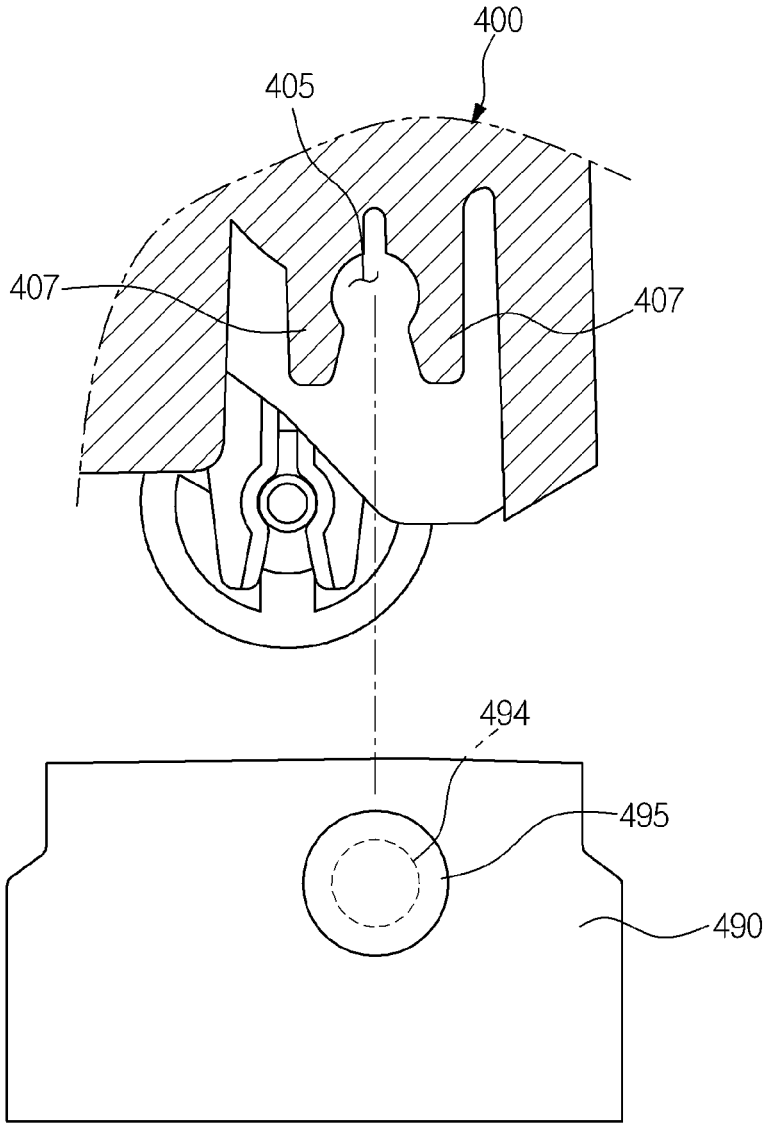
FIG. 30 is an enlarged view illustrating portions of the vane and the vane holder of the dish washing machine of FIG. 1.

FIG. 28 is a view illustrating the vane and the vane holder of the dish washing machine of FIG. 1. FIG. 29 is a perspective view illustrating the vane of the dish washing machine of FIG. 1. FIG. 30 is an enlarged view illustrating portions of the vane and the vane holder of the dish washing machine of FIG. 1.

With reference to FIGS. 28 to 30, the vane according to one embodiment of the present disclosure will be described.

The vane 400 may be provided to extend long in a direction vertical to the rail 440.

The vane 400 may include a reflecting portion 401 configured to reflect the washing water jetted from the fixed nozzle assembly 320, an upper supporting portion 410 bent from the reflecting portion 401, a rear supporting portion 411 bent from the upper supporting portion 410, a cap portion 404 provided at a longitudinal center of the reflecting portion 401, a rotational blocking portion 409 provided to be interfered with the rotational guide 610 (FIG. 31) of the bottom plate cover 600, a reinforcing rib 414 provide to reinforce strength of the reflecting portion 401, the upper supporting portion 410, and the rear supporting portion 411, a horizontal supporting portion 412 supported on an upper surface of the vane holder 490, and a vertical supporting portion 413 supported to a side surface of the vane holder 490.

The reflecting portion 401 includes reflecting surfaces 402*a* and 402*b* provided to be inclined and configured to reflect the washing water. The reflecting surfaces 402*a* and 402*b* may include a reflecting surface 402*a* and a reflecting surface 402*b* alternately arranged in a lengthwise direction thereof to have different slopes from each other and thus different reflection angles of the washing water.

The cap portion 404 may include a coupling groove 405 provided to be coupled with the vane holder 490, and a rotational stopper portion 408 configured to limit a rotational range of the vane 400 when the vane 400 is rotated by the rotational guide 610 of the bottom plate cover 600.

The coupling protrusion 493 of the vane holder 490 may be coupled into the coupling groove 405 of the vane 400. Specifically, the coupling shaft portion 494 of the coupling protrusion 493 may be inserted into the coupling groove 405 of the vane 400. The coupling shaft portion 494 may rotatably support the vane 400.

As illustrated in FIG. 30, the coupling groove 405 of the vane 400 may be defined by elastic hooks 407. The elastic hooks 407 may be elastically deformed in a direction to be slight opened during a process in which the coupling shaft portion 494 of the vane holder 490 is pushed in or taken out from the coupling groove 405 of the vane 400, and then restored to their original shapes when the process is finished. By this configuration, the vane 400 may be installed at or separated from the vane holder 490.

Rollers 415 configured to allow the vane 400 to be smoothly moved may be provided at the both longitudinal ends of the vane 400. Roller supporting portions 39 (FIG. 47) configured to support the rollers 415 may be provided at the bottom plate 35 of the washing tub 30.

Figure 31:
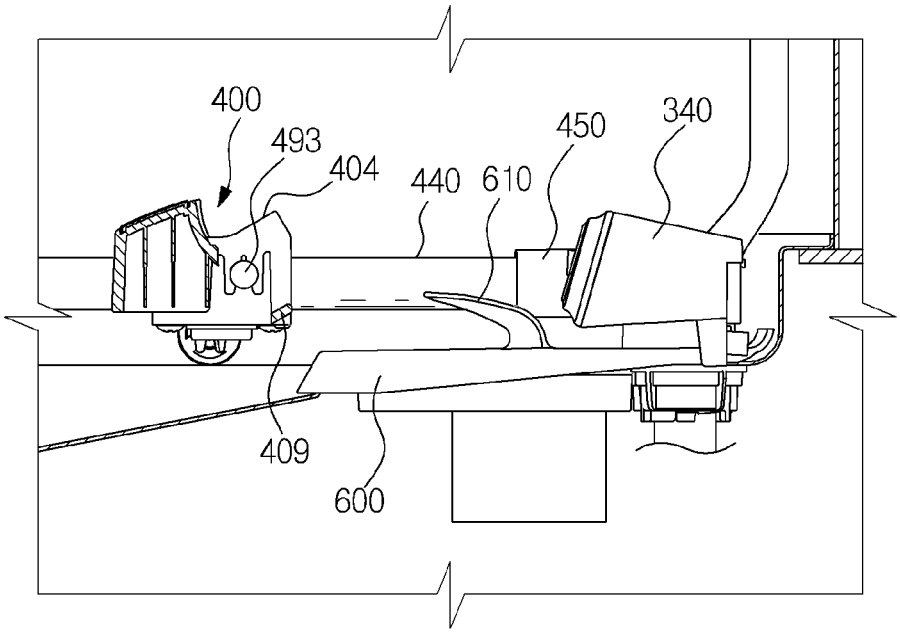
FIGS. 31 to 33 are views illustrating a rotating motion of the vane of the dish washing machine of FIG. 1.
Figure 32:
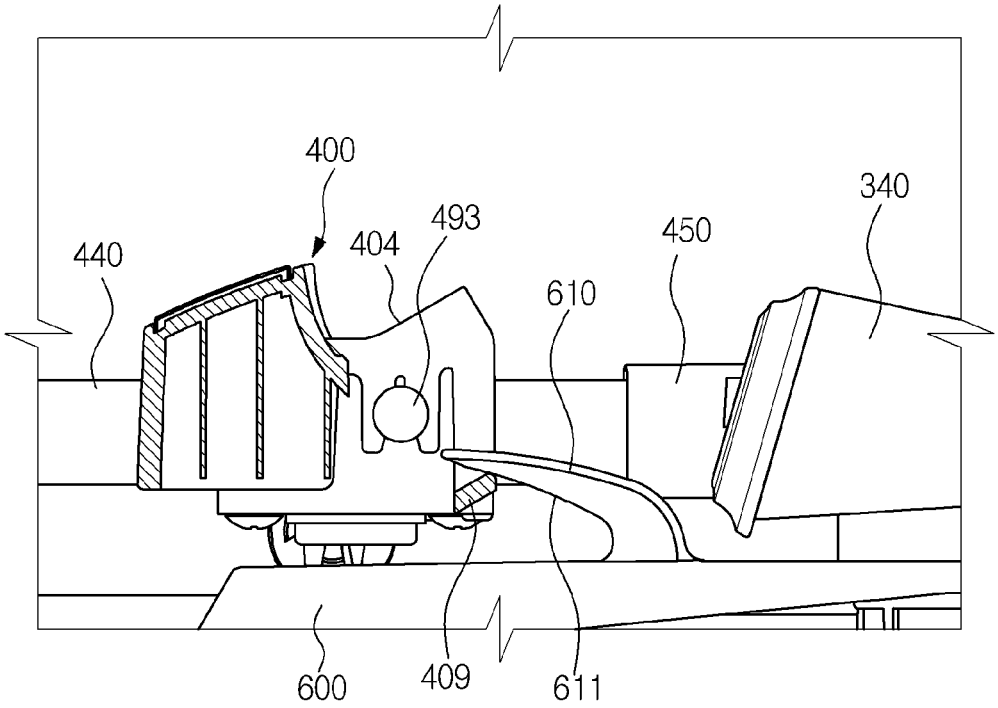
Figure 33:
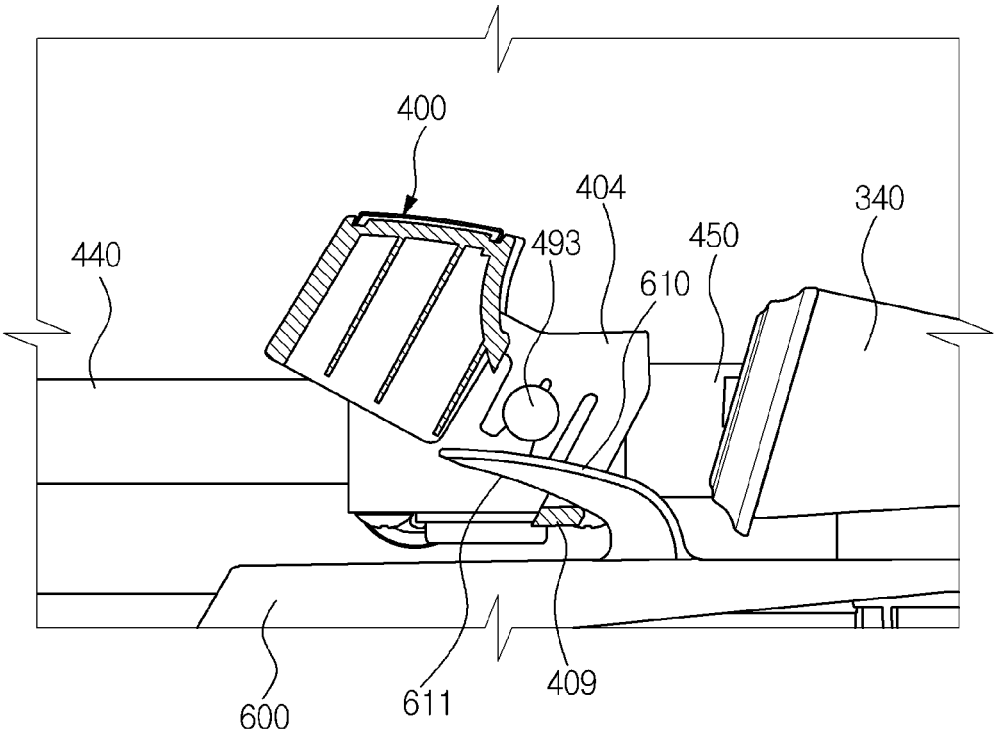
Figure 34:
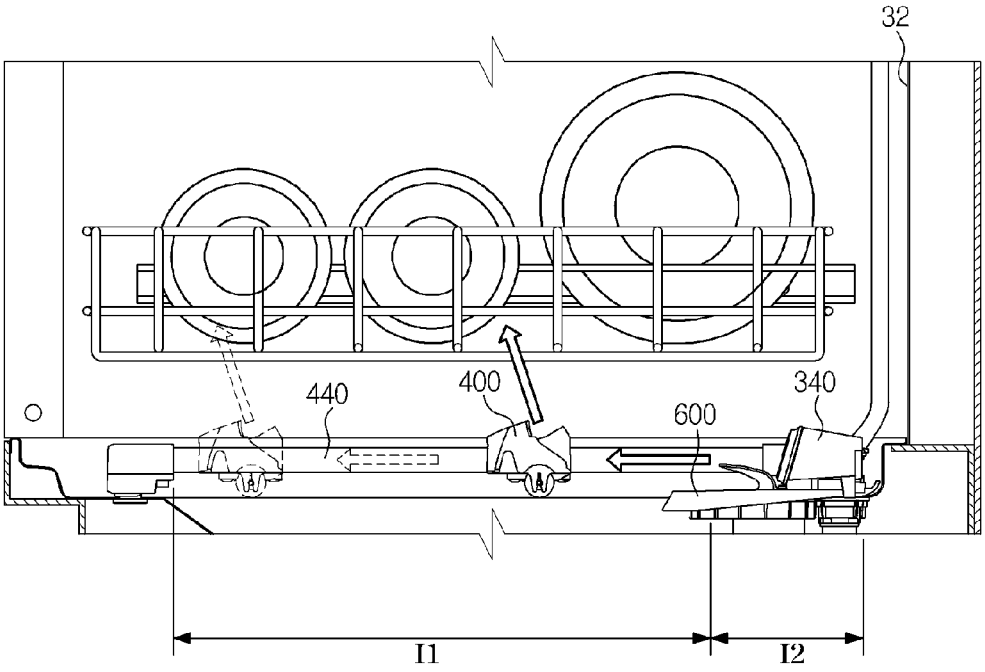
FIG. 34 is a view illustrating a motion in which the washing water is reflected by the vane in a vane moving section of the dish washing machine of FIG. 1.
Figure 35:
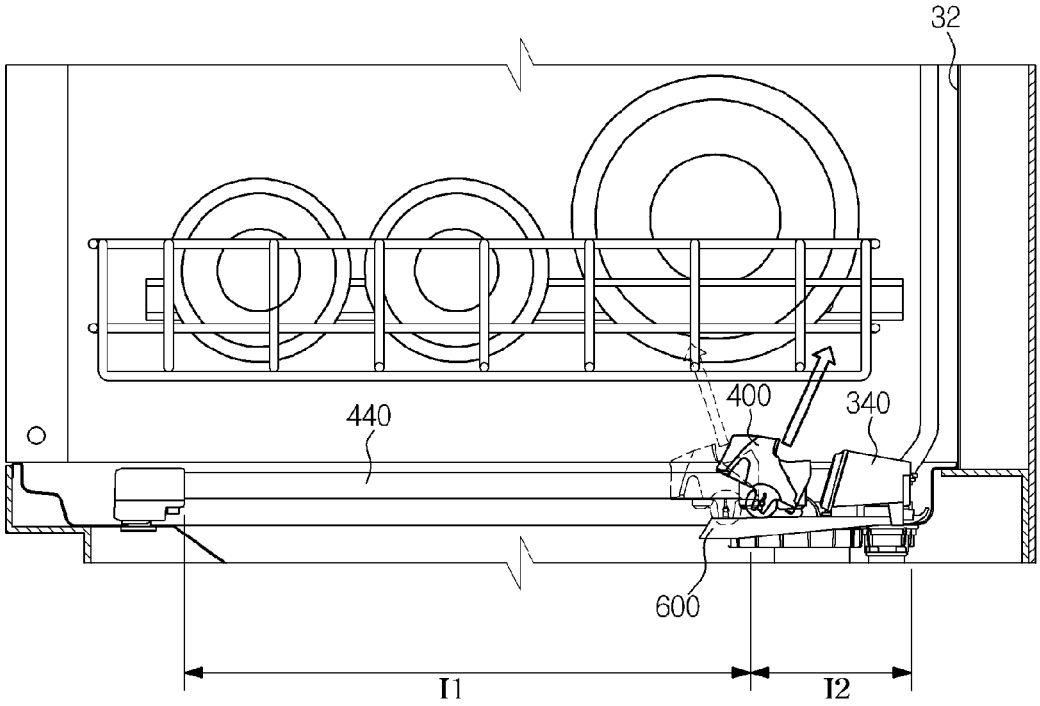
FIG. 35 is a view illustrating a motion in which the washing water is reflected by the vane in a vane non-moving section of the dish washing machine of FIG. 1.

FIGS. 31 to 33 are views illustrating a rotating motion of the vane of the dish washing machine of FIG. 1. FIG. 34 is a view illustrating a motion in which the washing water is reflected by the vane in a vane moving section of the dish washing machine of FIG. 1. FIG. 35 is a view illustrating a motion in which the washing water is reflected by the vane in a vane non-moving section of the dish washing machine of FIG. 1.

With reference to FIGS. 31 to 35, a moving section, a non-moving section, and a rotating motion of the vane according to one embodiment of the present disclosure will be described.

In the dish washing machine 1 according to one embodiment of the present disclosure, the washing water jetted from the fixed jet nozzles 320 is reflected to the dishes by the vane 400. Since the fixed jet nozzles 320 jet the washing water in an approximately horizontal direction, the fixed jet nozzles 320 and the vane 400 are approximately horizontally located with respect to each other. Therefore, the vane 400 may not be moved in an area in which the fixed jet nozzles 320 are arranged.

That is, the dish washing machine 1 has a vane moving section I1 in which the vane 400 may be moved, and a vane non-moving section I2 in which the vane 400 may not be moved.

The vane 400 of the dish washing machine 1 according to one embodiment of the present disclosure may be rotatably provided to wash the dishes received in the vane non-moving section I2.

As described above, the rotational guide 610 configured to protrude to guide movement of the vane 400 is formed at the bottom plate cover 600, and the rotational blocking portion 409 is formed at the vane 400 to be interfered with the rotational guide 610. The rotational blocking portion 409 forms a rotational shaft of the vane 400, and at the same time, is formed at an upper side than the coupling protrusion 493 of the vane holder 490 which transmits the driving force to the vane 400.

The rotational guide 610 includes a guide surface 611 which is formed in a curved surface, such that the rotational blocking portion 409 is in contact therewith and the vane 400 is allowed to be smoothly rotated.

If the rotational blocking portion 409 of the vane 400 is interfered with the guide surface 611 of the rotational guide 610 of the bottom plate cover 600 when the vane 400 reaches the vane non-moving section I2 from the vane moving section I1, the vane 400 is rotated around the coupling protrusion 493 of the vane holder 490. Therefore, the washing water may be reflected to the dishes in the vane non-moving section I2.

Figure 36:
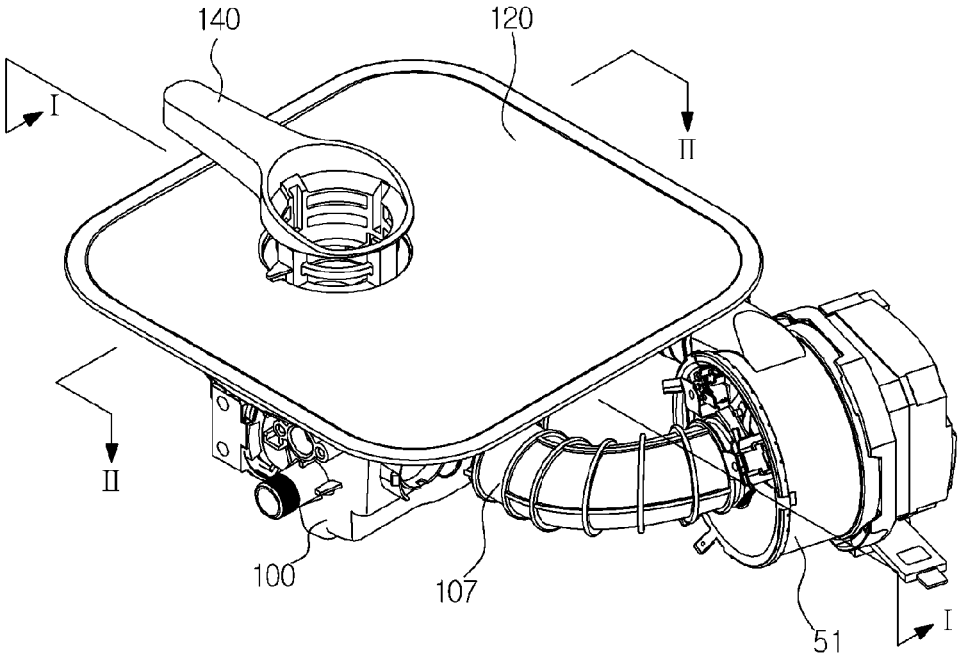
FIG. 36 is a view illustrating a sump, a coarse filter and a fine filter of the dish washing machine of FIG. 1.
Figure 37:
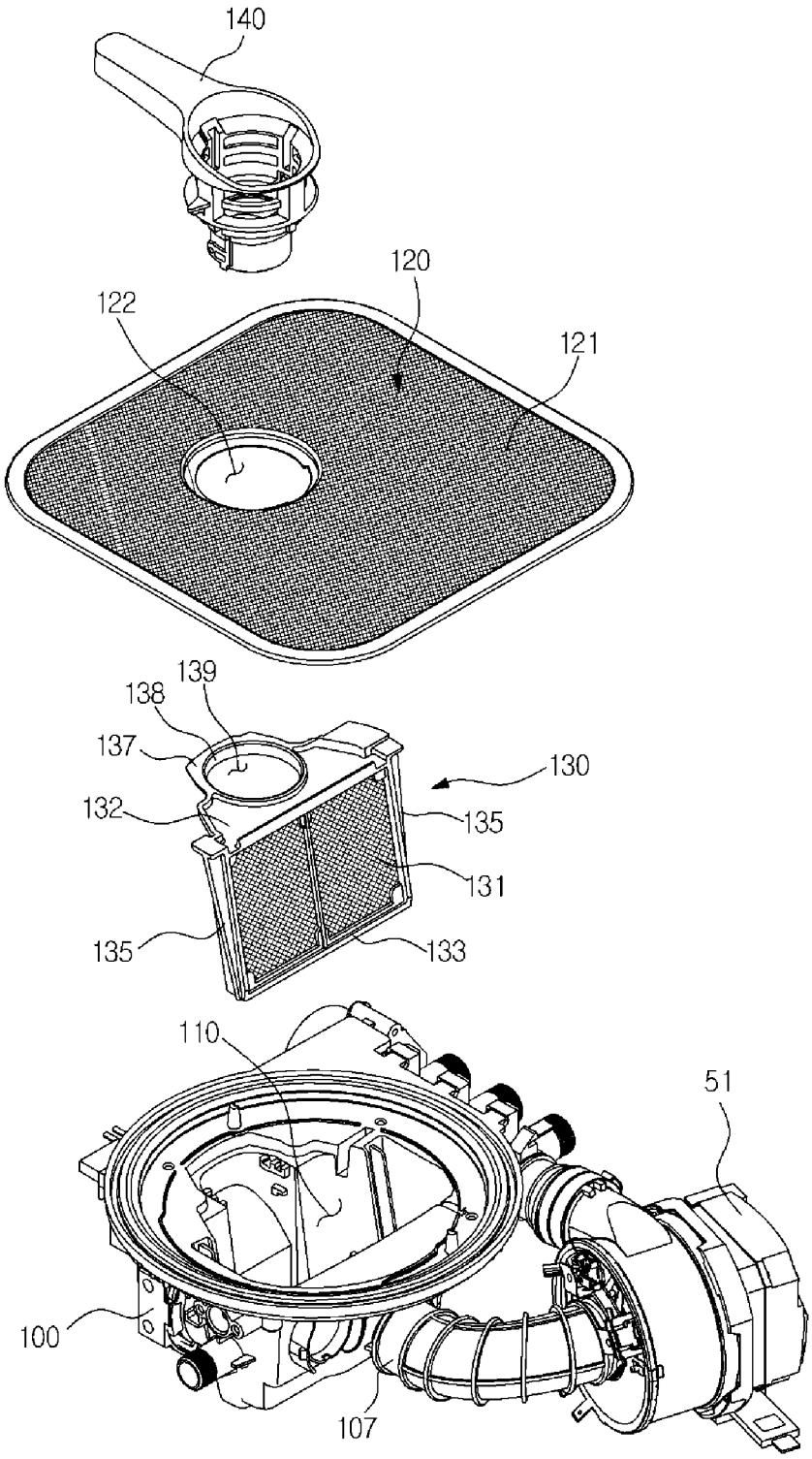
FIG. 37 is a view illustrating a state in which the sump, the coarse filter, the fine filter and a micro-filter of the dish washing machine of FIG. 1 are disassembled.
Figure 38:
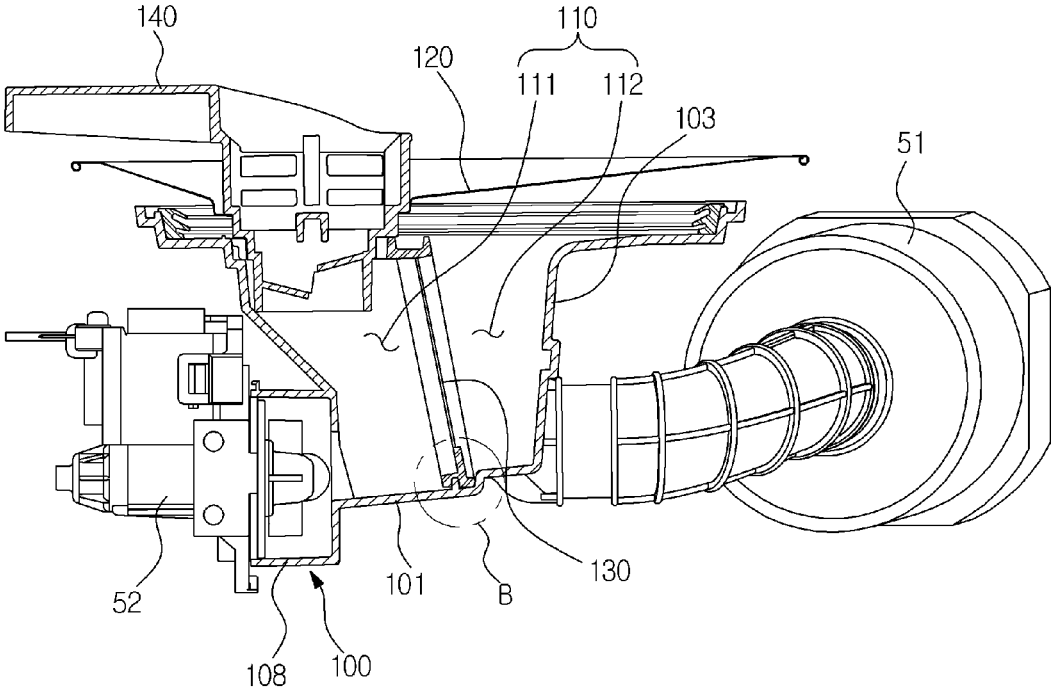
FIG. 38 is a cross-sectional view taken along line I-I of FIG. 36.
Figure 39:
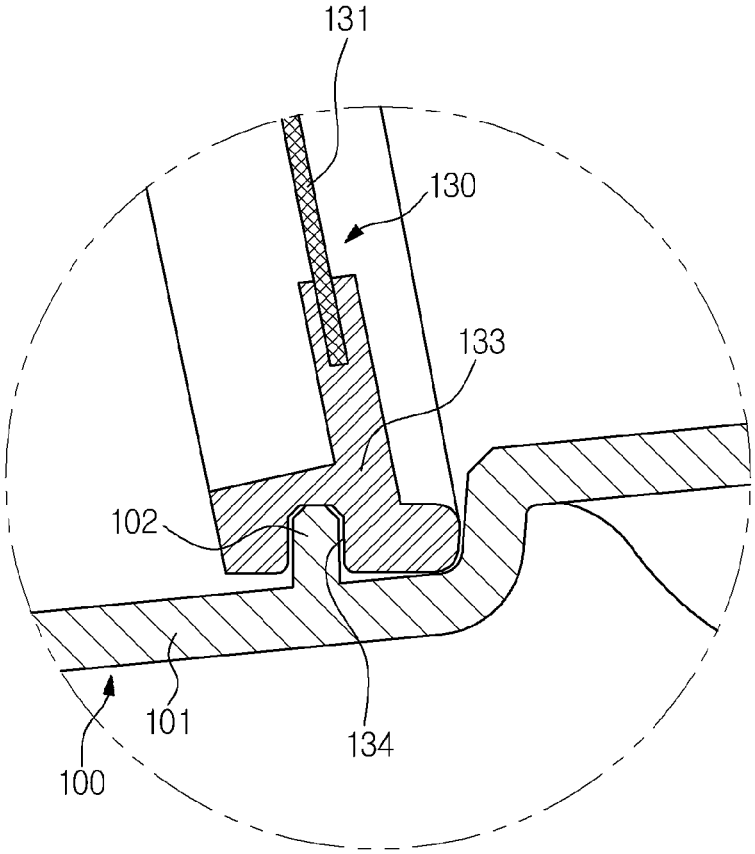
FIG. 39 is an enlarged view of a B portion of FIG. 38.
Figure 40:
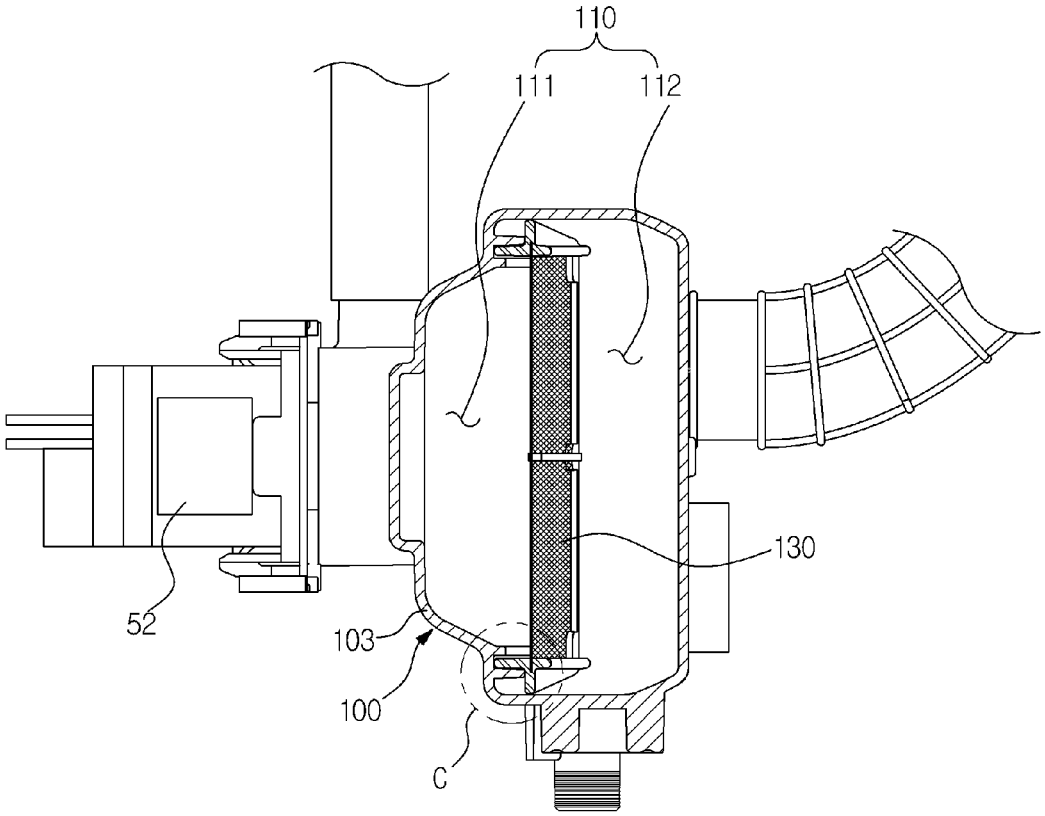
FIG. 40 is a cross-sectional view taken along line II-II of FIG. 38.
Figure 41:
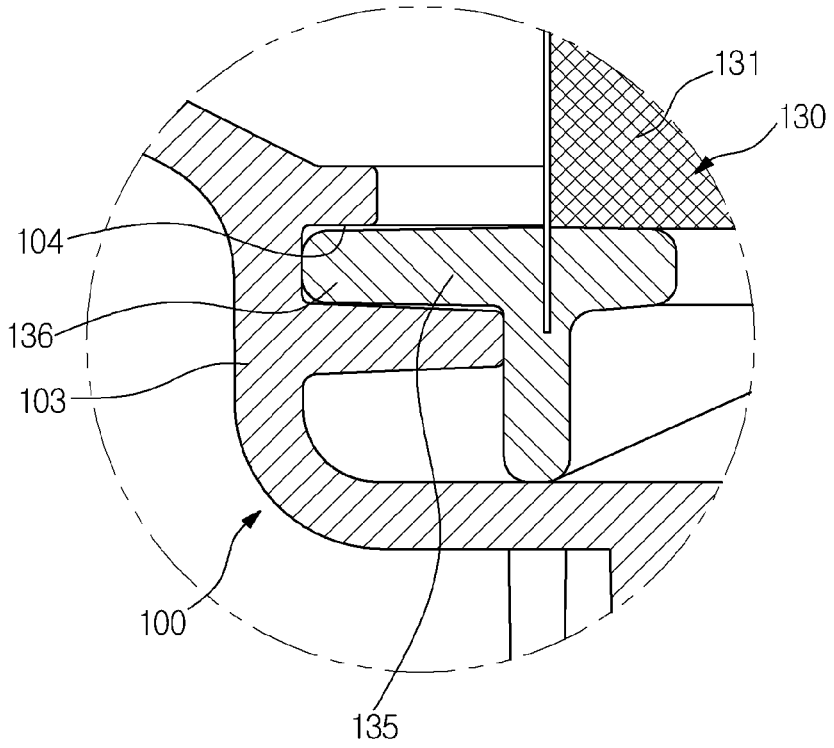
FIG. 41 is an enlarged view of a C portion of FIG. 40.
Figure 42:
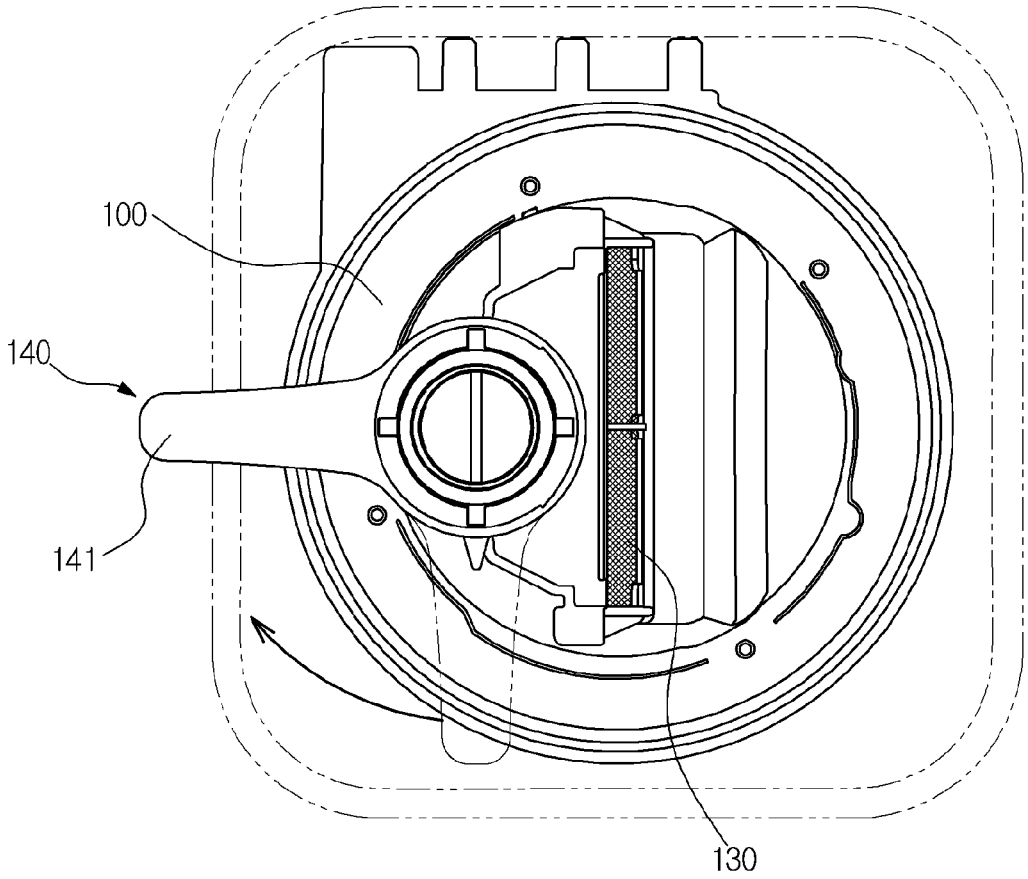
FIG. 42 is a plan view illustrating the sump and the coarse filter of the dish washing machine of FIG. 1, wherein a locking motion of the coarse filter is illustrated.
Figure 43:
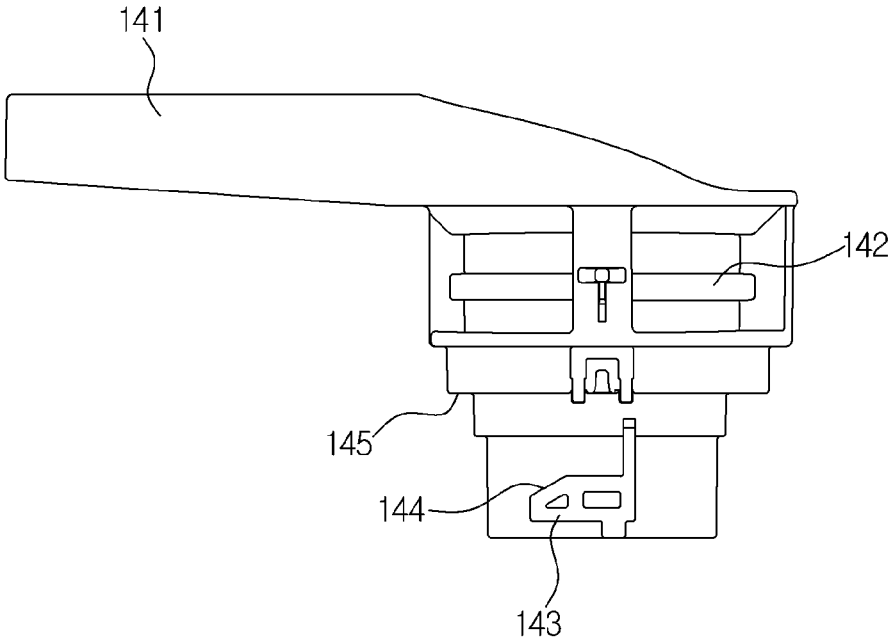
FIG. 43 is a side view illustrating the coarse filter of the dish washing machine of FIG. 1.
Figure 44:
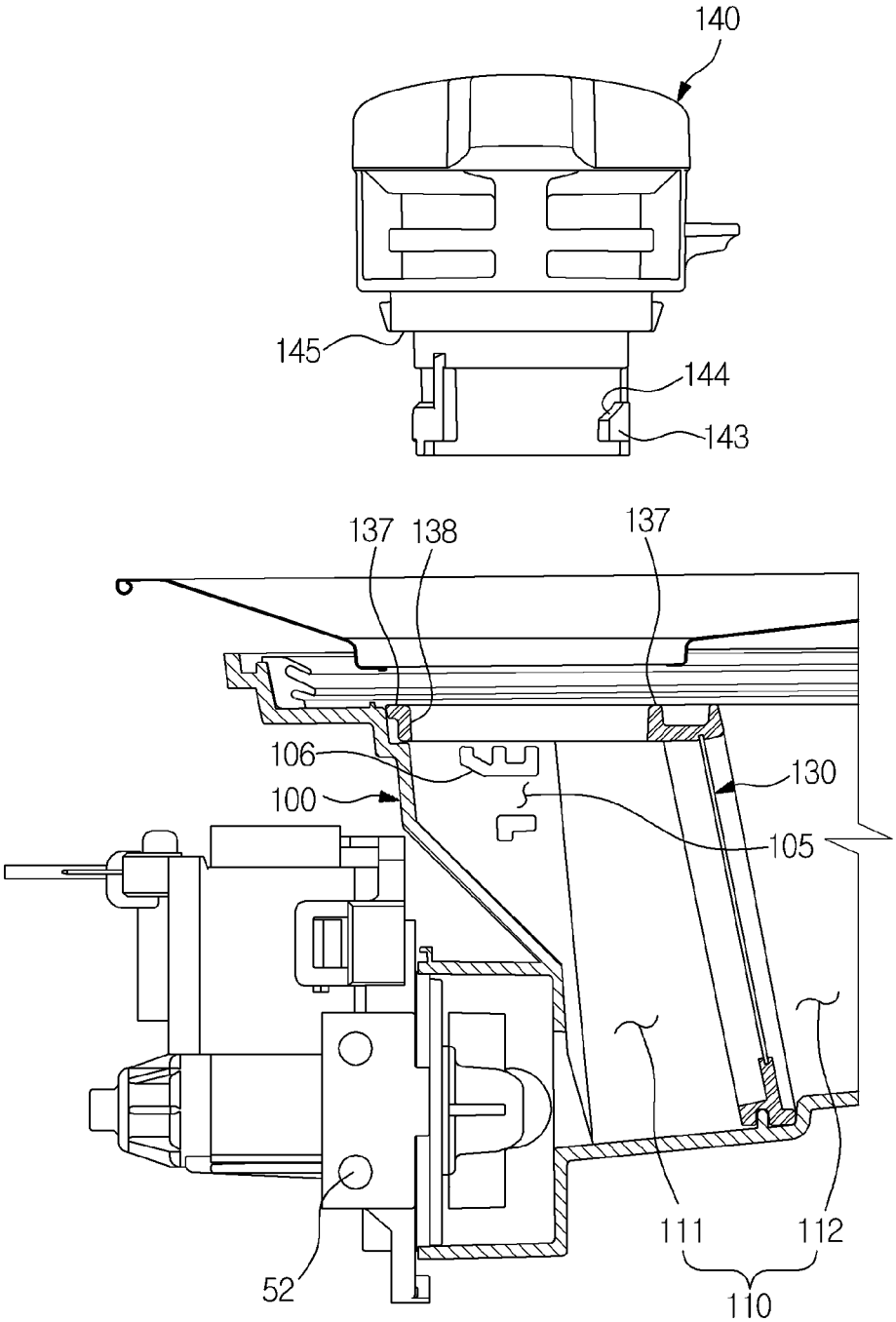
FIG. 44 is a view illustrating the sump and the coarse filter of the dish washing machine of FIG. 1, wherein the locking motion of the coarse filter is illustrated.
Figure 45:
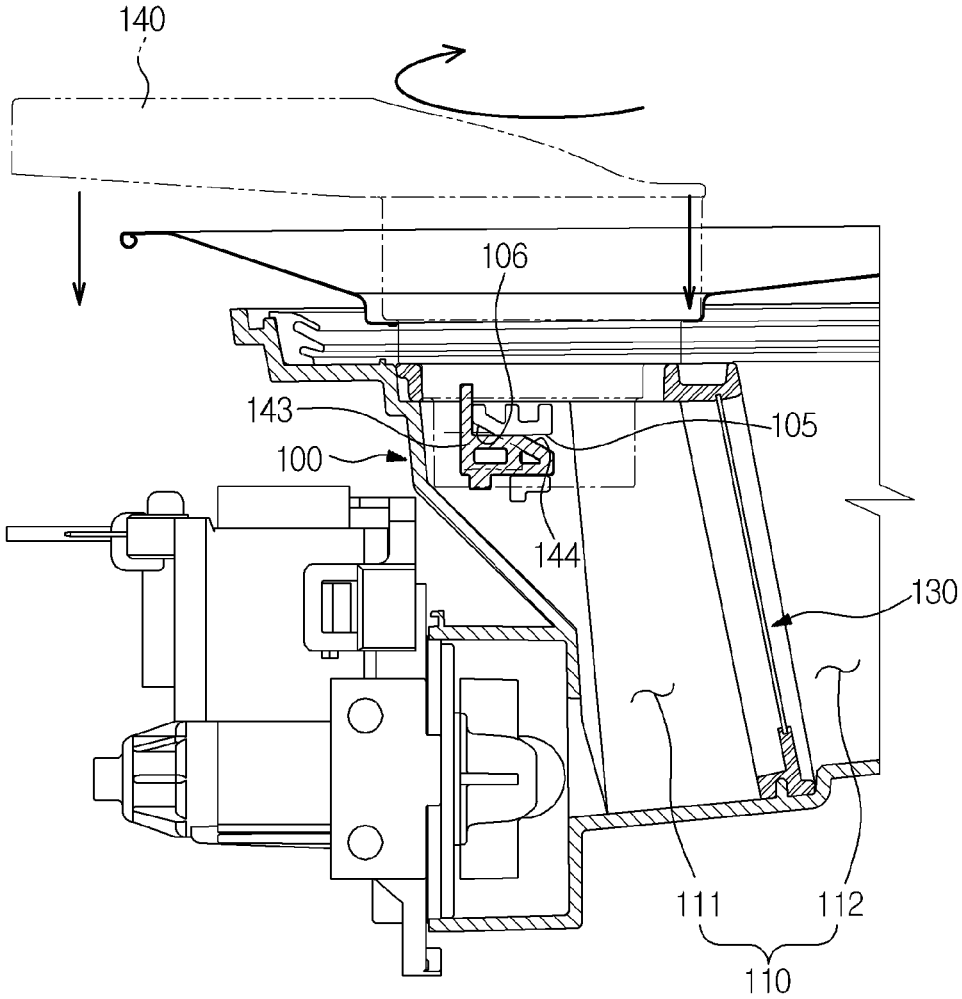
FIG. 45 is a cross-sectional view illustrating the sump, the coarse filter and the micro-filter of the dish washing machine of FIG. 1.
Figure 46:
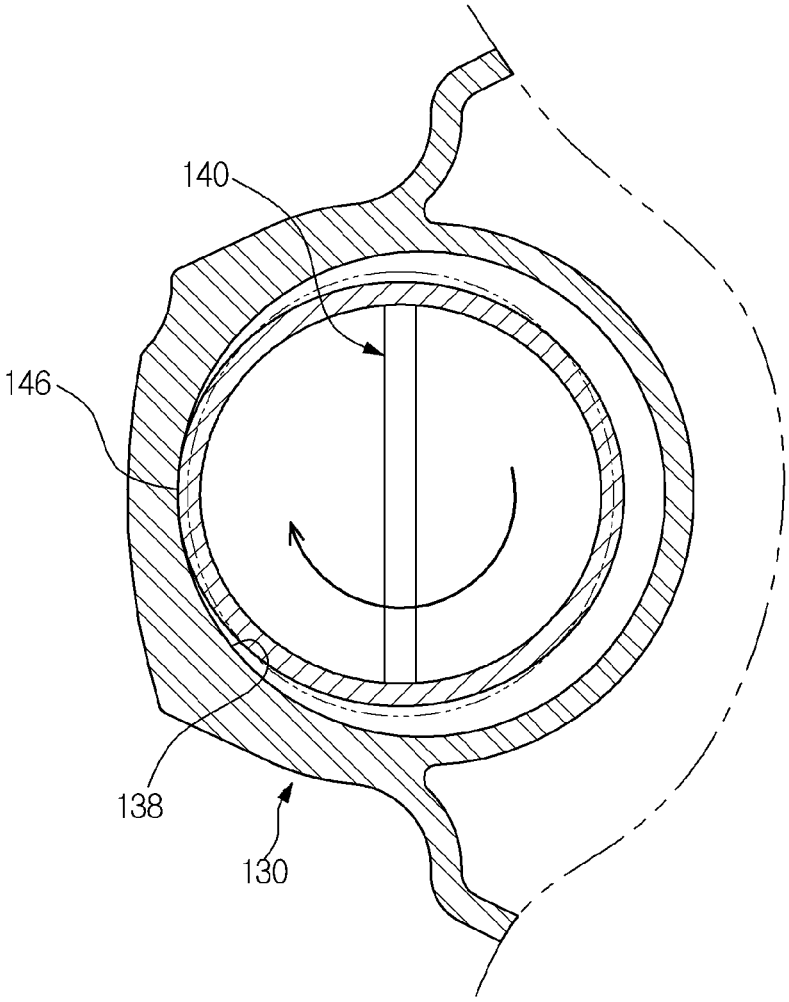
FIG. 46 is an enlarged plan view of portions of the coarse filter and the micro-filter of the dish washing machine of FIG. 1.
Figure 47:
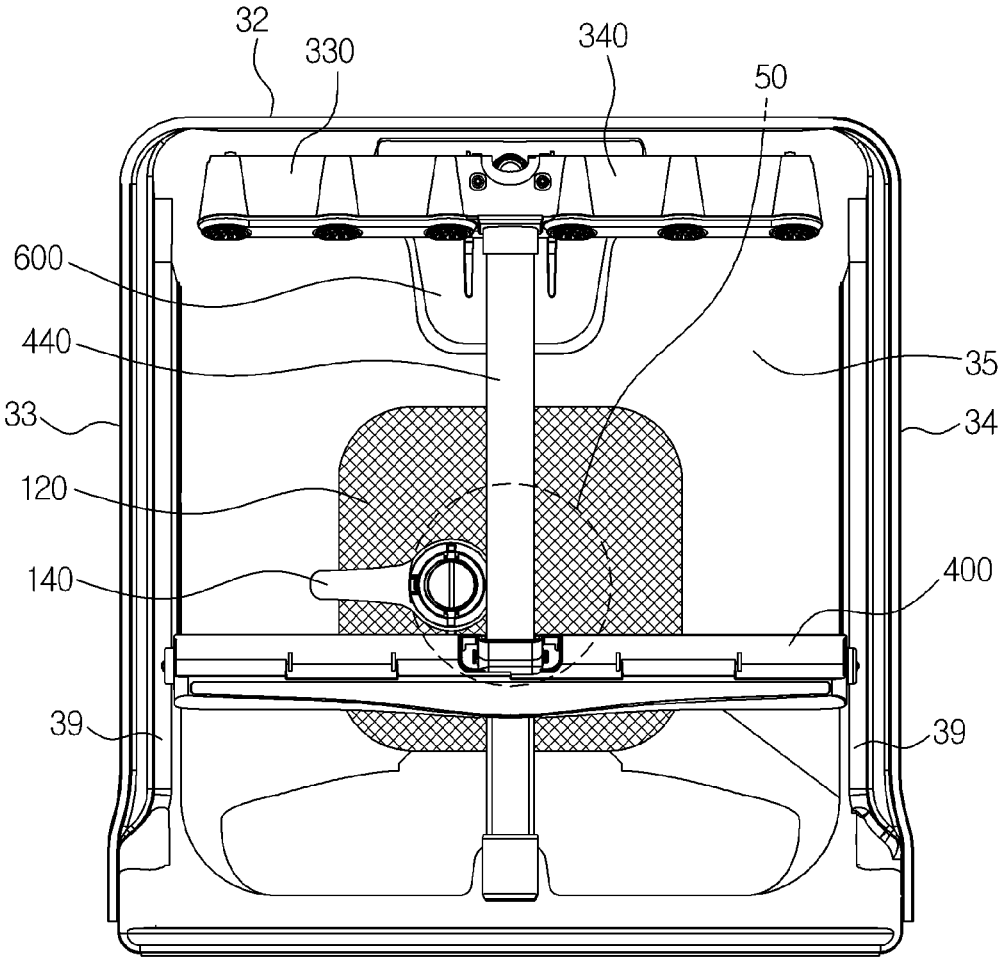
FIG. 47 is a plan view illustrating a lower portion of the washing tub of the dish washing machine of FIG. 1.

FIG. 36 is a view illustrating the sump, a coarse filter and a fine filter of the dish washing machine of FIG. 1. FIG. 37 is a view illustrating a state in which the sump, the coarse filter, the fine filter and a micro-filter of the dish washing machine of FIG. 1 are disassembled. FIG. 38 is a cross-sectional view taken along line I-I of FIG. 36. FIG. 39 is an enlarged view of a B portion of FIG. 38. FIG. 40 is a cross-sectional view taken along line II-II of FIG. 38. FIG. 41 is an enlarged view of a C portion of FIG. 40. FIG. 42 is a plan view illustrating the sump and the coarse filter of the dish washing machine of FIG. 1, wherein a locking motion of the coarse filter is illustrated. FIG. 43 is a side view illustrating the coarse filter of the dish washing machine of FIG. 1. FIG. 44 is a view illustrating the sump and the coarse filter of the dish washing machine of FIG. 1, wherein the locking motion of the coarse filter is illustrated. FIG. 45 is a cross-sectional view illustrating the sump, the coarse filter and the micro-filter of the dish washing machine of FIG. 1. FIG. 46 is an enlarged plan view of portions of the coarse filter and the micro-filter of the dish washing machine of FIG. 1. FIG. 47 is a plan view illustrating a lower portion of the washing tub of the dish washing machine of FIG. 1.

The dish washing machine 1 according to one embodiment of the present disclosure includes the sump 100 configured to store the washing water, the circulation pump 51 configured to circulate the washing water of the sump 100 to the jet nozzles 311, 313 and 320, the drainage pump 52 configured to discharge the washing water of the sump 100 together with the slops to the outside, and filters 120, 130 and 140 configured to filter the slops contained in the washing water.

A drainage hole 50 (FIG. 47) which drains the washing water to the sump 100 is formed at the bottom plate 35 of the washing tub 30. The bottom plate 35 of the washing tub 30 may be inclined toward the drainage hole 50 so that the washing water is guided to the drainage hole 50 by its own weight.

The sump 100 may have an approximately semi-spherical shape of which upper surface is opened. The sump 100 includes a bottom 101, a side wall 103, a water storage chamber 110 formed between the bottom 101 and the side wall 103 to store the washing water, a circulation port 107 to which the circulation pump 51 is connected, and a drainage port 108 to which the drainage pump 52 is connected.

The filters 120, 130 and 140 includes a fine filter 120 installed at the drainage hole 50 of the bottom plate 35, and a micro-filter 130 and a coarse filter 140 which are installed at the sump 100.

The coarse filter 140 may have an approximately cylindrical shape. The coarse filter 140 may be installed at an inner side surface of the side wall 103 of the sump 100.

The coarse filter 140 may have a filter portion 142 configured to filter the slops have relatively great sizes, and a handle 141 provided to install the coarse filter 140. The filter portion 142 of the coarse filter 140 may be formed at a circumferential surface of the coarse filter 140.

The coarse filter 140 passes through a micro-filter passing hole 139 and a fine filter passing hole 122 and is installed at the sump 100. An upper portion of the coarse filter 140 protrudes into the washing tub 30, and a lower portion thereof protrudes into a slop collecting chamber 111 of the sump 100. The slop collecting chamber 111 will be described later.

The fine filter 120 may have a filter portion 121 configured to filter the slops having relatively middle sizes or more, and the passing hole 122 through which the coarse filter 140 passes. The fine filter 120 may be approximately horizontally disposed on the drainage hole 50 of the bottom plate 35 of the washing tub 30. The fine filter 120 may be inclined so that the washing water is guided toward the passing hole 122 by its own weight.

The washing water of the washing tub 30 may flow to the coarse filter 140 along a slope of the fine filter 120. However, parts of the washing water and the slops may pass through the filter portion 121 of the fine filter 120 and may flow to the water storage chamber 110 of the sump 100.

The micro-filter 130 may have a filter portion 131 configured to filter the slops having relatively small sizes or more and having a flat shape, and frames 132, 133 and 135 configured to support the filter portion 131, and the passing hole 139 through which the coarse filter 140 passes.

The frames 132, 133 and 135 include an upper frame 132, a lower frame 133, and side frames 135. The micro-filter 130 is installed at the sump 100 so that the lower frame 133 is in close contact with the bottom 101 of the sump 100 and the side frames 135 are in close contact with the side wall 103 of the sump 100.

The micro-filter 130 may partition the water storage chamber 110 into the slop collecting chamber 111 and a circulation chamber 112. The drainage pump 52 is connected to the slop collecting chamber 111, and the circulation pump 51 is connected to the circulation chamber 112.

As described above, since the lower portion of the coarse filter 140 is provided to protrude into the slop collecting chamber 111, the washing water passing through the coarse filter 140 and the slops contained in the washing water are introduced into the slop collecting chamber 111.

The washing water introduced into the slop collecting chamber 111 may pass through the micro-filter 130 and then flow to the circulation chamber 112. However, since the slops contained in the washing water introduced into the slop collecting chamber 111 do not pass through the micro-filter 130, do not flow to the circulation chamber 112, and thus are remained in the slop collecting chamber 111.

When the drainage pump 52 is driven, the slops collected in the slop collecting chamber 111 may be discharged to outside together with the washing water.

Meanwhile, to prevent the slops in the slop collecting chamber 111 from flowing to the circulation chamber 112 through a gap between the micro-filter 130 and the sump 100, the micro-filter 130 should be in close contact with the bottom 101 and the side wall 103 of the sump 100.

To this end, a lower sealing groove 134 may be formed at the lower frame 133 of the micro-filter 130, and a side sealing protrusion 136 may be formed at the side frame 135. In response, a lower sealing protrusion 102 inserted into the lower sealing groove 134 may be formed at the bottom 101 of the sump 100, and a side sealing groove 104 in which the side sealing protrusion 136 may be inserted is formed at the side wall 103 of the sump 100.

The sealing of the micro-filter 130 and the sump 100 may be reinforced by the above-mentioned lower and side protrusions and grooves.

Meanwhile, the coarse filter 140 may be inserted vertically downward into the sump 100, rotated from an unlocking position to a locking position, and then installed at the sump 100.

To this end, an installation protrusion 143 may be formed at an outer circumferential surface of the coarse filter 140, and an installation groove 105 in which the installation protrusion 143 is inserted horizontally when the coarse filter 140 is rotated from the unlocking position to the locking position may be formed at an inner side surface of the side wall 103 of the sump 100.

The installation protrusion 143 may have an upward inclined surface 144 which is inclined upward according to a rotational direction from the unlocking position of the coarse filter 140 toward the locking position thereof. The installation groove 105 may have a downward inclined surface 106 which is inclined downward according to a rotational direction from the unlocking position of the coarse filter 140 toward the locking position thereof.

Due to this structure, when the coarse filter 140 is rotated from the unlocking position to the locking position, the upward inclined surface 144 of the installation protrusion 143 may be slid along the downward inclined surface 106 of the installation groove 105 and thus the coarse filter 140 may be moved downward.

When the coarse filter 140 is rotated from the unlocking position to the locking position, the coarse filter 140 may press downward the micro-filter 130 while being moved downward. To this end, the coarse filter 140 may have a downward pressing surface 145 which is horizontally formed to press downward the micro-filter 130. The micro-filter 130 may have a downward corresponding surface 137 which is horizontally formed to be pressed by the downward pressing surface 145.

Like this, since the coarse filter 140 presses downward the micro-filter 130 when being rotated from the unlocking position to the locking position, the sealing of the lower frame 133 of the micro-filter 130 and the bottom 101 of the sump 100 may be further reinforced, and the micro-filter 130 is prevented from coming off.

Further, the coarse filter 140 may have a lateral pressing surface 146 which is formed by that part of the outer circumferential surface of the coarse filter 140 is radially expanded to an outside, such that the micro-filter 130 is laterally pressed when the coarse filter 140 is rotated from the unlocking position to the locking position. That is, the coarse filter 140 may have a convex shape or an elliptic shape.

The micro-filter 130 may have a lateral corresponding surface 138 which is laterally pressed by the lateral pressing surface 146.

Due to this configuration, when the coarse filter 140 is rotated from the unlocking position to the locking position, the micro-filter 130 is pressed laterally, and the sealing of the side frame 135 of the micro-filter 130 and the side wall 103 of the sump 100 may be further reinforced.

Meanwhile, as illustrated in FIG. 47, the coarse filter 140 may be disposed to be one-sided to one of the both side walls 33 and 34 of the washing tub 30. That is, the coarse filter 140 may be disposed to be closer to the left wall 33 than the right wall 34. By such arrangement of the coarse filter 140, when the coarse filter 140 is separated, the coarse filter 140 may be easily separated without interference with the rail 440.

Figure 48:
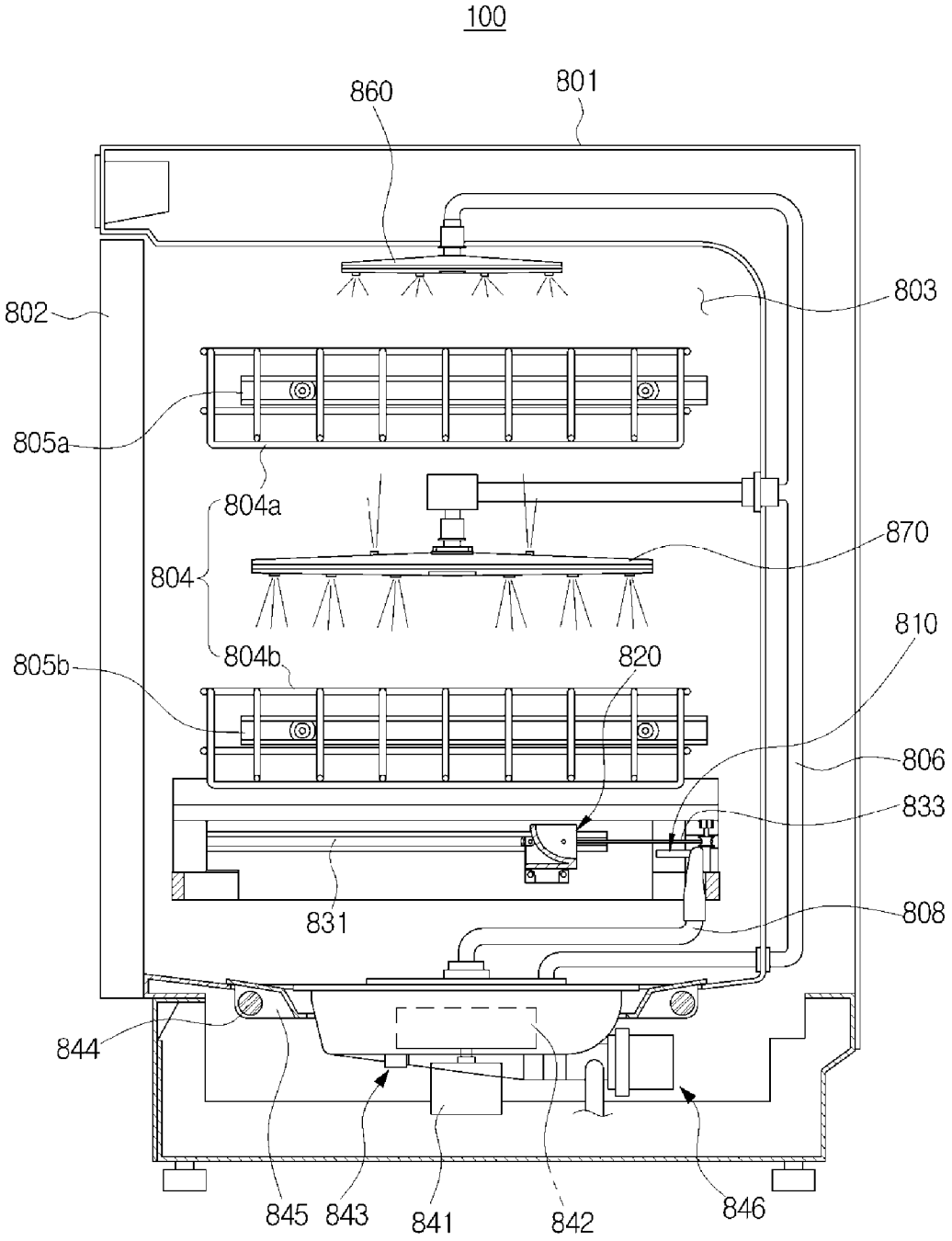
FIG. 48 is a cross-sectional view of a dish washing machine in accordance with a second embodiment of the present disclosure.
Figure 49:
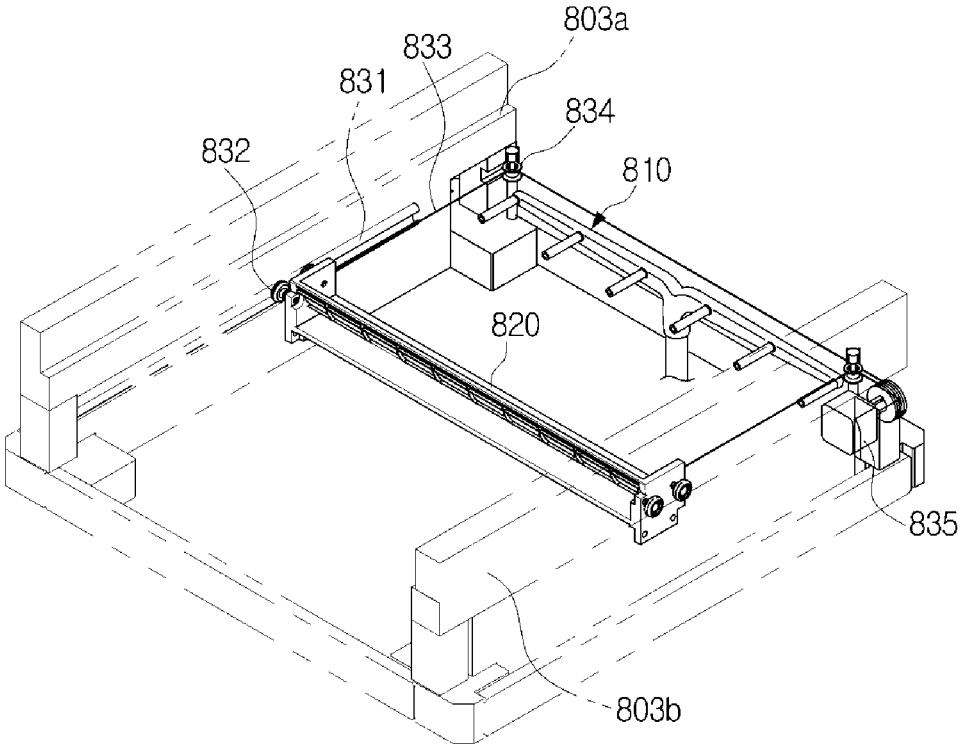
FIG. 49 is a perspective view of a jet unit and a changing unit in accordance with the second embodiment of the present disclosure.
Figure 50:
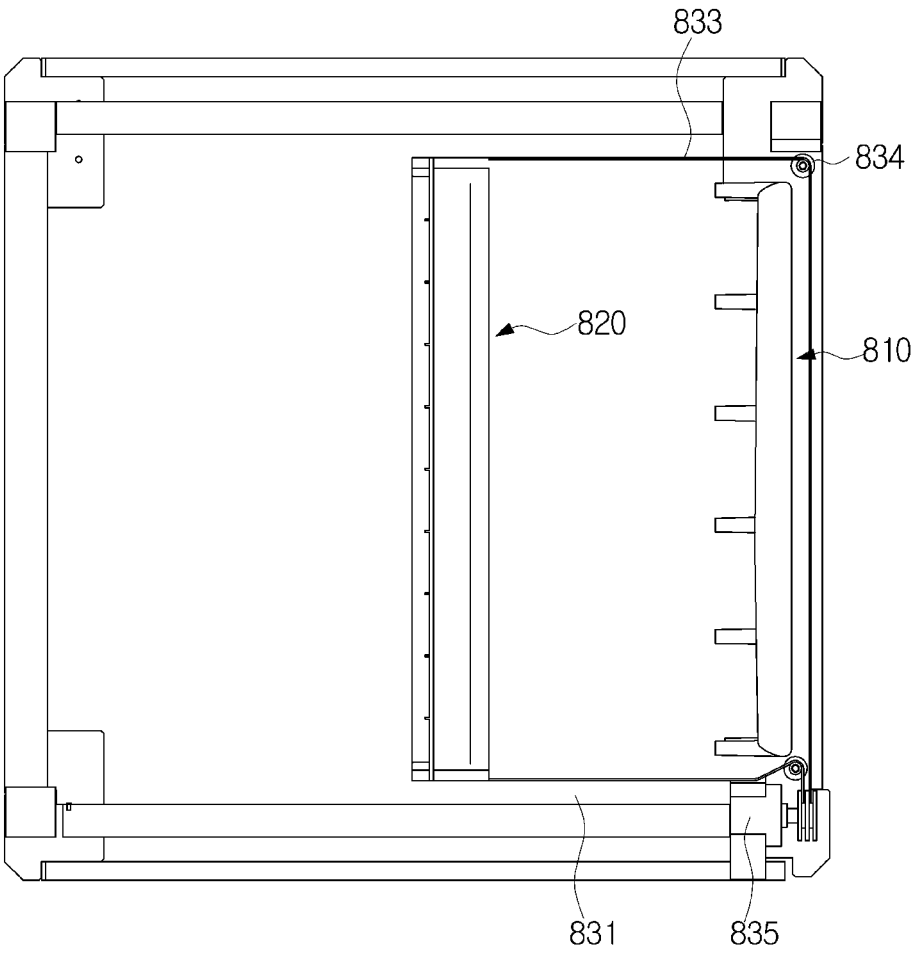
FIG. 50 is a top view of the jet unit and the changing unit in accordance with the second embodiment of the present disclosure.
Figure 51:
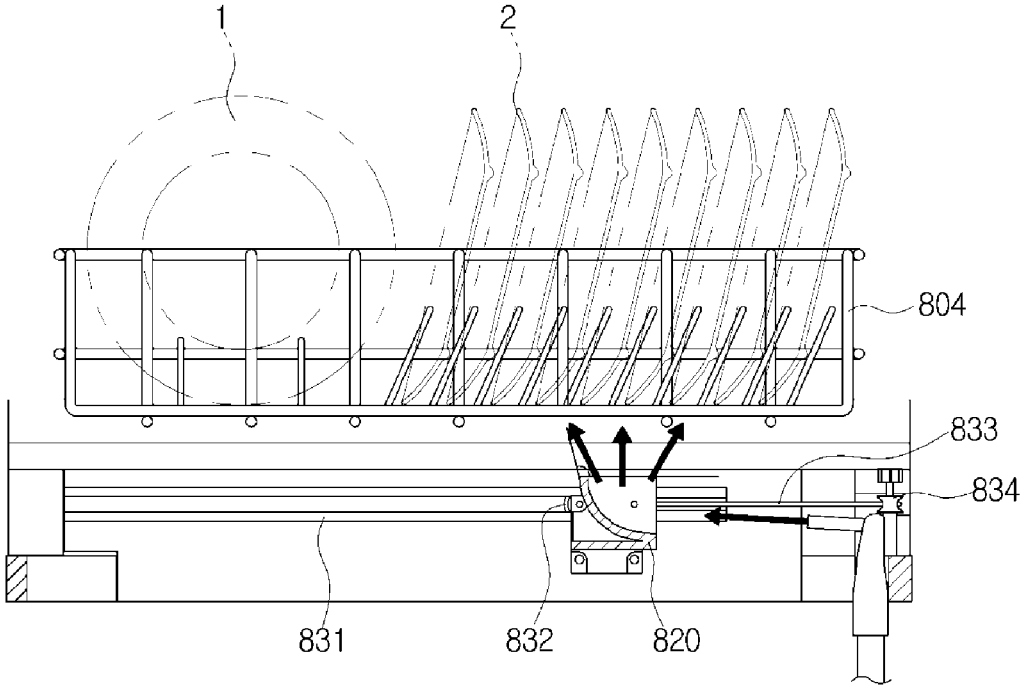
FIG. 51 is a side view of the jet unit and the changing unit in accordance with the second embodiment of the present disclosure.

FIG. 48 is a cross-sectional view of a dish washing machine in accordance with a second embodiment of the present disclosure. FIG. 49 is a perspective view of a jet unit and a changing unit in accordance with the second embodiment of the present disclosure. FIG. 50 is a top view of the jet unit and the changing unit in accordance with the second embodiment of the present disclosure. FIG. 51 is a side view of the jet unit and the changing unit in accordance with the second embodiment of the present disclosure.

As illustrated in FIG. 48, a dish washing machine 800 includes a cabinet 801 configured to form an exterior, and a washing tub 803 provided in the cabinet 801 to wash dishes. A sump 843 configured to store washing water is provided at a lower portion of the washing tub 803.

A front surface of the cabinet 801 is opened to put the dishes therein or take out the dishes therefrom, and a door 802 is provided to open and close the washing tub 803. The door 802 is rotatably hinged to a lower portion of the front surface of the cabinet 801 to open and close the washing tub 803.

A pair of dish baskets 804 of which upper portions are opened to provide a receiving portion in which the dishes are received is installed in upper and lower portions of the washing tub 803 to be moved forward and backward. The dish baskets 804 may be put in or taken out through the opened front surface of the cabinet 801 by racks 805*a* and 805*b* configured to slidably support the dish baskets 804.

The dish baskets 804 are formed of a wire which is arranged in a grid type so that the dishes received therein may be exposed to an outside and washed.

Jet units 810, 860 and 870 configured to jet the washing water to the dish baskets 804 are installed at at least one surface of the washing tub 803.

The jet units 810, 860 and 870 are provided to jet the washing water into the washing tub 803. The jet units 810, 860 and 870 may be provided at the at least one surface of the washing tub 803 to jet the washing water in at least one direction of a lower end, an upper end, and a side surface of the dish baskets 804. The jet units 810, 860 and 870 may be provided to be fixed to at least one surface of the washing tub 803, such that the washing water is jetted in opposite directions to positions of the jet units 810, 860 and 870.

The jet units 810, 860 and 870 may be provided so that a primary water jet and a secondary water jet are formed from only a first jet unit 810 which is at least one of the jet units 810, 860 and 870. The first jet unit 810 and a changing unit 820 are located under a lower dish basket 804*b*, and the primary water jet and the secondary water jet are formed by the first jet unit 810 and the changing unit 820, and wash the dishes. The second jet units 860 and 870 configured to jet the washing water while being rotated may be provided at upper and lower sides of an upper dish basket 804*a*. The jet units 810, 860 and 870 may be formed in a hybrid jetting manner in which a linear type jetting manner configured to linearly jet the washing water and a rotary jetting manner configured to jet the washing water while being rotated are used together.

The jet units 810, 860 and 870 may include the first jet unit 810 which linearly jets the washing water, and the second jet units 860 and 870 which jet the washing water while being rotated. The changing unit 820 may be provided at a front side of the first jet unit 810 to change a jet direction of the washing water. The first jet unit 810 may be located under the lower dish basket 804*b*. The second jet units 870 may be located between the upper dish basket 804*a* and the lower dish basket 804*b*. The second jet unit 860 may be additionally disposed above the upper dish basket 804*a*.

The first jet unit 810 may jet the washing water to generate one or more primary water jets in a direction approximately parallel with a lower end of the dish basket 804.

The changing unit 820 configured to change a direction of the washing water jetted from the jet units 810, 860 and 870 is provided in the washing tub 803. The changing unit 820 is provided inside a course of the jetted washing water to change the direction of the washing water. A direction of the washing water jetted from the first jet unit 810 is defined as a first direction, and a direction of the washing water changed by the changing unit 820 is defined as second direction. As an example, the changing unit 820 may be provided to be opposed to the first jet unit 810. In the case in which the first jet unit 810 is provided to jet the washing water to the lower end of the dish basket 804, the changing unit 820 may be disposed at the lower end of the dish basket

804. The changing unit 820 may be located at an outside of the dish basket 804, and linearly moved in a direction to become more distant from the first jet unit 810 or to be closer to the first jet unit 810. The primary water jet jetted from the first jet unit 810 may be jetted to the changing unit 820, and the direction of the primary water jet may be changed by the changing unit 820 so that the secondary water jet is formed toward the dishes located in the dish basket 804, and thus the dishes may be substantially washed by the secondary water jet. For example, the first jet unit 810 may be installed at a rear surface of the washing tub 803, and the changing unit 820 may be located in a direction parallel with the first jet unit 810. The changing unit 820 may reciprocate linearly in the direction to become more distant from the first jet unit 810 or in the opposite direction.

Further, the dish washing machine 800 may include a driving unit which drives the changing unit 820 to be movable in the washing tub 803. The driving unit may include a guide member 831 coupled to the changing unit 820, a power generating device 835 configured to drive the changing unit 820, and a pulley 834. Further, the driving unit may include a connection member 833 configured to connect the pulley 834 and the changing unit 820. The changing unit 820 may be moved in such a way, but the present disclosure is not limited thereto. It is satisfied as long as the changing unit 820 is provided to be movable.

The changing unit 820 includes a roller 832 provided at both sides thereof to allow the changing unit 820 to be smoothly moved in the washing tub 803. The changing unit 820 may be formed of a steel or plastic material.

The changing unit 820 may be coupled to the driving unit configured to drive the changing unit 820 to be movable in the washing tub 803. The driving unit may include at least one guide member 831 coupled to one side of the changing unit 820 to guide movement of the changing unit 820. According to the second embodiment of the present disclosure, the guide member 831 may be a rail, but is not limited thereto. As an example, the guide member 831 may be formed at at least part of the dish basket 804 without a separately additional component, or may be formed at at least part of an inner side surface of the washing tub 803 without the separately additional component. The roller 832 of the changing unit 820 is coupled to the guide member 831 of the driving unit to be movable along the guide member 831 between a front surface of the washing tub 803 and a rear surface thereof. The guide member 831 of the driving unit is coupled to the both side walls 803*a* and 803*b* of the washing tub 803. The power generating device 835 configured to drive the changing unit 820 is coupled to the pulley 834. The pulley 834 is connected to the changing unit 820 through the connection member 833. The connection member 833 may be a wire rope or a long string formed of a carbon material. Furthermore, a belt or a ball screw may be used for the connection member. The dishes which are arranged in the dish basket 804 in a transverse direction 8 or a longitudinal direction 9 may be washed in various directions by the changing unit 820.

A heater 844 configured to heat the washing water and a heater installation groove 845 may be provided at the washing tub 803. The heater installation groove 845 is provided at a bottom of the washing tub 803, and the heater 844 is installed in the heater installation groove 845.

The sump 843 is provided at a center of the bottom of the washing tub 803 so that the washing water is collected and pumped. The sump 843 includes a washing pump 842 configured to pump the washing water at a high pressure, and a pump motor 841 configured to drive the washing pump 842. Further, a drainage pump 846 configured to discharge the washing water is provided at the bottom of the washing tub 803.

The washing pump 842 pumps the washing water to the second jet units 860 and 870 through a first feed pipe 806, and also pumps the washing water to the first jet unit 810 through the second feed pipe 808. The drawings illustrate that the first feed pipe 806 and the second feed pipe 808 are separately coupled to the sump 843, but the present disclosure is not limited thereto. That is, the first feed pipe 806 and the second feed pipe 808 may be provided to branch from one pipe. The first feed pipe 806 may be connected with a connection portion (not shown), and the connection portion (not shown) may be connected with the jet units 810, 860 and 870.

The sump 843 may include a turbidity sensor (not shown) which detects a contamination level of the washing water. A control part (not shown) of the dish washing machine 800 may detect the contamination level of the washing water using the turbidity sensor (not shown) and control the performance number of a washing process or a rinsing process. That is, when the contamination level is high, the performance number of the washing process or the rinsing process may be increased, and when the contamination level is low, the performance number of the washing process or the rinsing process may be reduced.

Figure 52:
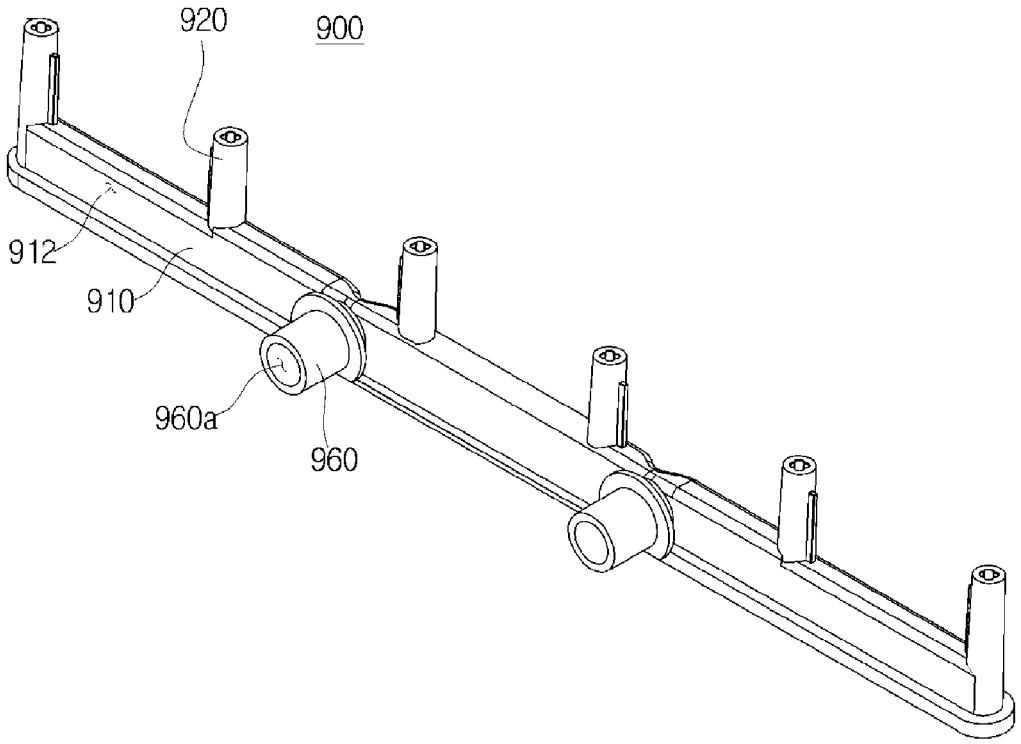
FIG. 52 is a perspective view of the jet unit in accordance with the second embodiment of the present disclosure.

FIG. 52 is a perspective view of the jet unit in accordance with the second embodiment of the present disclosure.

A first jet unit 900 may be provided to generate the primary water jet corresponding to the changing unit 820.

The first jet unit 900 may include a jet body 910 coupled to the washing tub 803, and a jet nozzle 920 having a jet passage 924 configured to jet the washing water.

The jet body 910 is coupled to the washing tub 803, and has a distribution passage 912 formed therein so that the washing water introduced from an introduction pipe 960 may be distributed to a plurality of jet nozzles 920.

The introduction pipe 960 is provided so that the washing water pumped through the feed pipe 808 by the washing pump is introduced into the first jet unit 900. The introduction pipe 960 has an introduction hole 960*a* to guide the washing water fed from the feed pipe 808 to the jet body 910. The introduction pipe 960 is connected with the feed pipe 808, and thus the washing water is introduced into the first jet unit 900.

The distribution passage 912 is in communication with the introduction hole 960*a* of the introduction pipe 960 and the jet passage 924 of the jet nozzle 920, which is described later. The distribution passage 912 is provided so that the washing water introduced through the introduction hole 960*a* is distributed to the plurality of jet nozzles 920.

The jet nozzles 920 are provided at the jet body 910 so that the washing water fed to the jet body 910 through the introduction pipe 960 is jetted to the changing unit 820.

Figure 53:
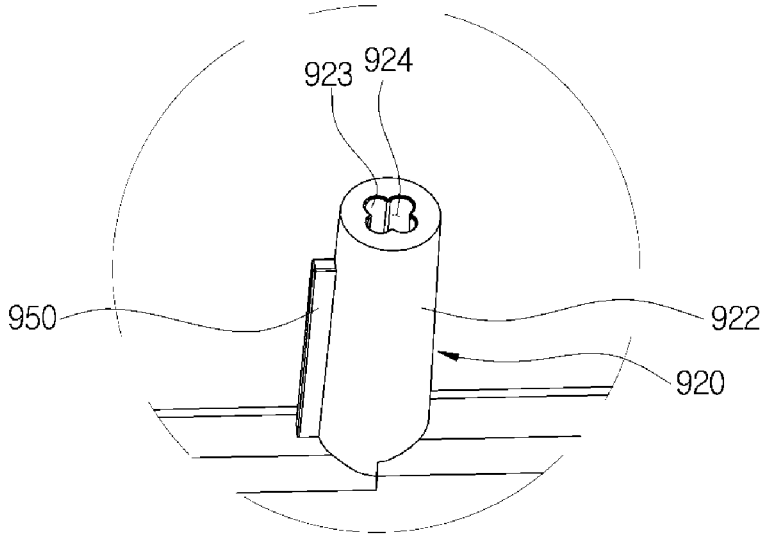
FIG. 53 is an enlarged view of a jet nozzle in accordance with the second embodiment of the present disclosure.
Figure 54:
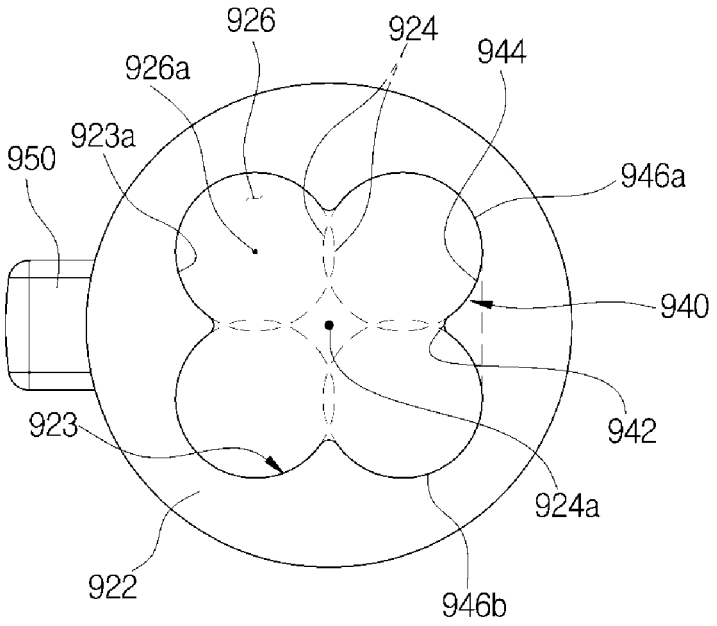
FIG. 54 is a top view of the jet nozzle in accordance with the second embodiment of the present disclosure.
Figure 55:
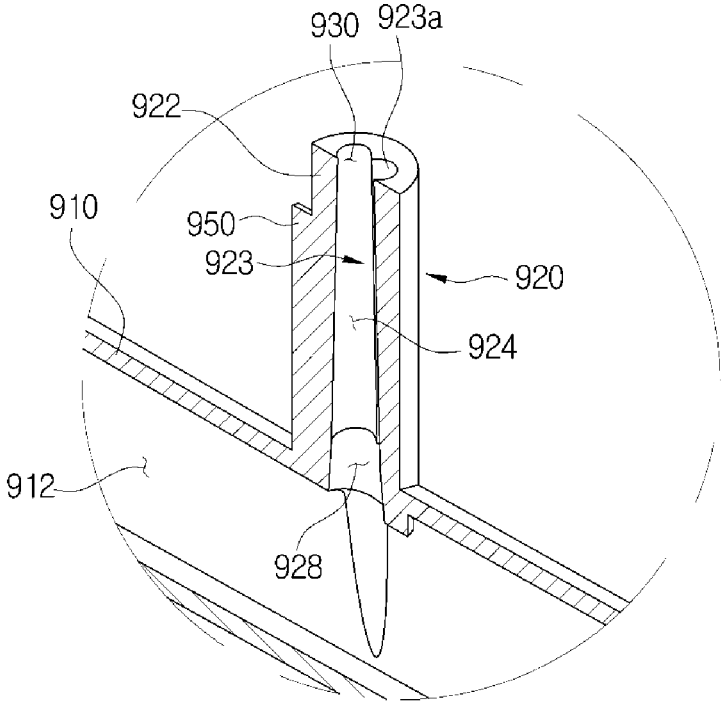
FIG. 55 is a cross-sectional perspective view of the jet nozzle in accordance with the second embodiment of the present disclosure.
Figure 56:
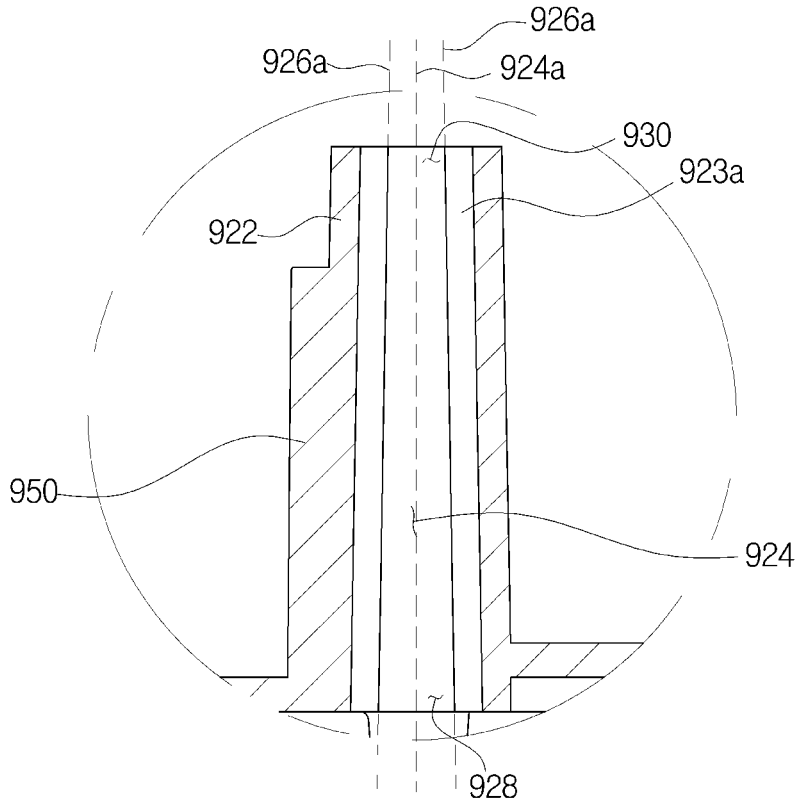
FIG. 56 is a cross-sectional view of the jet nozzle in accordance with the second embodiment of the present disclosure.
Figure 57:
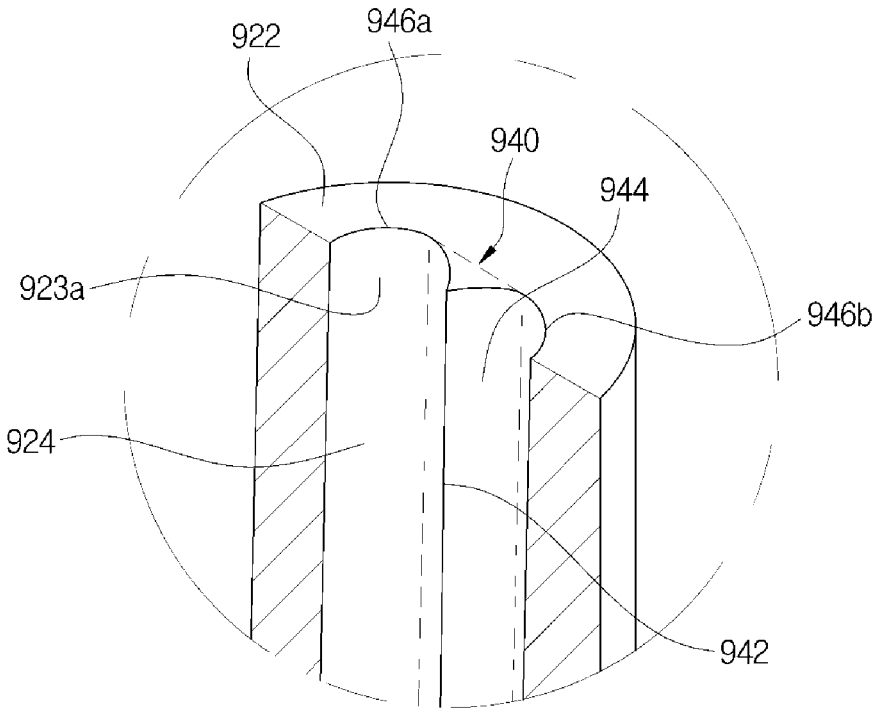
FIG. 57 is a partly enlarged view of the jet nozzle in accordance with the second embodiment of the present disclosure.

FIG. 53 is an enlarged view of a jet nozzle in accordance with the second embodiment of the present disclosure. FIG. 54 is a top view of the jet nozzle in accordance with the second embodiment of the present disclosure. FIG. 55 is a cross-sectional perspective view of the jet nozzle in accordance with the second embodiment of the present disclosure. FIG. 56 is a cross-sectional view of the jet nozzle in accordance with the second embodiment of the present disclosure. FIG. 57 is a partly enlarged view of the jet nozzle in accordance with the second embodiment of the present disclosure.

The jet nozzles 920 are provided to jet the washing water into the washing tub.

A nozzle inner wall 923 defining the jet passage 924 through which the washing water passes may be provided at each of the jet nozzles 920. The nozzle inner wall 923 is provided in each of the jet nozzles 920 to define the jet passage 924 configured to guide the washing water to the washing tub.

The jet passage 924 defined by the nozzle inner wall 923 may be formed so that a cross sectional area of the jet passage 924 becomes smaller in a flow direction of the washing water. That is, the cross sectional area of the jet passage 924 at a first point may be formed to be wider than that of the jet passage 924 at a second point which is located downstream of the first point in the flow direction of the washing water.

In other words, assuming that the cross sectional area of the jet passage 924, which is vertical to the flow direction of the washing water, at the first point is a first area, and the cross sectional area of the jet passage 924, which is vertical to the flow direction of the washing water, at the second point located downstream of the first point is a second area, the first area may be formed to be wider than the second area.

The nozzle inner wall 923 may include a plurality of passage inner walls 923*a*.

The plurality of passage inner walls 923*a* have arc shapes in section vertical to the flow direction of the washing water. The plurality of passage inner walls 923*a* may have different curvature radii from each other. However, in the embodiment of the present disclosure, the plurality of passage inner walls 923*a* have the same curvature radii.

Further, the curvature radii of the plurality of passage inner walls 923*a* may have different centers 926*a* from each other, and may be formed to be spaced apart from each other.

In the embodiment, four passage inner walls 923*a* are provided radially. However, in a third embodiment to be described later, ten passage inner walls 923*a* may be provided, and the number of passage inner walls 923*a* is not limited.

The plurality of passage inner walls 923*a* are provided so that the centers 926*a* of the curvature radii are spaced apart from each other, and thus the plurality of passage inner walls 923*a* are in contact with each other at regular angles. Specifically, as the centers 926*a* of the curvature radii of the plurality of passage inner walls 923*a* are spaced apart from each other, a contact portion between one end of one of the plurality of passage inner walls 923*a* and the other end of the adjacent passage inner wall 923*a* may be provided to protrude with respect to the nozzle inner wall 923.

That is, the nozzle inner wall 923 may include a plurality of protrusions 940 which are formed by that the plurality of passage inner walls 923*a* are in contact with each other and protrude toward the jet passage 924.

The plurality of protrusions 940 are formed to more protrude toward the jet passage 924 than the adjacent nozzle inner wall 923. The plurality of protrusions 940 are formed to protrude in the same direction as the flow direction of the washing water, and arranged along the nozzle inner wall 923 to be spaced apart from each other in a circumferential direction.

The plurality of protrusions 940 may be provided to have a protruding degree which becomes greater in the flow direction of the washing water. Specifically, when the plurality of protrusions 940 protrude from the nozzle inner wall 923 to have a first height at the first point, and also protrude from the nozzle inner wall 923 to have a second height at the second point which is located downstream of the first point in the flow direction of the washing water, the second height may be formed to be greater than the first height.

Protruding shapes of the plurality of protrusions 940 are not limited. However, in the embodiment of the present disclosure, the plurality of protrusions 940 are provided to have convexly curved shapes toward the jet passage 924.

The plurality of protrusions 940 may respectively include a top portion 942 and side portions 944.

The top portion 942 is formed to protrude from the nozzle inner wall 923 toward the jet passage 924. The top portion 942 of the protrusion 940 means a portion which protrudes toward the jet passage 924. The top portion 942 may have a sharpened shape defined by the both side portions 944. In the embodiment of the present disclosure, the top portion 942 has the convexly curved shape toward the jet passage 924.

The side portions 944 are provided at both side surfaces of the top portion 942 to connect the nozzle inner wall 923 and the top portion 942.

The side portions 944 are provided to connect the nozzle inner wall 923 and the top portion 942, and may be provided to have curved shapes. Further, the side portions 944 may be respectively formed to have the same curvature as that of the adjacent one of the plurality of passage inner walls 923*a*.

Hereinafter, another viewpoint of the second embodiment of the present disclosure will be described.

The same configuration as the above-mentioned description may be omitted or additionally described in detail.

The jet nozzle 920 may include a nozzle body 922, and the jet passage 924 formed in the nozzle body 922.

The jet passage 924 is provided so that the washing water flows in the jet nozzle 920 and is jetted to the washing tub 803. The jet passage 924 may include a plurality of sub-passages 926.

The plurality of sub-passages 926 may be formed to be at least partly overlapped with each other. That is, a cross sectional area of the jet passage 924 may be smaller than a total cross sectional area if the plurality of sub-passages 926 are independently provided. Specifically, the plurality of sub-passages 926 are respectively formed around a plurality of sub-passage axes 926*a* parallel with a lengthwise direction of the jet nozzle 920, and the a distance between the plurality of sub-passage axes 926*a* may be formed to be smaller than a diameter of one of the plurality of sub-passages 926. The sub-passage axes 926*a* are the same as the centers 926*a* of the above-mentioned curvature radii.

By this configuration, a ratio of the cross sectional area of the jet passage 924 with respect to a circumference of the jet passage 924 as an outer line of the jet passage 924 may be reduced, as compared with that the jet passage 924 has a circular shape in section, and thus a hydraulic diameter thereof may be reduced.

The plurality of sub-passages 926 may have different cross sectional areas from each other. However, in the second embodiment of the present disclosure, the plurality of sub-passages 926 have the same cross sectional areas.

The jet passage 924 has a jet nozzle axis 924*a* which is formed in the lengthwise direction of the jet nozzle 920, and the plurality of sub-passages 926 have the sub-passage axes 926*a* which are the centers of the sub-passages 926. The plurality of sub-passage axes 926*a* may be disposed around the jet nozzle axis 924*a* to be spaced apart with each other in regular intervals. In the second embodiment of the present disclosure, four sub-passages 926 are formed so that the plurality of sub-passage axes 926*a* form a quadrangle in regular intervals. In other words, the sub-passage axes 926*a* as the centers of the plurality of sub-passages 926 may be arranged radially with respect to the jet nozzle axis 924*a*.

However, the arrangement and the number of the plurality of sub-passages 926 are not limited.

The sub-passage axes 926*a* of the plurality of sub-passages 926 may be formed to have a shortened separation distance from the jet nozzle axis 924*a* in the flow direction of the washing water. That is, the washing water is introduced from the distribution passage 912 and then jetted to the washing tub 803 through the jet passage 924, and the plurality of sub-passage axes 926*a* as the centers of the plurality of sub-passages 926 are formed to have shortened separation distances from the jet nozzle axis 924*a* as the center of the jet passage 924. In a viewpoint of the cross sectional area, the cross sections of the plurality of sub-passages 926 may be provided so that an area overlapped between the cross sections becomes wider in the flow direction of the washing water.

Due to such configuration, the washing water passing through each passage is collected at a predetermined angle toward the jet nozzle axis 924*a*, and straightness of the washing water is enhanced.

The jet passage 924 may be formed to be in communication with the distribution passage 912.

Ends of the jet passage 924 may be formed by an inlet port 928 in communication with the distribution passage 912, and an outlet port 930 in communication with the washing tub 803. The plurality of sub-passages 926 may be provided so that the washing water is commonly introduced and discharged through the inlet port 928 and the outlet port 930. The jet nozzle 920 includes an inlet port 928 configured to allow washing water to be introduced into the jet passage 924 therethrough and an outlet port 930 configured to allow washing water of the jet passage 924 to be discharged therethrough and the plurality of sub-passages 926 allows washing water to be introduced through the inlet port 928 and discharged through the outlet port 930.

The inlet port 928 may be formed to have a circular shape, and the outlet port 930 may be formed so that a plurality of circular shapes are overlapped with each other. The jet passage 924 from the inlet port 928 to the outlet port 930 is formed so that the cross section thereof is deformed without any steps, and thus flow resistance may be minimized.

The jet nozzle 920 may include the protrusion 940.

The protrusion 940 is provided to protrude from the jet nozzle 920 toward the jet passage axis 924*a* of the jet passage 924. A protruding shape and a protruding size of the protrusion 940 are not limited. The plurality of protrusions 940 may be arranged around the jet passage axis 924*a* to be spaced apart from each other along an inner wall of the nozzle body 922. Due to the protrusion 940, the jet passage 924 may have a small cross sectional area, as compared with a circumferential length thereof.

When there are a first curved surface 946*a* formed by one of the plurality of sub-passages 926 and a second curved surface 946*b* formed by another adjacent sub-passage 926, the protrusion 940 may be formed at a portion in which the first and second curved surfaces 946*a* and 946*b* are in contact with each other. The protrusion 940 may at least partly partition each of the plurality of sub-passages 926.

The protrusion 940 may be provided to protrude toward the jet nozzle axis 924*a* with respect to the flow direction of the washing water. Specifically, the protrusion 940 may be formed to protrude from the inlet port 928 of the jet passage 924 to the outlet port 930 thereof. The protruding degree of the protrusion 940 may be formed to be greater at the outlet port 930 than at the inlet port 928, and thus the circumferential length of the jet passage 924 is greater at the outlet port 930 than at the inlet port 928.

The protrusion 940 may include the top portion 942 configured to protrude toward the jet nozzle axis 924*a*, and the side portion 944 extending from the top portion 942 to the nozzle body 922.

The top portion 942 may be formed to protrude from the nozzle body 922 in the flow direction of the washing water and thus to be closer to the jet nozzle axis 924*a*. The top portion 942 may be formed in a curved surface by a rounding process to reduce the flow resistance.

The side portion 944 is a portion from the top portion 942 to the nozzle body 922, and may be formed in the curved surface to reduce the flow resistance of the jet passage 924. The curved surface may be formed in a concave shape, and curvature of the curved surface may be formed to correspond to an internal cross section of the adjacent jet nozzle 920. That is, the side portion 944 may be formed to have the same curvature as that of an inner wall of the adjacent nozzle body 922.

A guide rib 950 may be provided at a side surface of the jet nozzle 920.

The guide rib 950 serves to guide the jet nozzle 920 so as to prevent the jet nozzle 920 from being twisted or bent by the water pressure at the jet nozzle 920. The guide rib 950 may be provided to connect the jet body 910 and the jet nozzle 920, and arranged in the lengthwise direction of the jet nozzle 920.

A length of the jet nozzle is not limited. However, in order for the existing jet nozzle of which the jet passage has the circular shape in section to have the straightness of the washing water, a length corresponding to 10 times of the hydraulic diameter was required. In the case of having the plurality of passage inner walls like in the embodiment of the present disclosure, a length corresponding to approximately 5 times the hydraulic diameter may create the same effect as that in the existing jet nozzle. Furthermore, a jet nozzle having a length corresponding to 2 times the hydraulic diameter may be embodied by additionally increasing the number of passage inner walls or providing other additional shapes. Therefore, the jet nozzle having the length corresponding to 2 times the hydraulic diameter is included within the scope of the jet nozzle according to the embodiment of the present disclosure.

Hereinafter, a jet unit according to a third embodiment of the present disclosure and a dish washing machine having the same will be described. In the embodiment of the present disclosure, the description of the same configuration as that described previously will be omitted.

Figure 58:
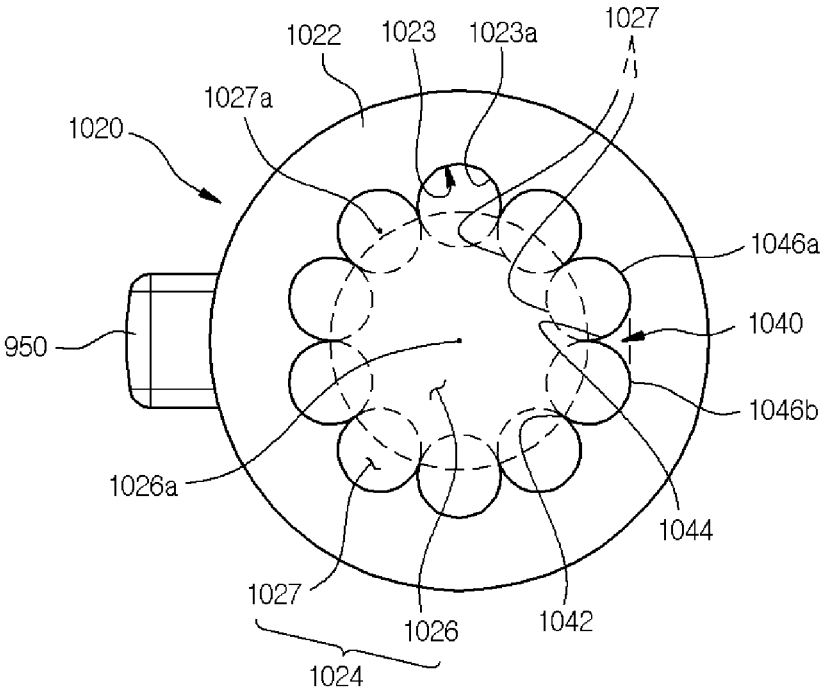
FIG. 58 is a top view of a jet nozzle in accordance with a third embodiment of the present disclosure.
Figure 59:
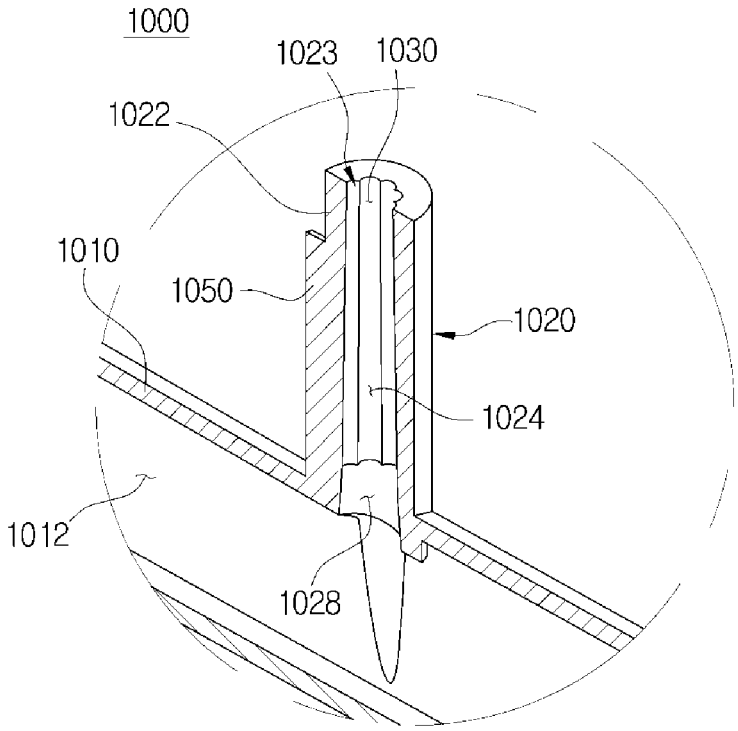
FIG. 59 is a cross-sectional perspective view of the jet nozzle in accordance with the third embodiment of the present disclosure.
Figure 60:
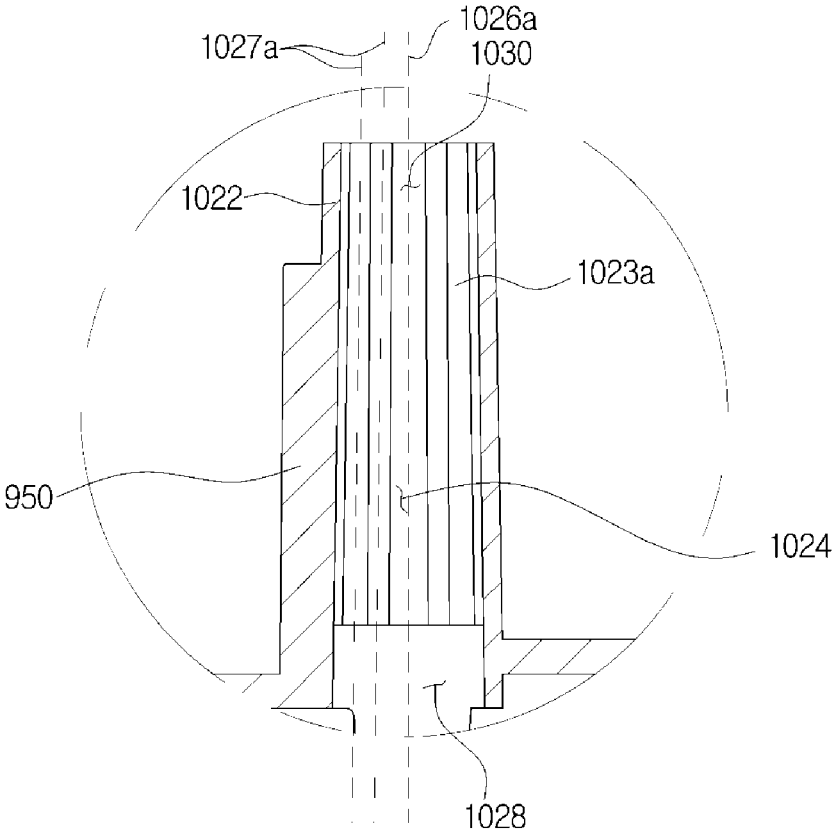
FIG. 60 is a cross-sectional view of the jet nozzle in accordance with the third embodiment of the present disclosure.

FIG. 58 is a top view of a jet nozzle in accordance with a third embodiment of the present disclosure. FIG. 59 is a cross-sectional perspective view of the jet nozzle in accordance with the third embodiment of the present disclosure. FIG. 60 is a cross-sectional view of the jet nozzle in accordance with the third embodiment of the present disclosure.

A jet nozzle 1020 is provided to jet the washing water into the washing tub.

A nozzle inner wall 1023 defining a jet passage 1024 through which the washing water passes may be provided at the jet nozzle 1020. The nozzle inner wall 1023 is provided in the jet nozzle 1020 to define the jet passage 1024 configured to guide the washing water into the washing tub.

The jet passage 1024 defined by the nozzle inner wall 1023 may be formed to have a cross sectional area which becomes smaller in the flow direction of the washing water. That is, the cross sectional area of the jet passage 1024 at a first point may be formed to be wider than that of the jet passage 1024 at a second point which is located downstream of the first point in the flow direction of the washing water.

In other words, assuming that the cross sectional area of the jet passage 1024, which is vertical to the flow direction of the washing water, at the first point is a first area, and the cross sectional area of the jet passage 1024, which is vertical to the flow direction of the washing water, at the second point located downstream of the first point is a second area, the first area may be formed to be wider than the second area.

The nozzle inner wall 1023 may include a plurality of passage inner walls 1023*a*.

The plurality of passage inner walls 1023*a* have arc shapes in section vertical to the flow direction of the washing water. The plurality of passage inner walls 1023*a* may have different curvature radii from each other. However, in the embodiment of the present disclosure, the plurality of passage inner walls 1023*a* have the same curvature radii.

Further, the curvature radii of the plurality of passage inner walls 1023*a* may have different centers 1027*a* from each other, and may be formed to be spaced apart from each other.

In the embodiment, ten passage inner walls 1023*a* may be provided, and the number of passage inner walls 1023*a* is not limited.

The plurality of passage inner walls 1023*a* are provided so that the centers 1027*a* of the curvature radii are spaced apart from each other, and thus the plurality of passage inner walls 1023*a* are in contact with each other at regular angles. Specifically, as the centers 1027*a* of the curvature radii of the plurality of passage inner walls 1023*a* are spaced apart from each other, a contact portion between one end of one of the plurality of passage inner walls 1023*a* and the other end of the adjacent passage inner wall 1023*a* may be provided to protrude with respect to the nozzle inner wall 1023.

That is, the nozzle inner wall 1023 may include a plurality of protrusions 1040 which are formed by that the plurality of passage inner walls 1023*a* are in contact with each other and protrude toward the jet passage 1024.

The plurality of protrusions 1040 are formed to more protrude toward the jet passage 1024 than the adjacent nozzle inner wall 1023. The plurality of protrusions 1040 are formed to protrude in the same direction as the flow direction of the washing water, and arranged along the nozzle inner wall 1023 in a circumferential direction to be spaced apart from each other.

The plurality of protrusions 1040 may be provided to have a protruding degree which becomes greater in the flow direction of the washing water. Specifically, when the plurality of protrusions 1040 protrude from the nozzle inner wall 1023 to have a first height at the first point, and also protrude from the nozzle inner wall 1023 to have a second height at the second point which is located downstream of the first point in the flow direction, the second height may be formed to be greater than the first height.

Protruding shapes of the plurality of protrusions 1040 are not limited. However, in the embodiment of the present disclosure, the plurality of protrusions 1040 are provided to have convexly curved shapes toward the jet passage 1024.

The plurality of protrusions 1040 may respectively include a top portion 1042 and side portions 1044.

The top portion 1042 is formed to protrude from the nozzle inner wall 1023 toward the jet passage 1024. The top portion 1042 of the protrusion 1040 means a portion which protrudes toward the jet passage 1024. The top portion 1042 may have a sharpened shape defined by the both side portions 1044. In the embodiment of the present disclosure, the top portion 1042 has the convexly curved shape toward the jet passage 1024.

The side portions 1044 are provided at both side surfaces of the top portion 1042 to connect the nozzle inner wall 1023 and the top portion 1042.

The side portions 1044 are provided to connect the nozzle inner wall 1023 and the top portion 1042, and may be provided to have curved shapes. Further, the side portions 1044 may be respectively formed to have the same curvature as that of the adjacent one of the plurality of passage inner walls 1023*a*.

Hereinafter, another viewpoint of the third embodiment of the present disclosure will be described.

A first jet unit 1000 may include a jet body 1010 coupled to the washing tub 803, and a jet nozzle 1020 having a jet passage 1024 configured to jet the washing water.

The jet nozzle 1020 may include a nozzle body 1022, and the jet passage 1024 formed in the nozzle body 1022.

The jet passage 1024 is provided so that the washing water flows in the jet nozzle 1020 and is jetted to the washing tub 803. The jet passage 1024 may include a main passage 1026 and a plurality of sub-passages 1027.

The main passage 1026 is a passage which is formed around an axis of the main passage 1026, which is formed in a lengthwise direction of the jet nozzle 1020. The main passage 1026 may have various shapes in section. However, in the embodiment of the present disclosure, the main passage 1026 has a circular shape in section.

The plurality of sub-passages 1027 may be provided to have central axes adjacent to an imaginary outer line of the main passage 1026. That is, sub-passage axes 1027*a* passing through the centers of the plurality of sub-passages 1027 are provided to be adjacent to the imaginary outer line of the main passage 1026, and thus cross sections of the sub-passages 1027 are partly overlapped with the cross section of the main passage 1026. In other words, the plurality of sub-passages 1027 may be arranged around the main passage 1026 so that parts of the cross sections thereof are overlapped with the cross section of the main passage 1026. The sub-passage axes 1027*a* are the same configurations as the centers 1027*a* of the curvature radii described above.

The number and arrangement of the plurality of sub-passages 1027 are not limited. However, in the embodiment of the present disclosure, the plurality of sub-passages 1027 may be uniformly arranged along the outer line of the main passage 1026.

The sub-passage axes 1027*a* of the plurality of sub-passages 1027 may be formed to have a shortened separation distance from the axis of the main passage 1026 in the flow direction of the washing water. That is, the washing water is introduced from the distribution passage 1012 and then jetted to the washing tub 803 through the jet passage 1024, and the plurality of sub-passage axes 1027*a* as the centers of the plurality of sub-passages 1027 are formed to have shortened separation distances from the axis of the main passage 1026. In a viewpoint of the cross sectional area, an area overlapped between the cross sections of the plurality of sub-passages 1027 and the cross section of the main passage 1026 may become wider in the flow direction of the washing water.

Due to such configuration, the washing water passing through each passage is collected at a predetermined angle toward the axis of the jet nozzle 1020, and the straightness of the washing water is enhanced.

The jet passage 1024 may be formed to be in communication with the distribution passage 1012.

Ends of the jet passage 1024 may be formed by an inlet port 1028 in communication with the distribution passage 1012, and an outlet port 1030 in communication with the washing tub 803. The main passage 1026 and the plurality of sub-passages 1027 may be provided so that the washing water is commonly introduced and discharged through the inlet port 1028 and the outlet port 1030. The jet nozzle 1020 includes an inlet port 1028 configured to allow washing water to be introduced into the jet passage 1024 therethrough and an outlet port 1030 configured to allow washing water of the jet passage 1024 to be discharged therethrough and the plurality of sub-passages 1026 allows washing water to be introduced through the inlet port 1028 and discharged through the outlet port 1030.

The inlet port 1028 may be formed to have a circular shape, and the outlet port 1030 may be formed so that a plurality of circular shapes are overlapped with each other. The jet passage 1024 from the inlet port 1028 to the outlet port 1030 is formed so that the cross section thereof is deformed without any steps, and thus the flow resistance may be minimized.

The jet nozzle 1020 may include the protrusion 1040.

The protrusion 1040 is provided to protrude from the jet nozzle 1020 toward a main passage axis 1026*a* of the jet passage 1024. A protruding shape and a protruding size of the protrusion 1040 are not limited. The plurality of protrusions 1040 may be arranged around the main passage axis 1026*a* to be spaced apart from each other along an inner wall of the nozzle body 1022. Due to the protrusion 1040, the jet passage 1024 may have a small cross sectional area, as compared with a circumferential length thereof.

When there are a first curved surface 1046*a* formed by one of the plurality of sub-passages 1027 and a second curved surface 1046*b* formed by another adjacent sub-passage 1027, the protrusion 1040 may be formed at a portion in which the first and second curved surfaces 1046*a* and 1046*b* are in contact with each other. The protrusion 1040 may at least partly partition each of the plurality of sub-passages 1027.

The protrusion 1040 may be provided to protrude toward the main passage axis 1026*a* with respect to the flow direction of the washing water. Specifically, the protrusion 1040 may be formed to protrude from the inlet port 1028 of the jet passage 1024 to the outlet port 1030 thereof. The protruding degree of the protrusion 1040 may be formed to be greater at the outlet port 1030 than at the inlet port 1028, and thus the circumferential length of the jet passage 1024 is greater at the outlet port 1030 than at the inlet port 1028.

The protrusion 1040 may include the top portion 1042 configured to protrude toward the main passage axis 1026*a*, and the side portion 1044 extending from the top portion 1042 to the nozzle body 1022.

The top portion 1042 may be formed to protrude from the nozzle body 1022 in the flow direction of the washing water and thus to be closer to the main passage axis 1026*a*. The top portion 1042 may be formed in a curved surface by a rounding process to reduce the flow resistance.

The side portion 1044 is a portion from the top portion 1042 to the nozzle body 1022, and may be formed in the curved surface to reduce the flow resistance of the jet passage 1024. The curved surface may be formed in a concave shape, and curvature of the curved surface may be formed to correspond to an internal cross section of the adjacent jet nozzle 1020. That is, the side portion 1044 may be formed to have the same curvature as that of an inner wall of the adjacent nozzle body 1022.

Hereinafter, a jet unit according to a fourth embodiment of the present disclosure and a dish washing machine having the same will be described. In the embodiment of the present disclosure, the description of the same configuration as that described previously will be omitted.

Figure 61:
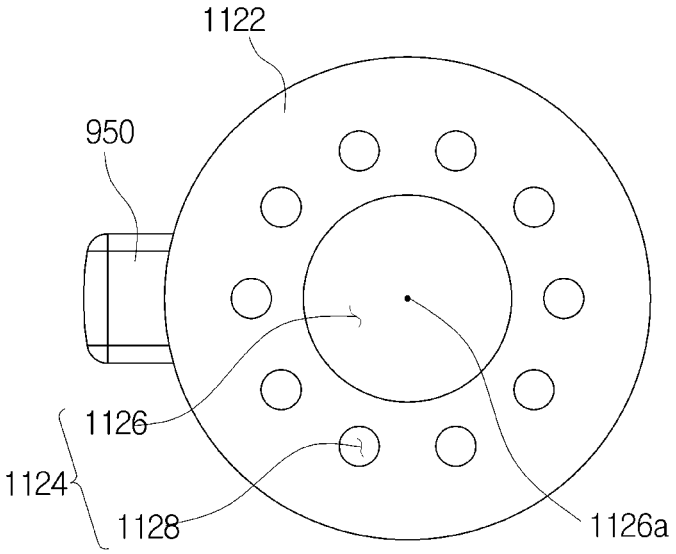
FIG. 61 is a top view of a jet nozzle in accordance with a fourth embodiment of the present disclosure.
Figure 62:
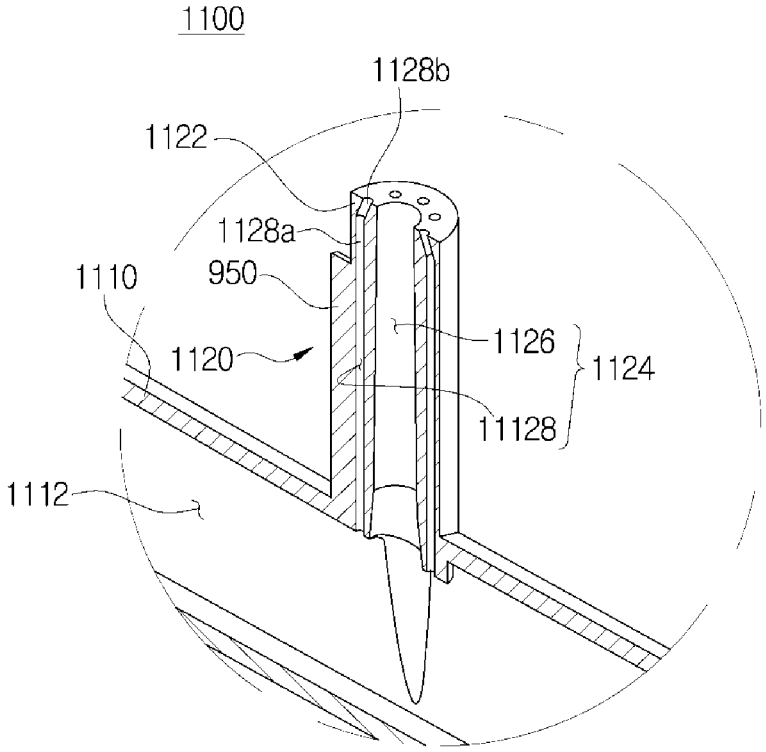
FIG. 62 is a cross-sectional perspective view of the jet nozzle in accordance with the fourth embodiment of the present disclosure.
Figure 63:
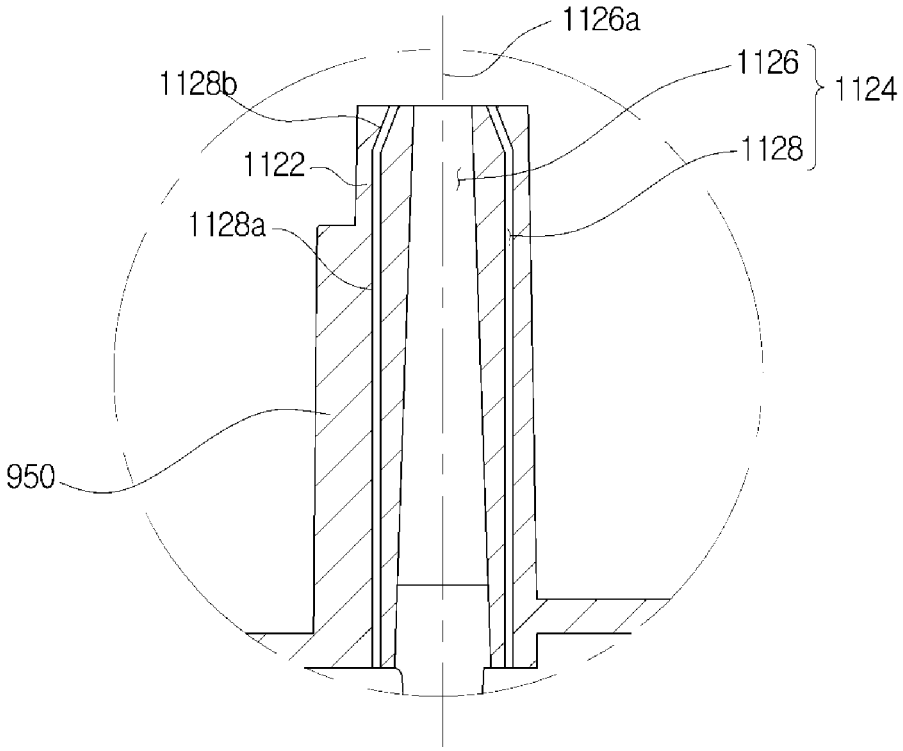
FIG. 63 is a cross-sectional view of the jet nozzle in accordance with the fourth embodiment of the present disclosure.

FIG. 61 is a top view of a jet nozzle in accordance with a fourth embodiment of the present disclosure. FIG. 62 is a cross-sectional perspective view of the jet nozzle in accordance with the fourth embodiment of the present disclosure. FIG. 63 is a cross-sectional view of the jet nozzle in accordance with the fourth embodiment of the present disclosure.

A first jet unit 1100 may include a jet body 1110 coupled to the washing tub 803, and a jet nozzle 1120 having a jet passage 1124 configured to jet the washing water.

The jet nozzle 1120 may include a nozzle body 1122, and the jet passage 1124 formed in the nozzle body 1122.

The jet passage 1124 is provided so that the washing water flows in the jet nozzle 1120 and is jetted to the washing tub 803. The jet passage 1124 may include a first passage 1126 and a plurality of second passages 1128 provided around the first passage 1126.

The first passage 1126 is a passage which is formed around a first passage axis 1126*a*, which is formed in a lengthwise direction of the jet nozzle 1120. The first passage 1126 may have various shapes in section. However, in the embodiment of the present disclosure, the first passage 1126 has a circular shape in section.

The plurality of second passages 1128 may be formed to be adjacent to the first passage 1126, and provided to have an outlet port separate from the first passage 1126.

Each of the second passages 1128 may include a guide passage 1128*a* in which the washing water is introduced from the distribution passage and introduced and guided into the second passage 1128, and a bent passage 1128*b* bent toward the first passage 1126. Specifically, the first passage 1126 may be provided to have the first passage axis 1126*a* passing through a center thereof, and the flow direction of the washing water passing through the guide passage 1128*a* is changed while the washing water passes through the bent passage 1128*b*, such that the washing water jetted through the first passage 1126 may have straightness.

Since the plurality of second passages 1128 are provided around the first passage 1126, the second passages 1128 may serve to adjust a jet direction of the first passage 1126 in various directions so that the washing water has the improved straightness in the jet direction.

The jet nozzle 1120 of the present disclosure was described in a state of being applied to the first jet units 900, 1000 and 1100 which are formed in the linear type jetting manner. However, the jet nozzle 1120 may be applied to the second jet units 860 and 870 which are formed in the rotary type jetting manner.

Due to the jet unit according to the present disclosure and the dish washing machine having the same, the straightness of the jet nozzle may be enhanced, and thus a size of the jet unit may be reduced, and the dish washing machine may have a small size.

Hereinafter, a jet unit according to a fifth embodiment of the present disclosure and a dish washing machine having the same will be described.

Figure 64:
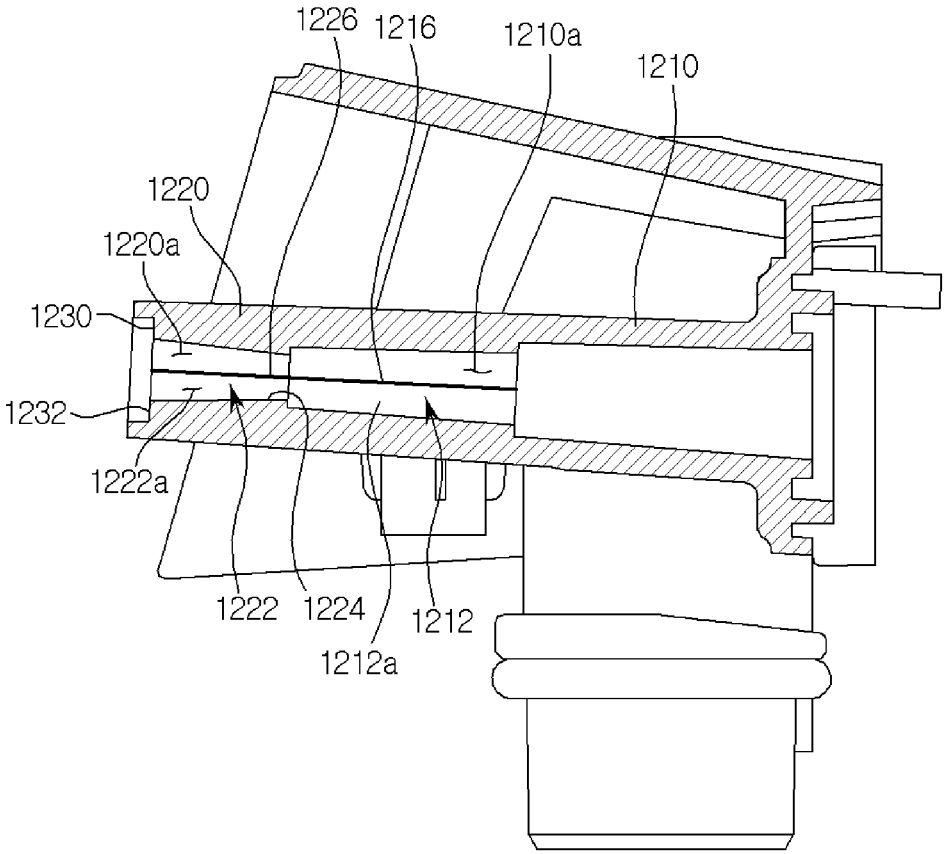
FIG. 64 is a cross-sectional view of a jet nozzle in accordance with a fifth embodiment of the present disclosure.
Figure 65:
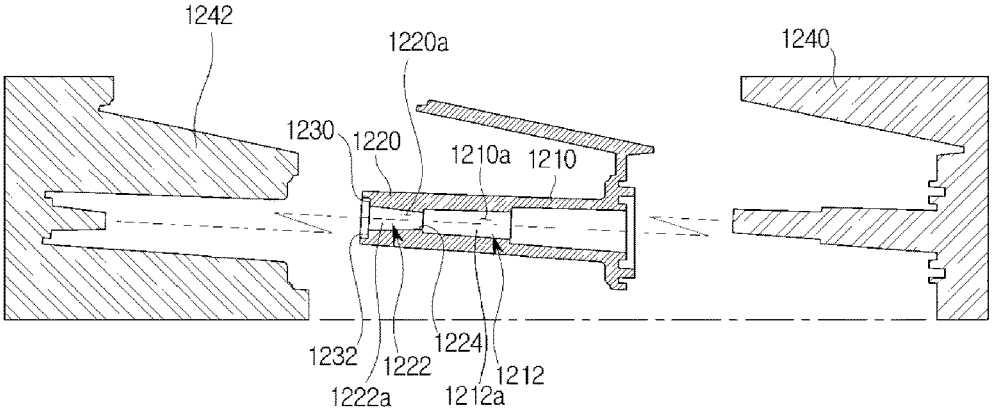
FIGS. 65 and 66 are views illustrating a manufacturing process of the jet nozzle in accordance with the fifth embodiment of the present disclosure.
Figure 66:
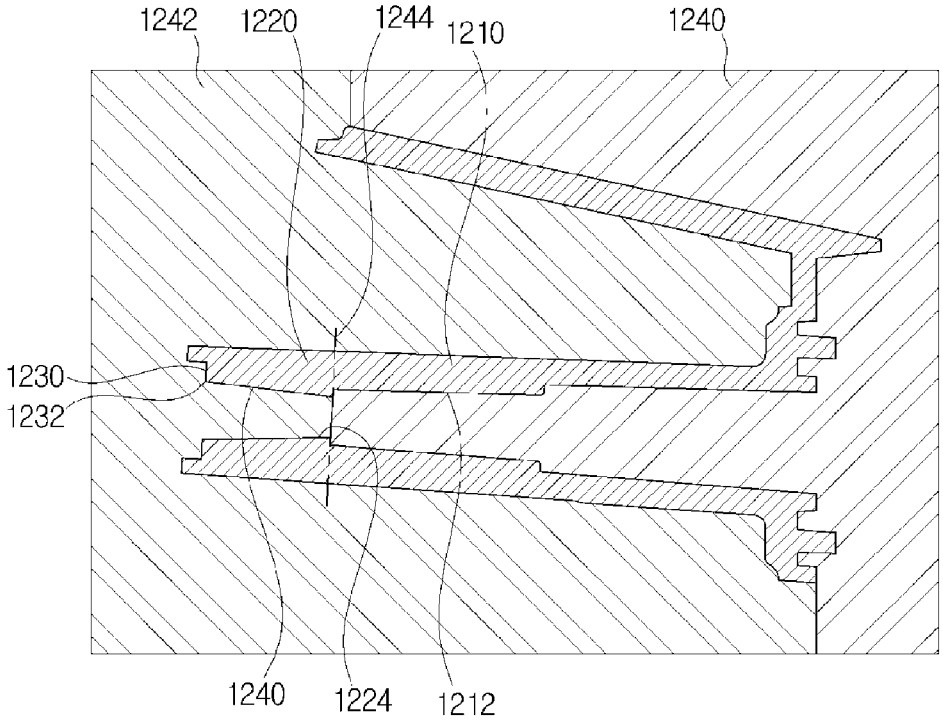

FIG. 64 is a cross-sectional view of a jet nozzle in accordance with a fifth embodiment of the present disclosure. FIGS. 65 and 66 are views illustrating a manufacturing process of the jet nozzle in accordance with the fifth embodiment of the present disclosure.

The description of the same configuration as that described previously will be omitted.

A jet nozzle 1200 is provided to jet the washing water into the washing tub.

The jet nozzle 1200 may include a first jet nozzle 1210 and a second jet nozzle 1220.

The first jet nozzle 1210 is provided to have a first jet passage 1210*a* of which a cross sectional area becomes smaller in the flow direction of the washing water. The second jet nozzle 1220 is provided to have a second jet passage 1220*a* in communication with the first jet passage 1210*a*. The first jet passage 1210*a* and the second jet passage 1220*a* may be provided to be in communication with each other and also to have the same central line. The first jet passage 1210*a* is in communication with a nozzle passage 1202 to receive the washing water fed from the nozzle passage 1202.

The first jet nozzle 1210 may include a first nozzle inner wall 1212 defining the first jet passage 1210*a*. The first nozzle inner wall 1212 may be formed to have a gradient toward a center of the passage in the flow direction of the washing water. By such configuration, the first jet passage 1210*a* may be formed so that a cross sectional area thereof becomes smaller in the flow direction of the washing water.

The second jet nozzle 1220 may include a second nozzle inner wall 1222 defining the second jet passage 1220*a*. The second nozzle inner wall 1222 may be formed to have a gradient in a direction to become more distant from the center of the passage. By such configuration, the second jet passage 1220*a* may be formed so that a cross sectional area thereof becomes greater in the flow direction of the washing water. However, the gradient level of the second nozzle inner wall 1222 is not limited, and thus the second nozzle inner wall 1222 may be provided to be parallel with the flow direction of the washing water.

The first nozzle inner wall 1212 and the second nozzle inner wall 1222 may be provided to have a step in the flow direction of the washing water. That is, the second jet nozzle 1220 may further include a stepped portion 1224 which is provided at the second jet passage 1220*a* so that a cross sectional area thereof located upstream of the second jet passage 1220*a* is smaller than that located downstream of the first jet passage 1210*a*. Since the first nozzle inner wall 1212 and the second nozzle inner wall 1222 are connected through the stepped portion 1224 so as to have the step, the washing water passing through the first jet passage 1210*a* defined by the first nozzle inner wall 1212 has an increased current speed while passing through the second jet passage 1220*a* defined by the second nozzle inner wall 1222.

The first nozzle inner wall 1212 may include a plurality of first passage inner walls 1212*a*.

The plurality of first passage inner walls 1212*a* have arc shapes in section vertical to the flow direction of the washing water. The plurality of first passage inner walls 1212*a* may have different curvature radii from each other. However, in the embodiment of the present disclosure, the plurality of first passage inner walls 1212*a* have the same curvature radii.

Further, the curvature radii of the plurality of first passage inner walls 1212*a* may have different centers from each other, and may be formed to be spaced apart from each other.

In the embodiment, four first passage inner walls 1212*a* are provided radially to be symmetrical with each other. However, the number of first passage inner walls 1212*a* is not limited.

The plurality of first passage inner walls 1212*a* are provided so that the centers of the curvature radii are spaced apart from each other, and thus the plurality of first passage inner walls 1212*a* are in contact with each other at regular angles. Specifically, as the centers of the curvature radii of the plurality of first passage inner walls 1212*a* are spaced apart from each other, a contact portion between one end of one of the plurality of first passage inner walls 1212*a* and the other end of the adjacent first passage inner wall 1212*a* may be provided to protrude with respect to the first nozzle inner wall 1212.

That is, the first nozzle inner wall 1212 may include a plurality of first protrusions 1216 which are formed by that the plurality of first passage inner walls 1212*a* are in contact with each other and protrude toward the first jet passage 1210*a*.

The plurality of first protrusions 1216 are formed to more protrude toward the first jet passage 1210*a* than the adjacent first nozzle inner wall 1212. The plurality of first protrusions 1216 are formed to protrude in the same direction as the flow direction of the washing water, and arranged along the first nozzle inner wall 1212 to be spaced apart from each other in a circumferential direction.

Protruding shapes of the plurality of first protrusions 1216 are not limited. However, in the embodiment of the present disclosure, the plurality of first protrusions 1216 are provided to have convexly curved shapes toward the first jet passage 1210*a*. That is, ends of the first protrusions 1216, which are directed to the first jet passage 1210*a*, may be formed to be rounded.

The second nozzle inner wall 1222 may include a plurality of second passage inner walls 1222*a*.

The plurality of second passage inner walls 1222*a* have arc shapes in section vertical to the flow direction of the washing water. The plurality of second passage inner walls 1222*a* may have different curvature radii from each other. However, in the embodiment of the present disclosure, the plurality of second passage inner walls 1222*a* have the same curvature radii.

Further, the curvature radii of the plurality of second passage inner walls 1222*a* may have different centers from each other, and may be formed to be spaced apart from each other.

In the embodiment, four second passage inner walls 1222*a* are provided radially to be symmetrical with each other. However, the number of second passage inner walls 1222*a* is not limited.

The plurality of second passage inner walls 1222*a* are provided so that the centers of the curvature radii are spaced apart from each other, and thus the plurality of second passage inner walls 1222*a* are in contact with each other at regular angles. Specifically, as the centers of the curvature radii of the plurality of second passage inner walls 1222*a* are spaced apart from each other, a contact portion between one end of one of the plurality of second passage inner walls 1222*a* and the other end of the adjacent second passage inner wall 1222*a* may be provided to protrude with respect to the second nozzle inner wall 1222.

That is, the second nozzle inner wall 1222 may include a plurality of second protrusions 1226 which are formed by that the plurality of second passage inner walls 1222*a* are in contact with each other and protrude toward the second jet passage 1220*a*.

The plurality of second protrusions 1226 are formed to more protrude toward the second jet passage 1220*a* than the adjacent second nozzle inner wall 1222. The plurality of second protrusions 1226 are formed to protrude in the same direction as the flow direction of the washing water, and arranged along the second nozzle inner wall 1222 to be spaced apart from each other in a circumferential direction.

Protruding shapes of the plurality of second protrusions 1226 are not limited. However, in the embodiment of the present disclosure, the plurality of second protrusions 1226 are provided to have convexly curved shapes toward the second jet passage 1220*a*. That is, ends of the second protrusions 1226, which are directed to the second jet passage 1220*a*, may be formed to be rounded.

In the embodiment, the first nozzle inner wall 1212 and the second nozzle inner wall 1222 have the plurality of first passage inner walls 1212*a* and the plurality of second passage inner walls 1222*a*. However, the first nozzle inner wall 1212 and the second nozzle inner wall 1222 are not limited thereto, and may be respectively provided so that the inner walls thereof have circular shapes in section.

The end of each passage in which the washing water flows may include a washing water jet port 1232 through which the washing water is discharged to the outside. The washing water jet port 1232 may be provided at an end of the jet nozzle 1200. However, in the embodiment of the present disclosure, the washing water jet port 1232 is provided at a concave portion 1230 which is formed at the end of the jet nozzle 1200 to be more concave than the adjacent jet nozzle 1200. That is, the washing water jet port 1232 is not exposed to the outside but disposed at a portion which is recessed to an inner side of the jet nozzle 1200, and thus the washing water jet port 1232 may be protected. In the case in which the washing water jet port 1232 is exposed to the outside, the washing water jet port 1232 may be deformed by an external influence, and thus the washing water may not be uniformly jetted. However, due to the configuration according to the embodiment, the washing water jet port 1232 may be protected, and the washing water may be uniformly jetted.

Hereinafter, a manufacturing method of the jet nozzle 1200 according to the embodiment will be described.

The first nozzle inner wall 1212 and the second nozzle inner wall 1222 defining the first jet passage 1210*a* and the second jet passage 1220*a* may be formed by a first core 1240 and a second core 1242 which are disposed to be opposed to each other.

Specifically, the first and second cores 1240 and 1242 are provided to have cavities corresponding to exteriors of the passage and the jet nozzle 1200 through which the washing water may flow, and also to be opposed to each other. Further, a portion of the first core 1240 corresponding to the jet passage and a portion of the second core 1242 corresponding to the jet passage may be formed to have different diameters from each other. That is, the portion of the first core 1240 defining the jet passage and the portion of the second core 1242 defining the jet passage may be formed to have different end diameters from each other.

The first core 1240 and the second core 1242 are coupled to each other, and a molding material is poured into the cavities, and then the jet nozzle 1200 may be injection-molded.

A parting surface 1244 may be formed by a portion in which the first core 1240 and the second core 1242 are coupled. The parting surface 1244 may be formed at the jet passage. In the injection molding, a burr may be generated at the parting surface 1244 formed by the coupling between the cores, and the parting surface 1244 may be disposed at the jet passage instead of the washing water jet port 1232 as an outlet port of the jet passage. In the case in which the parting surface 1244 is formed at the washing water jet port 1232 and the burr is generated, the jet direction of the washing water may be deformed, and thus the washing water may not be jetted in a desired direction. Therefore, due to such configuration, even when the burr is generated in the manufacturing process, the jet direction of the washing water may be readjusted by the second nozzle inner wall 1222 provided after the parting surface 1244, and thus the jetting of the washing water may be easily controlled.

The first and second cores 1240 and 1242 may be formed so that a cross sectional area of the jet passage becomes smaller in a direction facing the parting surface 1244.

The jet passage of the jet nozzle 1200, which is defined by the first and second cores 1240 and the 1242 may be applied to a case of having the nozzle inner wall defined by the plurality of passage inner walls like in the embodiment, and also applied to the jet nozzle 1200 having the nozzle inner wall which has the circular shape in section.

Hereinafter, a dish washing machine according to a sixth embodiment will be described.

Figure 67:
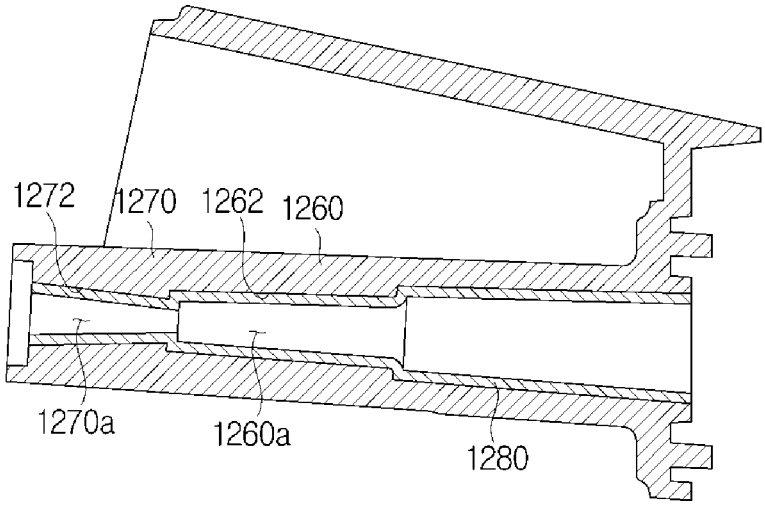
FIG. 67 is a cross-sectional view of a jet nozzle in accordance with a sixth embodiment of the present disclosure.

FIG. 67 is a cross-sectional view of a jet nozzle in accordance with a sixth embodiment of the present disclosure.

The description of the same configuration as that described previously will be omitted.

A jet nozzle 1250 may include a first jet nozzle 1260 and a second jet nozzle 1270. A nozzle inner wall may include a first nozzle inner wall 1262 and a second nozzle inner wall 1272. The jet nozzle 1250 may include a nozzle tip 1280 formed to cover at least part of the nozzle inner wall.

The nozzle tip 1280 is formed of a metallic material to minimize damage of the jet nozzle 1250 due to the continuous flow of the washing water flowing in a first jet passage 1260*a* or a second jet passage 1270*a* of the jet nozzle 1250, and also to prevent the flow of the washing water from being changed by the burr or the like which may be generated when the jet nozzle 1250 is injection-molded.

The nozzle tip 1280 may be formed to cover at least part of the nozzle inner wall, and may be formed at the entire nozzle inner wall. A cross sectional shape of the nozzle tip 1280 may be changed according to the shape of the nozzle inner wall. In the embodiment of the present disclosure, since the first nozzle inner wall 1262 and the second nozzle inner wall 1272 respectively include a plurality of first passage inner wall 1264 and a plurality of second passage inner wall 1274, the nozzle tip 1280 has the shape in section corresponding to this configuration. But the present disclosure is not limited thereto, and the nozzle tip 1280 may be configured to have a circular cross section in the case of the nozzle inner wall having the circular cross section. That is, the present disclosure is not limited to the shape of the nozzle inner wall, and it is satisfied as long as the nozzle tip 1280 is formed to protect the nozzle inner wall.

The nozzle tip 1280 may be formed to cover the nozzle inner walls by the injection molding method in the fifth embodiment and an additional insert injection molding method. However, the manufacturing method is not limited thereto, and it is satisfied as long as the nozzle tip 1280 is provided to cover the at least part of the nozzle inner wall.

Hereinafter, a dish washing machine according to a seventh embodiment will be described.

Figure 68:
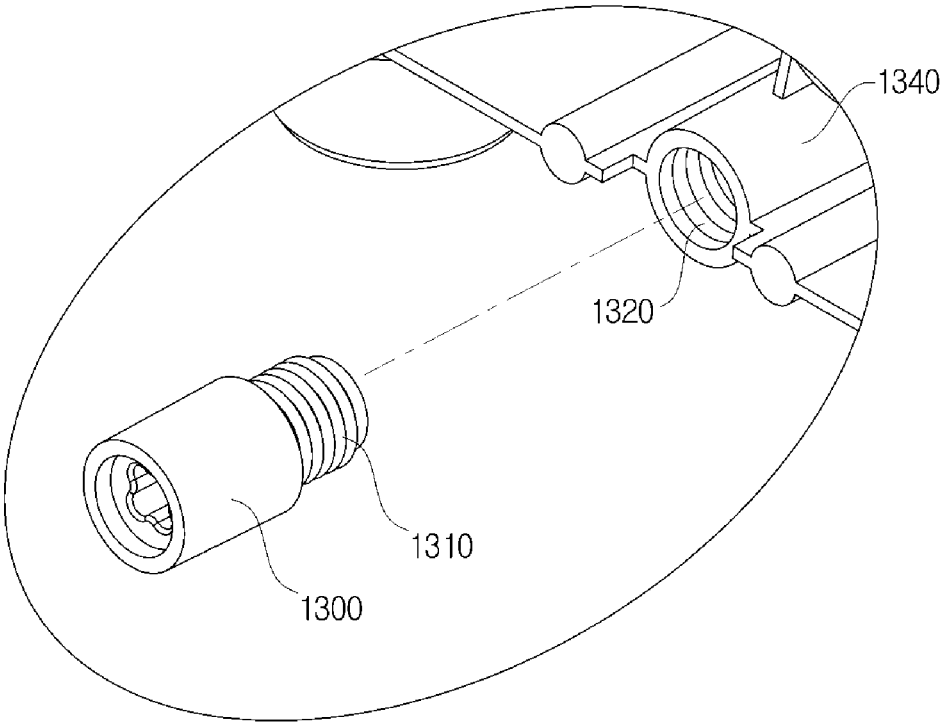
FIG. 68 is a perspective view of a jet nozzle in accordance with a seventh embodiment of the present disclosure.
Figure 69:
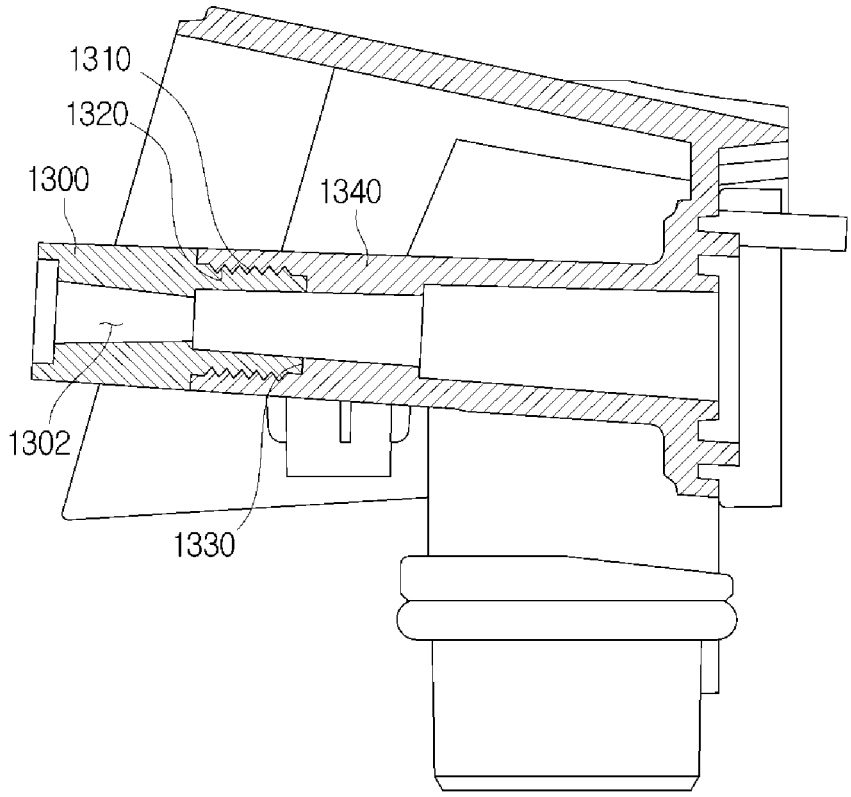
FIG. 69 is a cross-sectional view of the jet nozzle in accordance with the seventh embodiment of the present disclosure.

FIG. 68 is a perspective view of a jet nozzle in accordance with a seventh embodiment of the present disclosure. FIG. 69 is a cross-sectional view of the jet nozzle in accordance with the seventh embodiment of the present disclosure.

The description of the same configuration as that described previously will be omitted.

A jet nozzle 1300 may be formed to be removably coupled to a fixed nozzle assembly 1340. A pressure and a jet amount of the washing water should be changed according to a capacity of the washing tub, kinds of the received dishes or the like. In the case in which the jet nozzle 1300 is integrally formed with the fixed nozzle assembly 1340, since it is necessary to change the fixed nozzle assembly 1340 itself, it is inefficient. Therefore, the jet nozzle 1300 may be provided to be replaced.

A thread portion 1310 may be formed at an outer circumferential surface of the jet nozzle 1300 to be screw-coupled to the fixed nozzle assembly 1340. The fixed nozzle assembly 1340 may have a thread groove portion 1320 formed to correspond to the thread portion 1310. The thread portion 1310 and the thread groove portion 1320 may be formed to have the same lengths and thus to prevent excessive or loose insertion of the jet nozzle 1300 when the jet nozzle 1300 is coupled to the fixed nozzle assembly 1340.

That is, a stopper portion 1330 configured to prevent the thread portion 1310 from being inserted over a predetermined section is provided at an end of the thread groove portion 1320, and thus deformation of a jet passage 1302 or twist of the jet nozzle 1300 due to the excessive insertion of the thread portion 1310 into the thread groove portion 1320 is prevented.

Hereinafter, a dish washing machine according to an eighth embodiment will be described.

Figure 70:
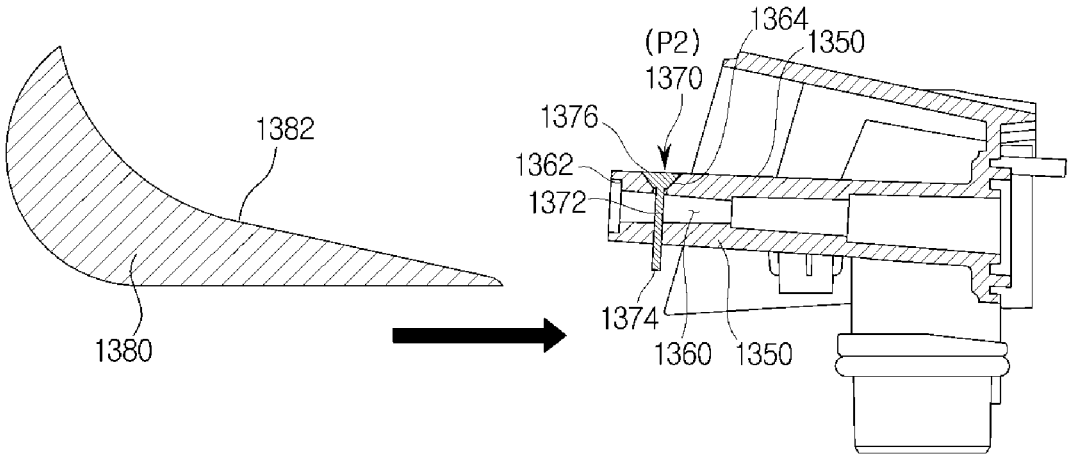
FIGS. 70 and 71 are views illustrating an operation of a jet nozzle in accordance with an eighth embodiment of the present disclosure.
Figure 71:
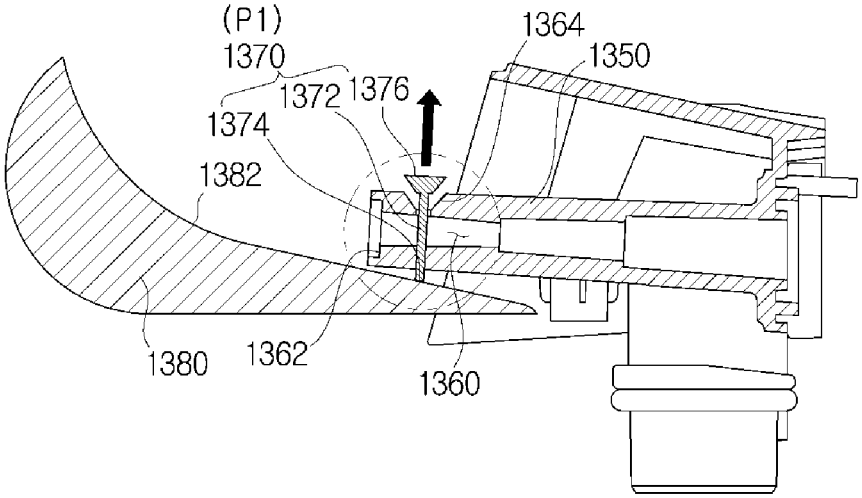
Figure 72:
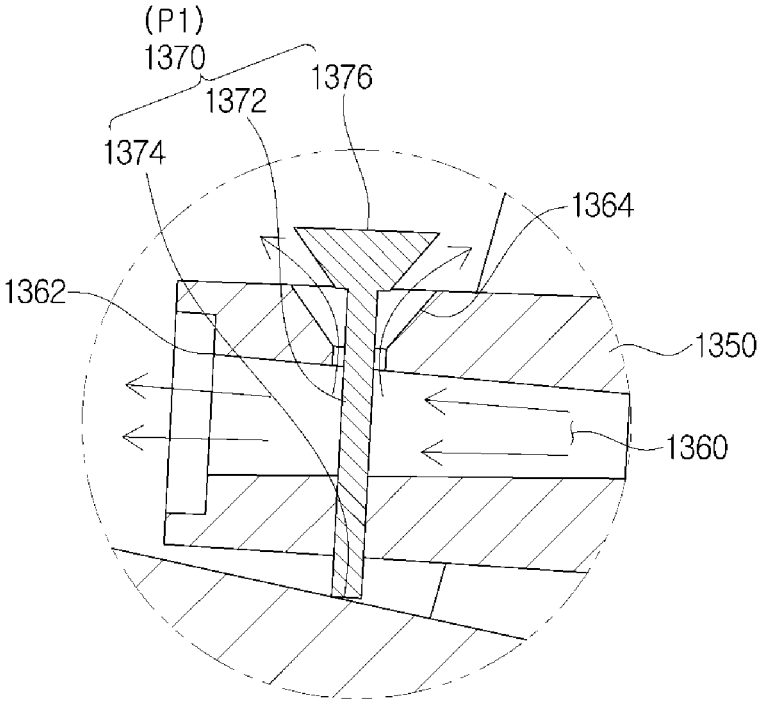
FIG. 72 is an enlarged view of part of the jet nozzle in accordance with the eighth embodiment of the present disclosure.

FIGS. 70 and 71 are views illustrating an operation of a jet nozzle in accordance with an eighth embodiment of the present disclosure. FIG. 72 is an enlarged view of part of the jet nozzle in accordance with the eighth embodiment of the present disclosure.

The description of the same configuration as that described previously will be omitted.

A jet nozzle 1350 may include a sub-jet hole 1364.

The sub-jet hole 1364 is provided to pass through the jet nozzle 1350, such that an outer side of the jet nozzle 1350 and a jet passage 1360 in the jet nozzle 1350 are in communication with each other.

The arrangement of the sub-jet hole 1364 is not limited. In the embodiment, the sub-jet hole 1364 may be provided to pass through a passage of the jet nozzle 1350 in up and down directions.

The sub-jet hole 1364 may be provided to be opened and closed by an opening/closing member 1370.

The opening/closing member 1370 is provided to be moved between an opening position P1 opening the sub-jet hole 1364 and a closing position P2 closing the sub-jet hole 1364. Specifically, the opening/closing member 1370 may include an opening/closing member body 1372, a pressing protrusion portion 1374 provided at a lower portion of the opening/closing member body 1372 to be pressed by a vane 1380 to be described later, and an opening/closing portion 1376 provided at an upper portion of the opening/closing member body 1372 to selectively open the sub-jet hole 1364.

Hereinafter, an operation of the dish washing machine according to the embodiment will be described.

As described in the above-mentioned embodiment, the vane 1380 is provided to be movable in the washing tub. The vane 1380 presses the pressing protrusion portion 1374 of the opening/closing member 1370, while being moved toward the jet nozzle 1350. Specifically, a reflecting surface 1382 by which the washing water is reflected is provided to extend long from the vane 1380 toward the opening/closing member 1370. When the vane 1380 is moved to the jet nozzle 1350, the pressing protrusion portion 1374 of the opening/closing member 1370 is pressed by the reflecting surface 1382 formed to extend long.

The opening/closing member 1370 of which the pressing protrusion portion 1374 is pressed is moved upward, and thus the opening/closing portion opens the sub-jet hole 1364. In this process, the washing water passing through the jet passage 1360 is discharged through the sub-jet hole 1364 as well as a washing water jet port 1362, and thus jetted to an upper side of the fixed nozzle assembly. In other words, the opening/closing member 1370 is moved from the closing position P2 to the opening position P1 by movement of the vane 1380, and the sub-jet hole 1364 is opened, and the washing water is jetted through the sub-jet hole 1364.

In the case in which the washing water is reflected by only the vane 1380, only an upper side of a moving path of the vane 1380 is affected. In this case, an upper side of the fixed nozzle assembly, which is not located at the moving path of the vane 1380, is not washed by the washing water.

However, since the sub-jet hole 1364 may be selectively opened, and the washing water may be branched to the upper side of the fixed nozzle assembly, a dead zone which is not affected by the washing water may be reduced. Further, contaminants which may be accumulated in the fixed nozzle assembly may be washed through this operation, and thus it is possible to extend a life span of the dish washing machine and also to prevent a bad smell or the like due to the contaminants.

Hereinafter, a dish washing machine according to a ninth embodiment will be described.

Figure 73:
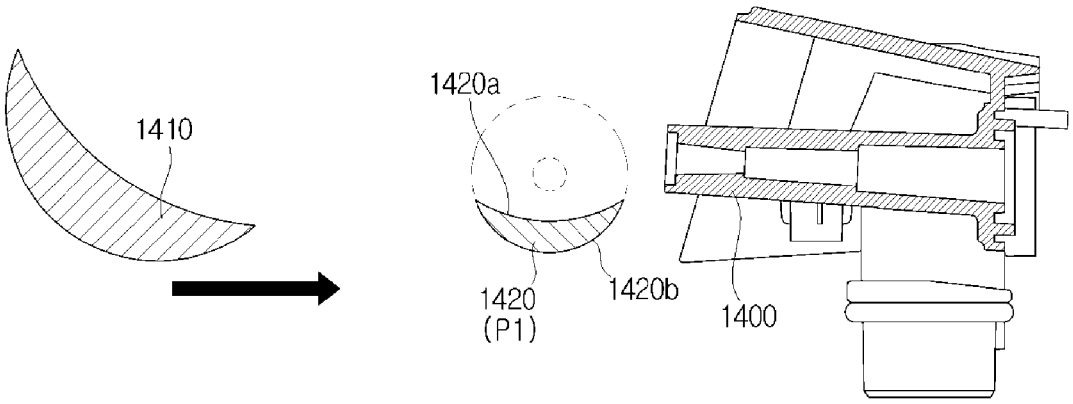
FIGS. 73 and 74 are views illustrating an operation of a jet nozzle in accordance with a ninth embodiment of the present disclosure.
Figure 74:
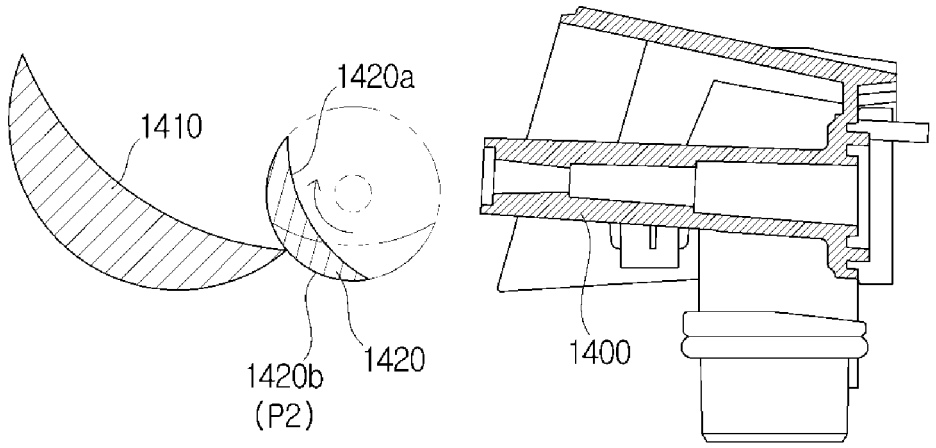

FIGS. 73 and 74 are views illustrating an operation of a jet nozzle in accordance with a ninth embodiment of the present disclosure.

The description of the same configuration as that described previously will be omitted.

A vane 1410 is movably provided to reflect the washing water jetted from the fixed nozzle assembly to the basket. The embodiment includes the vane 1410 provided to be movable, and a sub-vane 1420 fixed to be rotatable.

The sub-vane 1420 may be provided to be rotated between a standby position P1 disposed at an end of a jet nozzle 1400 to be spaced apart from the flow direction of the washing water and a reflecting position P2 disposed in the flow direction of the washing water to reflect a direction of the washing water.

An operation of the sub-vane 1420 may be achieved by movement of the vane 1410. Specifically, when the vane 1410 is moved toward the jet nozzle 1400, a rear surface 1420*b* of a reflecting surface 1420*a* of the sub-vane 1420, by which the washing water is reflected, is pressed by the vane 1410, and the sub-vane 1420 is rotated from the standby position P1 to the reflecting position P2 by the pressing of the vane 1410.

When the sub-vane 1420 is located at the standby position P1, the washing water jetted from the jet nozzle 1400 is reflected to the basket by the moving vane 1410, and when the sub-vane 1420 is located at the reflecting position P2, the washing water jetted from the jet nozzle 1400 is reflected by the sub-vane 1420 rotated from the standby position P1 and directed to an upper side of the fixed nozzle assembly.

When the washing water is reflected by the vane 1410, only an upper side of a moving path of the vane 1410 is affected. In this case, the upper side of the fixed nozzle assembly, which is not located at the moving path of the vane 1410, is not washed by the washing water.

However, since the sub-vane 1420 is rotated from the standby position P1 to the reflecting position P2, the flow direction of the washing water may be reflected at a right angle or more, and thus a dead zone which is not affected by the washing water may be reduced. Further, contaminants which may be accumulated in the fixed nozzle assembly or the jet nozzle may be washed through this operation, and thus it is possible to extend a life span of the dish washing machine and also to prevent a bad smell or the like due to the contaminants.

In the above-mentioned embodiments, partial configurations of the dish washing machine according to other embodiments were respectively described. However, these configurations may be applied together, and the description of the same configuration as that described previously was omitted.

Through the jet unit according to the present disclosure and the dish washing machine having the same, the straightness of the jet nozzle can be enhanced, and thus the size of the jet unit can be reduced, and the dish washing machine can have a compact structure.

Further, since it is possible to increase the current speed of the washing water, the washing efficiency can be improved.

Also, the durability of the jet nozzle can be enhanced.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dish washing machine comprising:

a cabinet configured to form an exterior;

a washing tub provided in the cabinet to wash dishes; and a jet nozzle configured to jet washing water to the washing tub, wherein the jet nozzle comprises a plurality of inner walls of a passage through which the washing water passes, and at least one of the plurality of inner walls has a cross sectional area formed in an arc shape that is convex in an outer circumferential direction of the jet nozzle, and wherein the plurality of nozzle inner walls extends to the end of the jet nozzle for linearity of the washing water sprayed from the jet nozzle.

2. The dish washing machine according to claim 1, wherein centers of curvature radii of the plurality of inner walls are spaced apart from each other.

3. A dish washing machine comprising:

a cabinet configured to form an exterior;

a washing tub provided in the cabinet to wash dishes; and a jet nozzle configured to jet washing water to the washing tub, wherein the jet nozzle comprises a plurality of inner walls of a passage through which the washing water passes, and at least one of the plurality of inner walls has a cross sectional area formed in an arc shape that is convex in an outer circumferential direction of the jet nozzle, wherein a size of the cross sectional area of the passage at a first point is formed to be wider than that of the passage at a second point which is located downstream of the first point.

4. The dish washing machine according to claim 1, wherein the plurality of inner walls are in contact with each other and protrude toward a center of the passage to form a plurality of protrusions.

5. The dish washing machine according to claim 4, wherein the plurality of protrusions extend in the same direction as the flow direction of the washing water.

6. The dish washing machine according to claim 4, wherein the plurality of protrusions are arranged along the passage to be spaced apart from each other in a circumferential direction.

7. The dish washing machine according to claim 4, wherein the plurality of protrusions have a first height at a first point, the plurality of protrusions have a second height at a second point which is located downstream of the first point in the flow direction of the washing water, and the second height is greater than the first height.

8. The dish washing machine according to claim 4, wherein the plurality of protrusions are formed to have convexly curved shapes toward the passage.

* * * * *